US011060749B2

(12) United States Patent
Hur et al.

(10) Patent No.: US 11,060,749 B2
(45) Date of Patent: Jul. 13, 2021

(54) AIR CONDITIONER CONTROLLING SYSTEM AND AIR CONDITIONER CONTROLLING METHOD

(71) Applicant: Samsung Electronics Co., Ltd, Suwon-si (KR)

(72) Inventors: Jae Hun Hur, Yongin-si (KR); Min Gyu Kim, Seongnam-si (KR); Chang-Yong Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 462 days.

(21) Appl. No.: 16/063,676

(22) PCT Filed: Dec. 7, 2016

(86) PCT No.: PCT/KR2016/014296
§ 371 (c)(1),
(2) Date: Jun. 18, 2018

(87) PCT Pub. No.: WO2017/105028
PCT Pub. Date: Jun. 22, 2017

(65) Prior Publication Data

US 2020/0284460 A1 Sep. 10, 2020

(30) Foreign Application Priority Data

Dec. 17, 2015 (KR) ..... 10-2015-0181148

(51) Int. Cl.
*F24F 11/54* (2018.01)
*F24F 11/64* (2018.01)
(Continued)

(52) U.S. Cl.
CPC ..... *F24F 11/54* (2018.01); *F24F 11/30* (2018.01); *F24F 11/64* (2018.01); *F24F 11/56* (2018.01); *F24F 11/89* (2018.01)

(58) Field of Classification Search
CPC ..... B60W 2050/143; B60W 2420/403; B60W 2420/52; B60W 2554/00;
(Continued)

(56) References Cited

U.S. PATENT DOCUMENTS 5,647,223 A * 7/1997 Wada ..... G05D 23/1905 62/175
2006/0123811 A1* 6/2006 Ha ..... F24F 11/62 62/175
(Continued)

FOREIGN PATENT DOCUMENTS

CN 1719135 A 1/2006
CN 101539314 A 9/2009
(Continued)

OTHER PUBLICATIONS

International Search Report dated Mar. 20, 2017 in connection with International Patent Application No. PCT/KR2016/014296.
(Continued)

*Primary Examiner* — Kidest Bahta

(57) ABSTRACT

The present disclosure relates to an air conditioner, an air conditioner controlling system, and an air conditioner controlling method. The air conditioner controlling system includes one or more controlled air conditioners, a main controlling air conditioner having control authority over, from among the one or more controlled air conditioners, one or more controlled air conditioners that belong to an upper rank group corresponding to the main controlling air conditioner, and a sub-controlling air conditioner having control authority over, from among the one or more controlled air conditioners, one or more controlled air conditioners that belong to a first lower rank group.

12 Claims, 44 Drawing Sheets

(51) Int. Cl.
*F24F 11/30* (2018.01)
*F24F 11/89* (2018.01)
*F24F 11/56* (2018.01)

(58) Field of Classification Search
CPC . B60W 2554/4026; B60W 2554/4029; B60W 2556/05; B60W 2556/10; B60W 2556/50; B60W 50/14; B60W 60/005; G01C 21/30; G01C 21/3461; G05D 1/0061; G05D 1/0088; G05D 2201/0213; G06F 16/29; G08G 1/0112; G08G 1/0129; G08G 1/0133
See application file for complete search history.

(56) References Cited

U.S. PATENT DOCUMENTS

| | | | | |
|---|---|---|---|---|
| 2008/0178615 | A1* | 7/2008 | Yoon | F24F 3/06 62/79 |
| 2009/0057425 | A1* | 3/2009 | Sullivan | F24F 11/30 236/51 |
| 2015/0293540 | A1 | 10/2015 | Izumihara et al. | |
| 2015/0350031 | A1* | 12/2015 | Burks | G06F 3/0482 715/736 |

FOREIGN PATENT DOCUMENTS

| | | | | |
|---|---|---|---|---|
| CN | 102563809 | A | 7/2012 | |
| CN | 103062869 | A | 4/2013 | |
| CN | 204830328 | U | 12/2015 | |
| KR | 10-2007-0009930 | A | 1/2007 | |
| KR | 10-2007-0031530 | A | 3/2007 | |
| KR | 10-2010-0105206 | A | 9/2010 | |
| KR | 10-2012-0004186 | A | 1/2012 | |
| KR | 101186313 | B1 * | 9/2012 | F24F 11/30 |
| KR | 10-2014-0054595 | A | 5/2014 | |

OTHER PUBLICATIONS

Written Opinion of the International Searching Authority dated Mar. 20, 2017 in connection with International Patent Application No. PCT/KR2016/014296.
European Patent Office, "Supplementary European Search Report," Application No. EP16875970.2, dated Oct. 31, 2018, 8 pages.
Office Action dated Jan. 20, 2020 in connection with Chinese Patent Application No. 201680074526.1, 24 pages.

* cited by examiner

【Fig. 1】
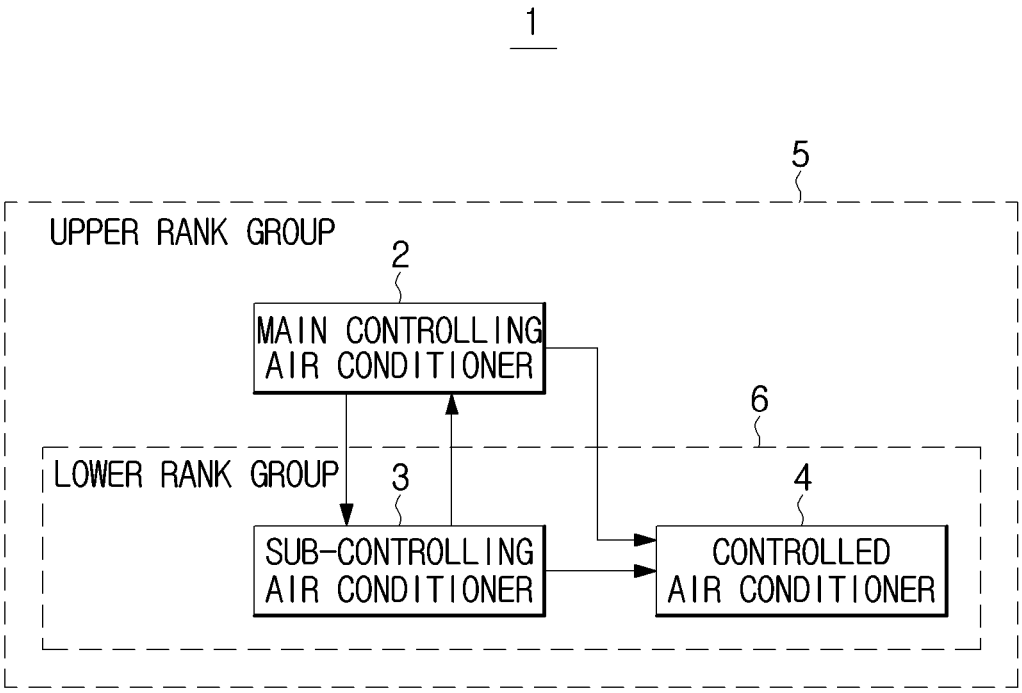

【Fig. 2】
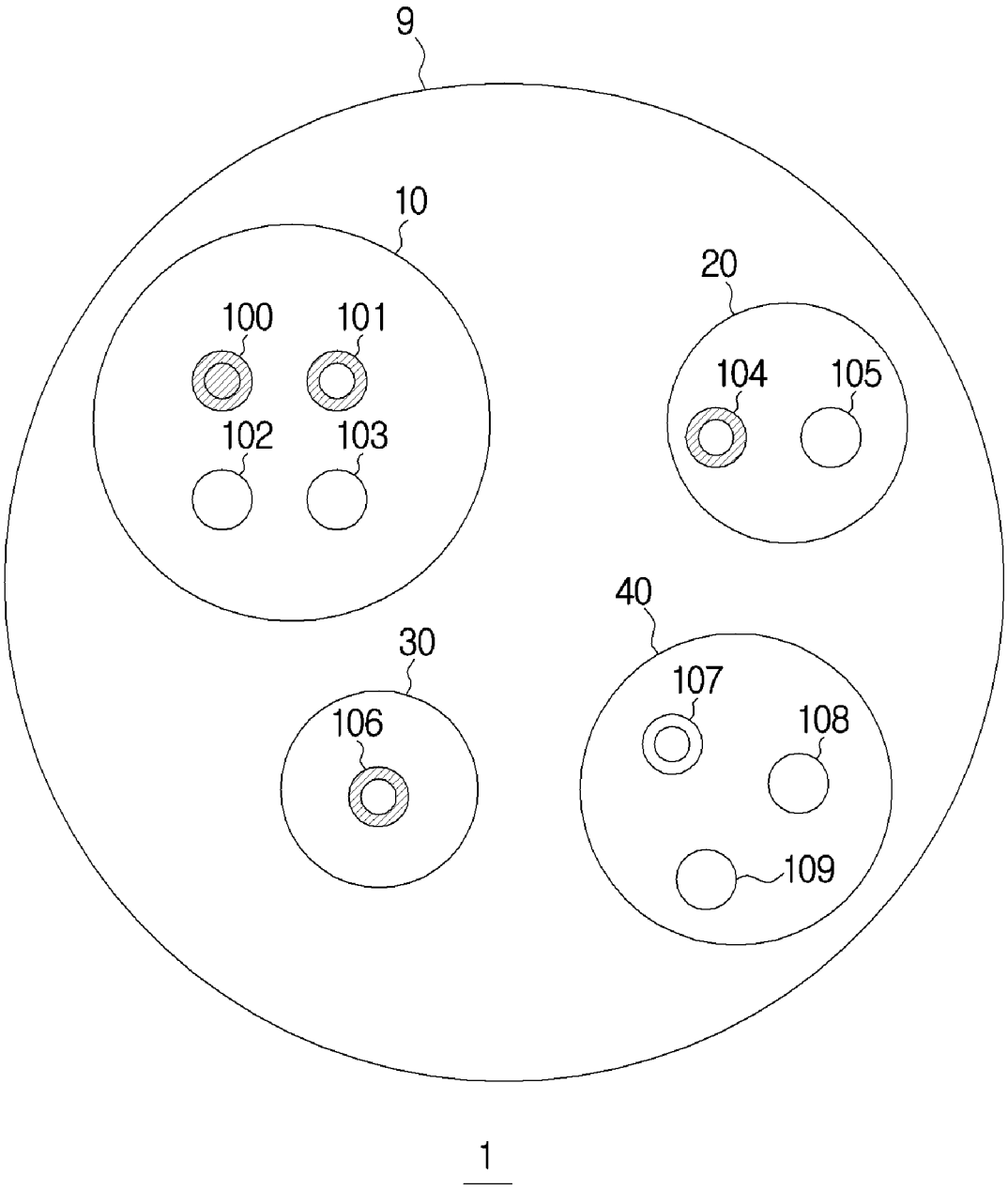

[Fig. 3]
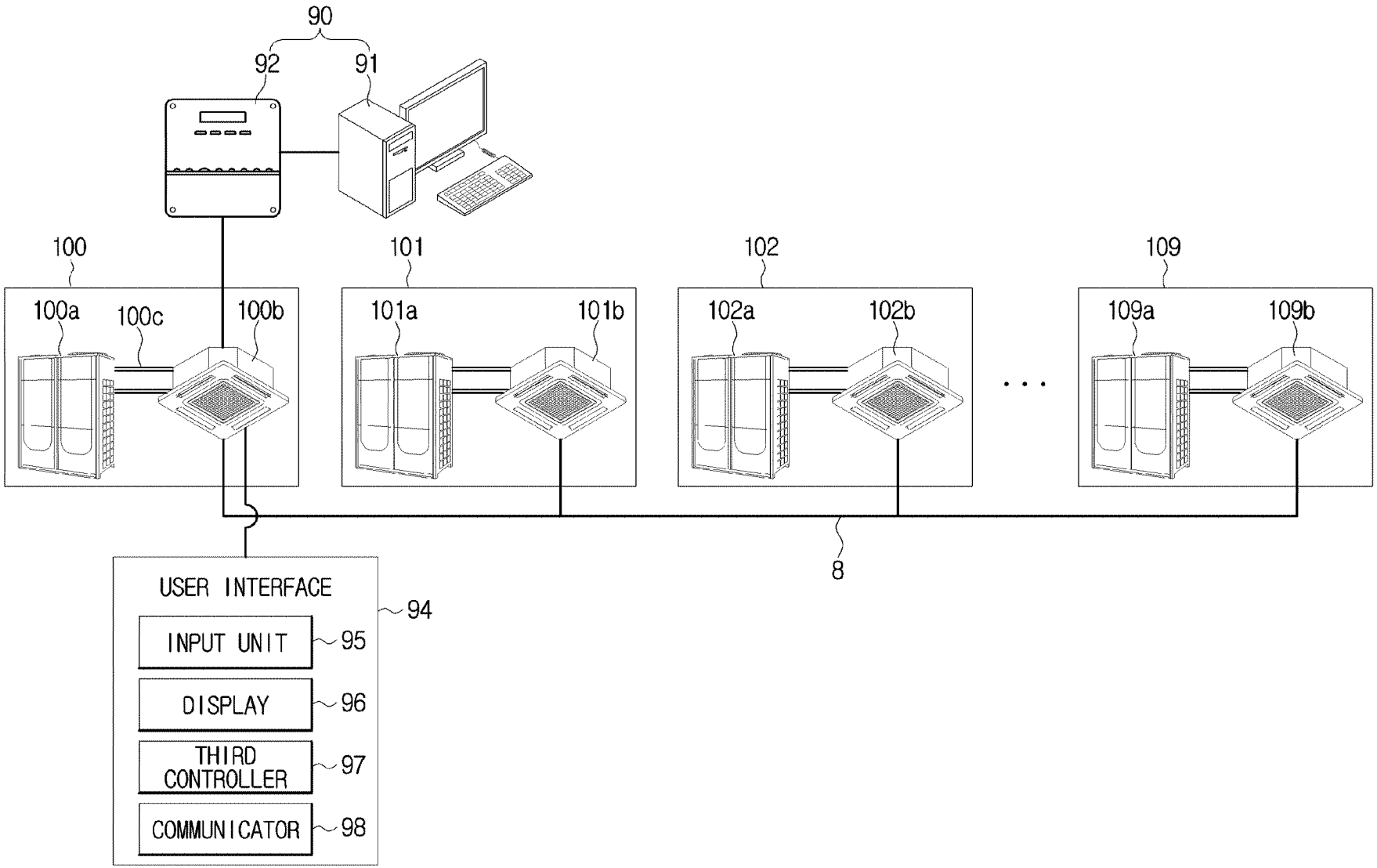

【Fig. 4】
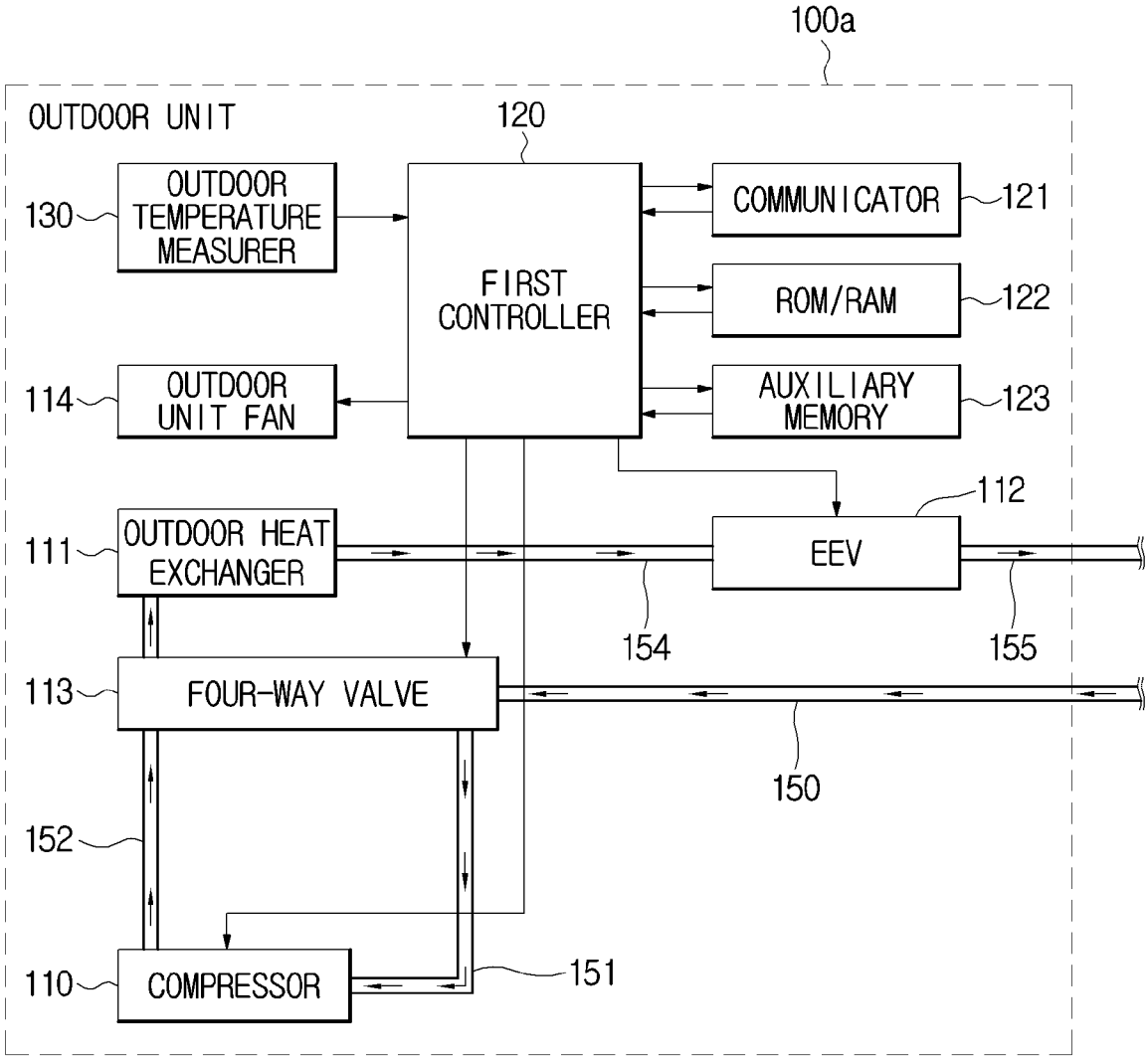

【Fig. 5】
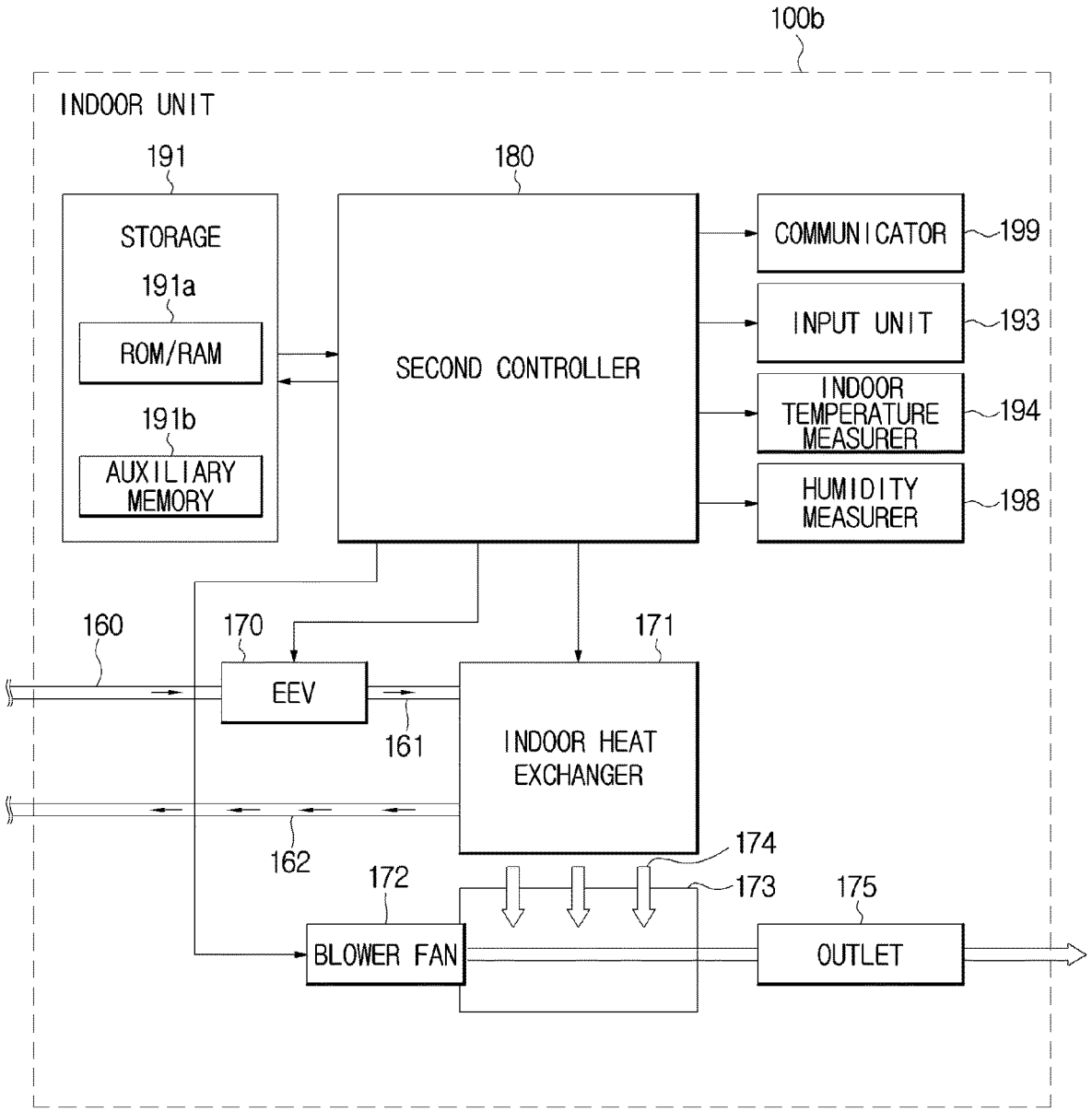

[Fig. 6]
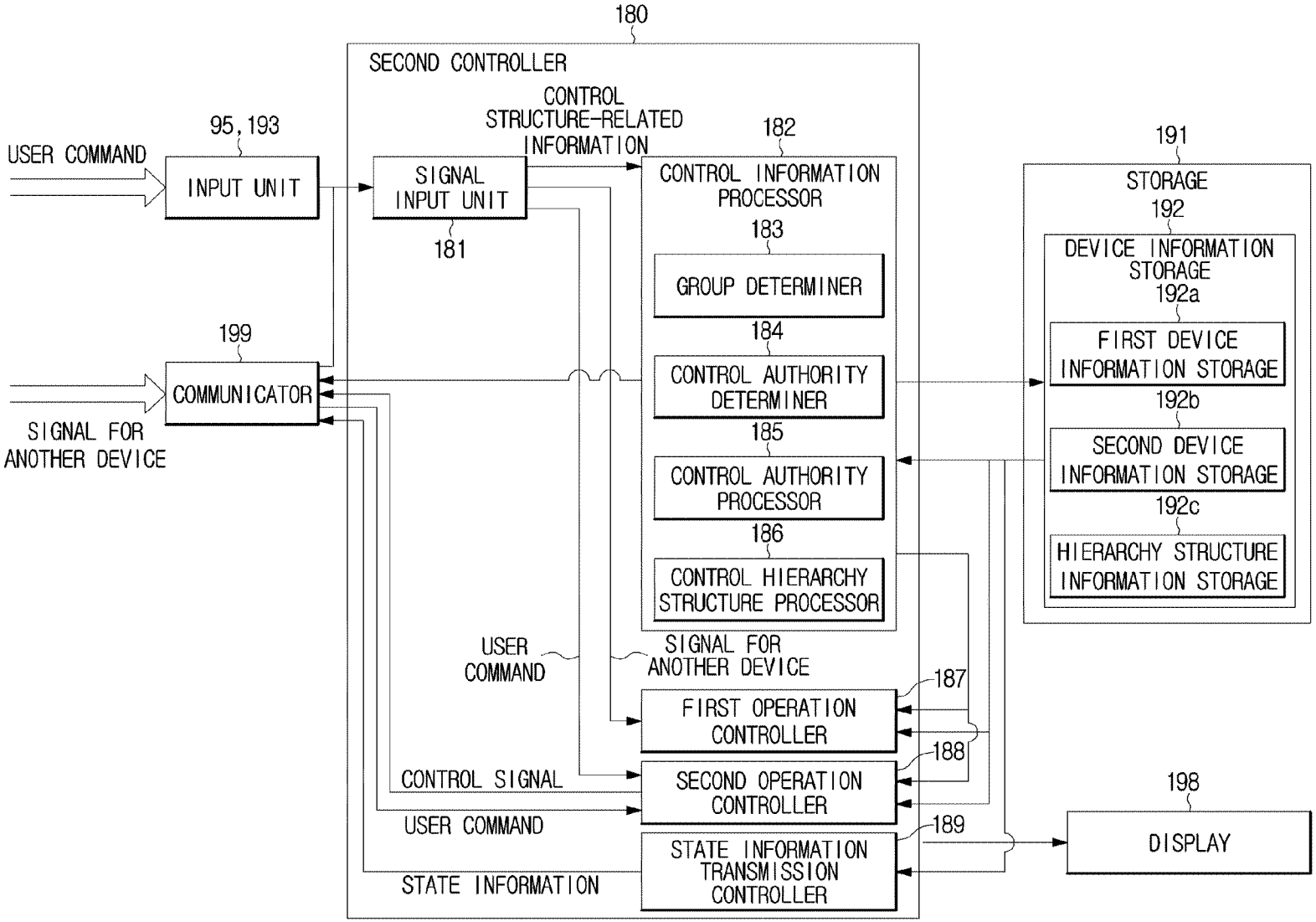

【Fig. 7】 i1

| INDEX | FIRST AIR CONDITIONER |
|---|---|
| UPPER RANK GROUP | 1 |
| LOWER RANK GROUP | 1 |
| CONTROL AUTHORITY OVER UPPER RANK GROUP | 1 |
| CONTROL AUTHORITY OVER LOWER RANK GROUP | 2 |

【Fig. 8】 i2

| INDEX | SECOND AIR CONDITIONER |
|---|---|
| UPPER RANK GROUP | 1 |
| LOWER RANK GROUP | 1 |
| CONTROL AUTHORITY OVER UPPER RANK GROUP | 1 |
| CONTROL AUTHORITY OVER LOWER RANK GROUP | 2 |

【Fig. 9】 i3

| INDEX | TENTH AIR CONDITIONER |
|---|---|
| UPPER RANK GROUP | 1 |
| LOWER RANK GROUP | 4 |
| CONTROL AUTHORITY OVER UPPER RANK GROUP | 1 |
| CONTROL AUTHORITY OVER LOWER RANK GROUP | 8 |

【Fig. 10】 i10

| ID | UPPER RANK GROUP | LOWER RANK GROUP | CONTROL AUTHORITY OVER UPPER RANK GROUP | CONTROL AUTHORITY OVER LOWER RANK GROUP |
|---|---|---|---|---|
| FIRST AIR CONDITIONER | 1 | 1 | 1 | 2 |
| SECOND AIR CONDITIONER | 1 | 1 | 1 | 2 |
| THIRD AIR CONDITIONER | 1 | 1 | 1 | 2 |
| FOURTH AIR CONDITIONER | 1 | 1 | 1 | 2 |
| FIFTH AIR CONDITIONER | 1 | 2 | 1 | 5 |
| SIXTH AIR CONDITIONER | 1 | 2 | 1 | 5 |
| SEVENTH AIR CONDITIONER | 1 | 3 | 1 | 6 |
| EIGHTH AIR CONDITIONER | 1 | 4 | 1 | 8 |
| NINTH AIR CONDITIONER | 1 | 4 | 1 | 8 |
| TENTH AIR CONDITIONER | 1 | 4 | 1 | 8 |

【Fig. 11】
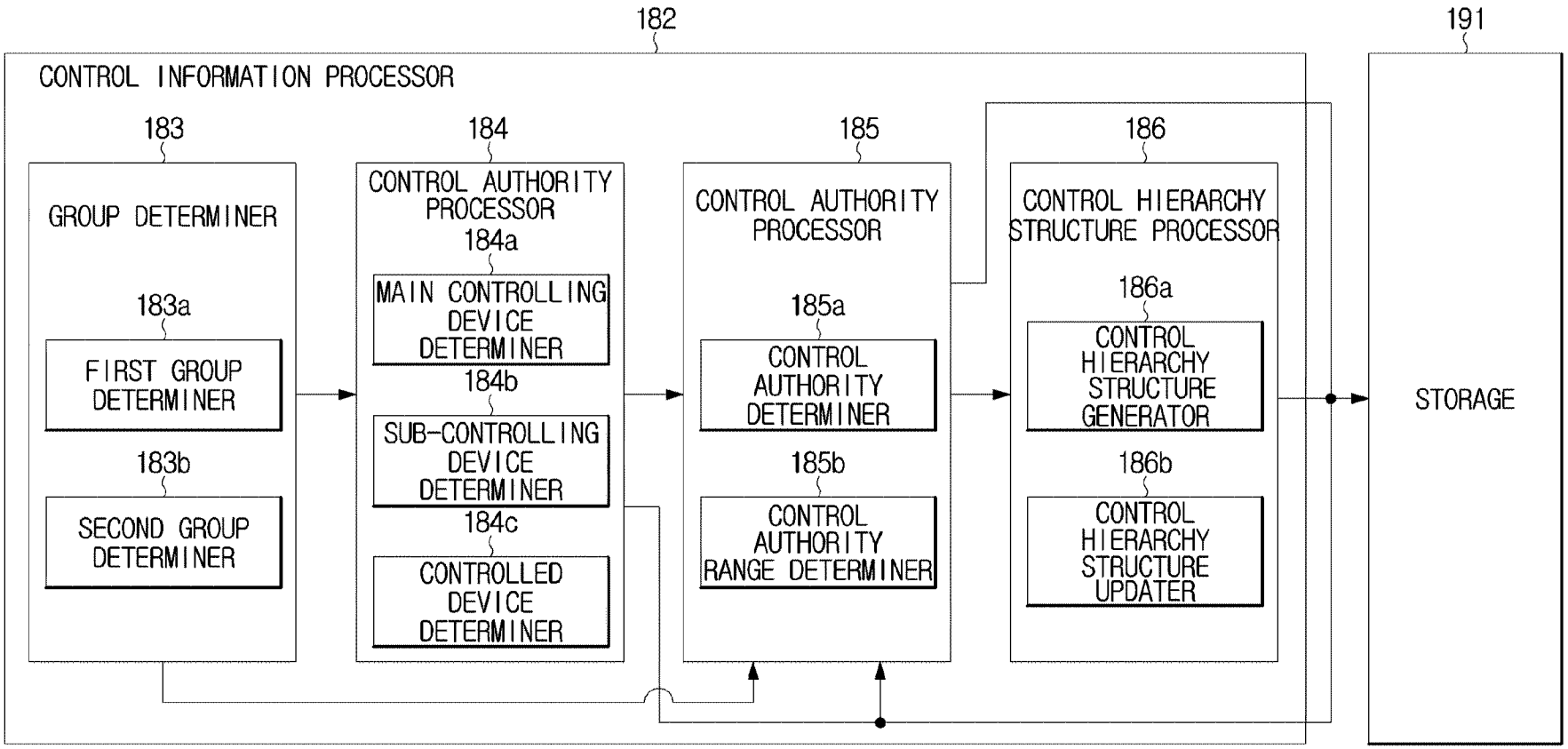

【Fig. 12】
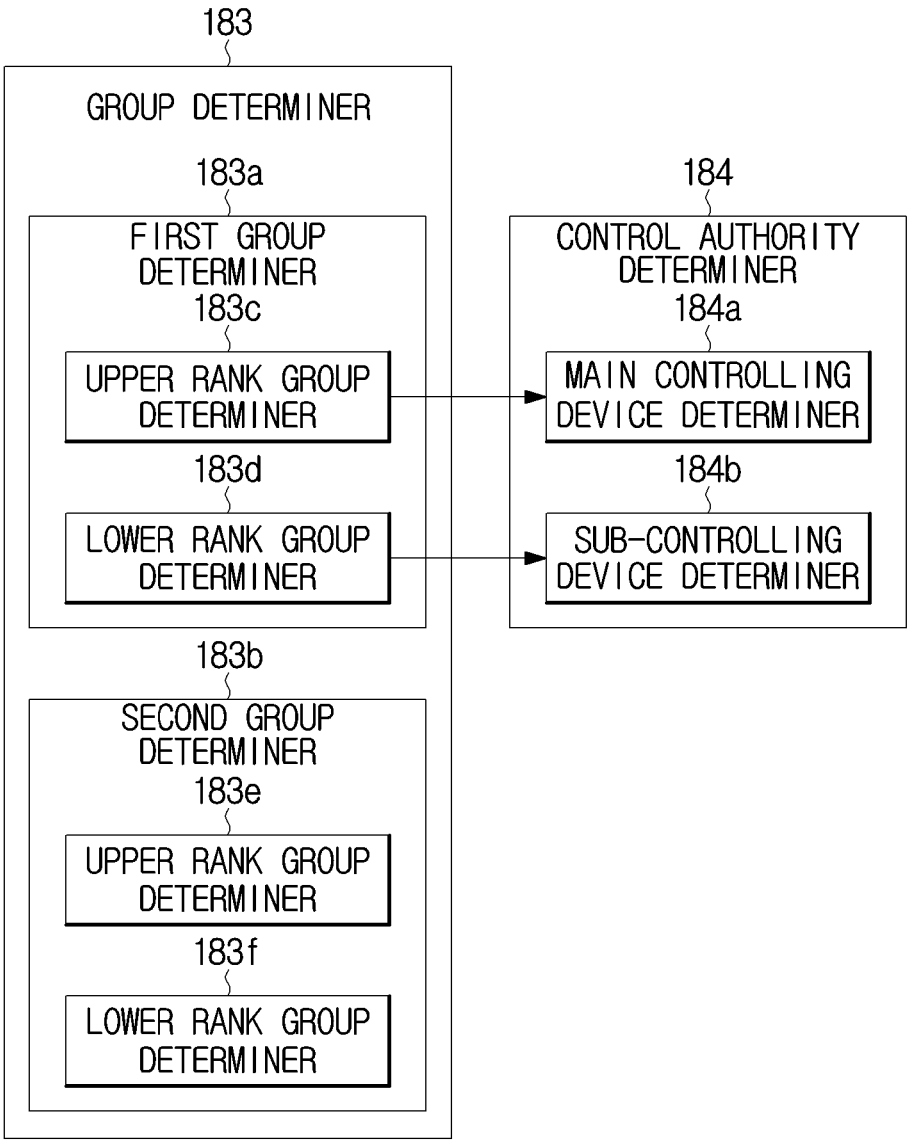

【Fig. 13】 i20

| TYPE OF CONTROL | AUTHORITY |
|---|---|
| ON / OFF | 1 |
| INCREASE SET TEMPERATURE | 1 |
| DECREASE SET TEMPERATURE | 1 |
| SET TIMER | 1 |
| BLOWING OPERATION | 2 |
| DEHUMIDIFYING OPERATION | 2 |
| ROTATION | 2 |
| ⋮ | ⋮ |

DETERMINED AS CONTROL AUTHORITY OF FIRST AIR CONDITIONER

DETERMINED AS CONTROL AUTHORITY OF SECOND AIR CONDITIONER

【Fig. 14】
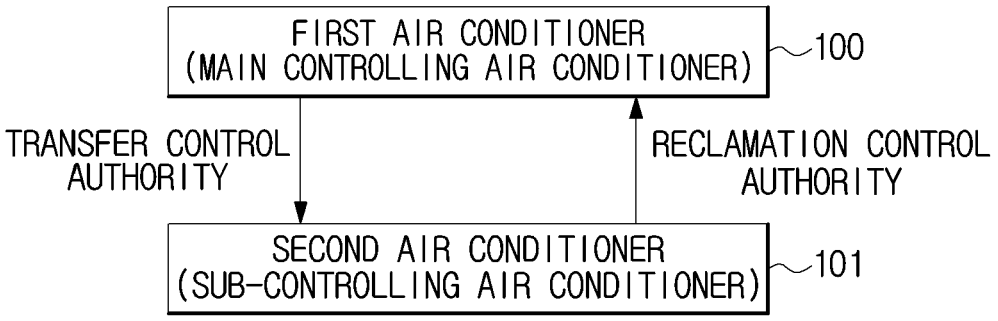

【Fig. 15】
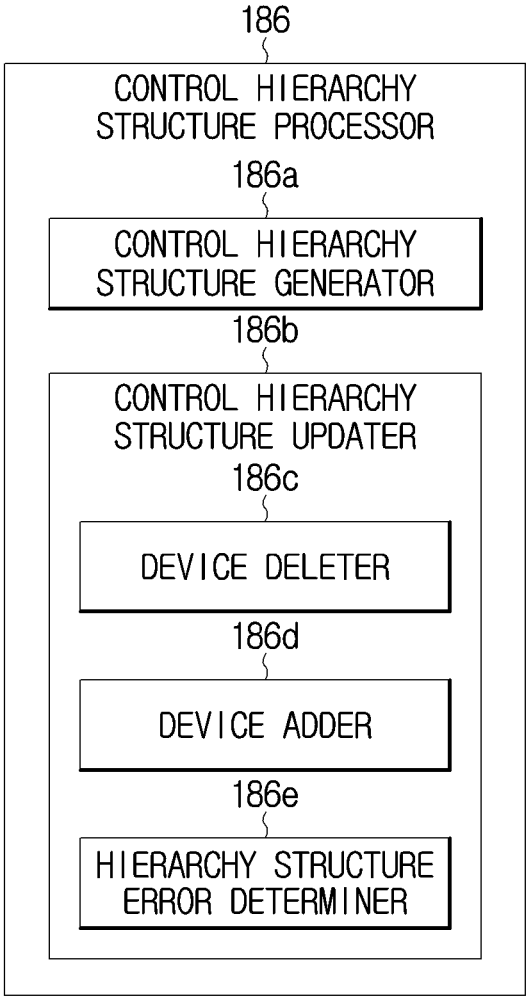

【Fig. 16】
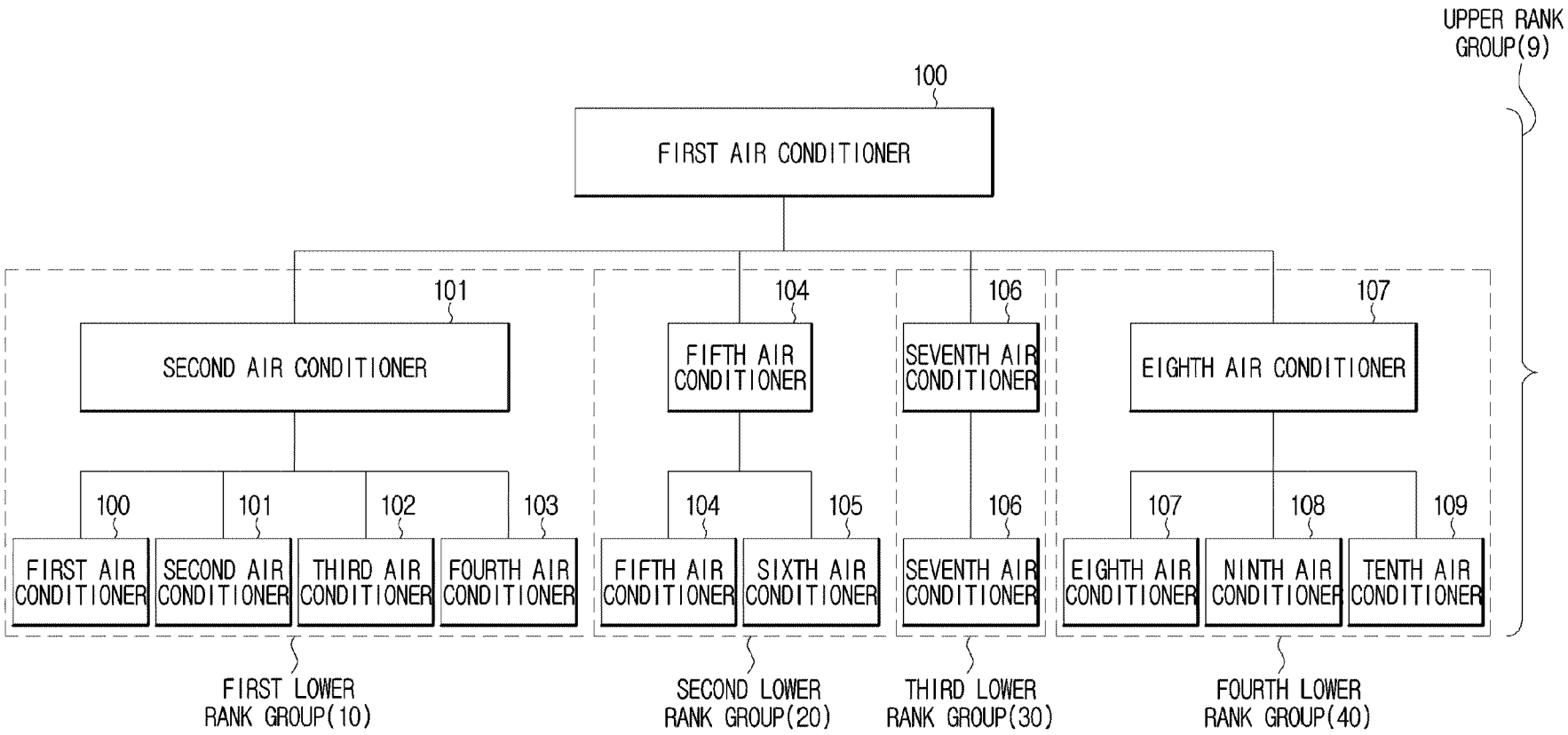

【Fig. 17】

| INDEX | FIRST TIME POINT | SECOND TIME POINT |
|---|---|---|
| FIRST AIR CONDITIONER | 0 | 0 |
| SECOND AIR CONDITIONER | 0 | 0 |
| THIRD AIR CONDITIONER | 3 | 4 |
| FIFTH AIR CONDITIONER | 1 | 0 |
| ⋮ | ⋮ | ⋮ |

COUNT IS EXCEEDED

【Fig. 18】
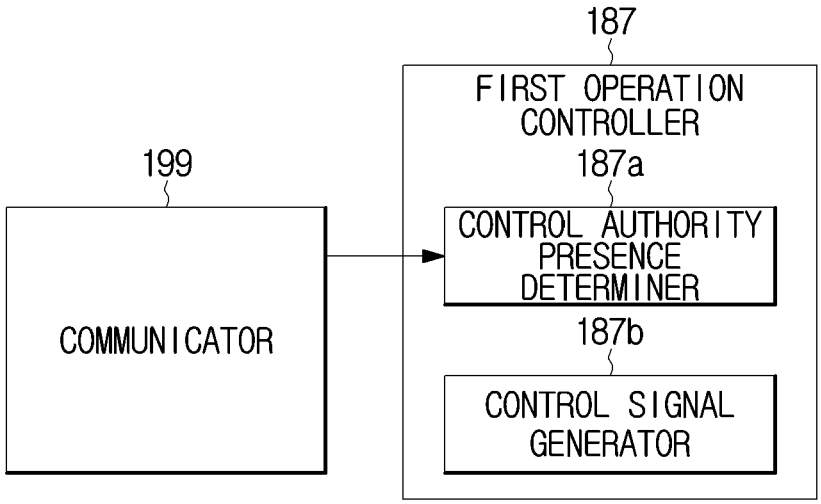

【Fig. 19】
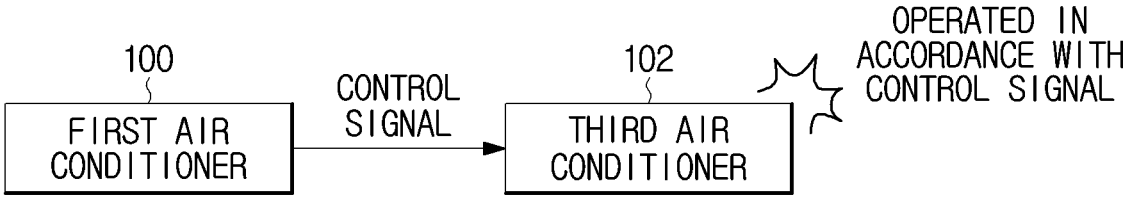

【Fig. 20】
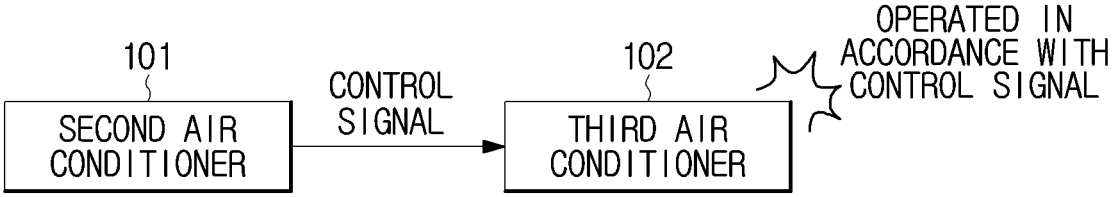

【Fig. 21】
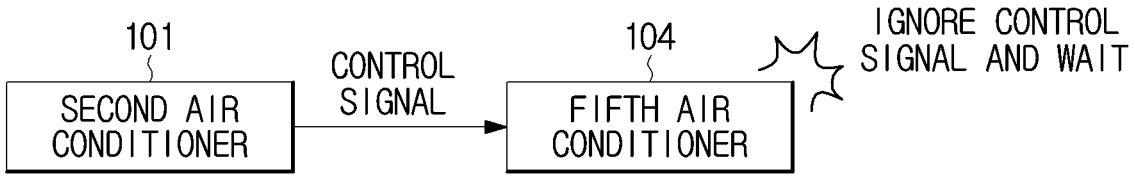

【Fig. 22】
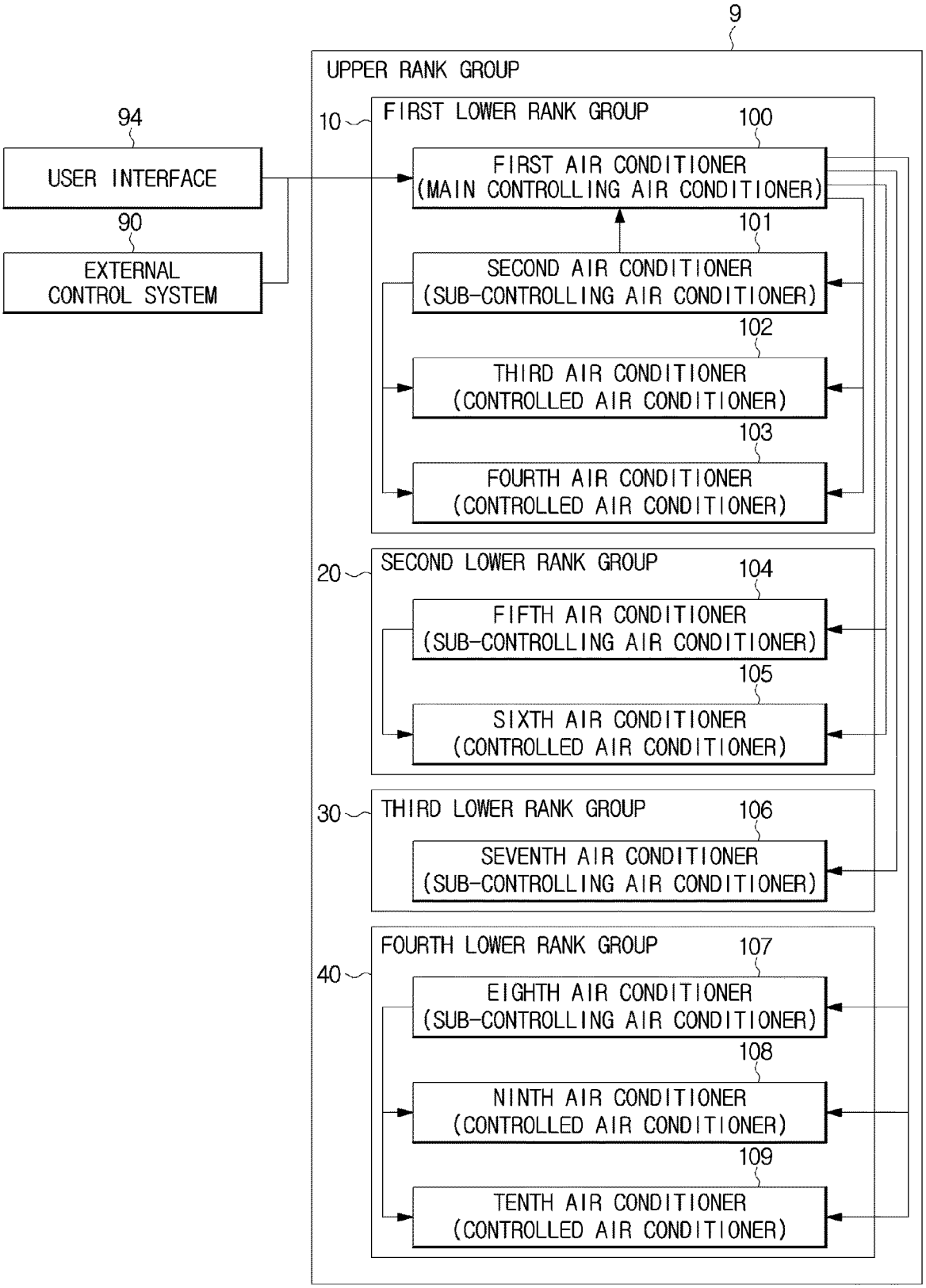

【Fig. 23】
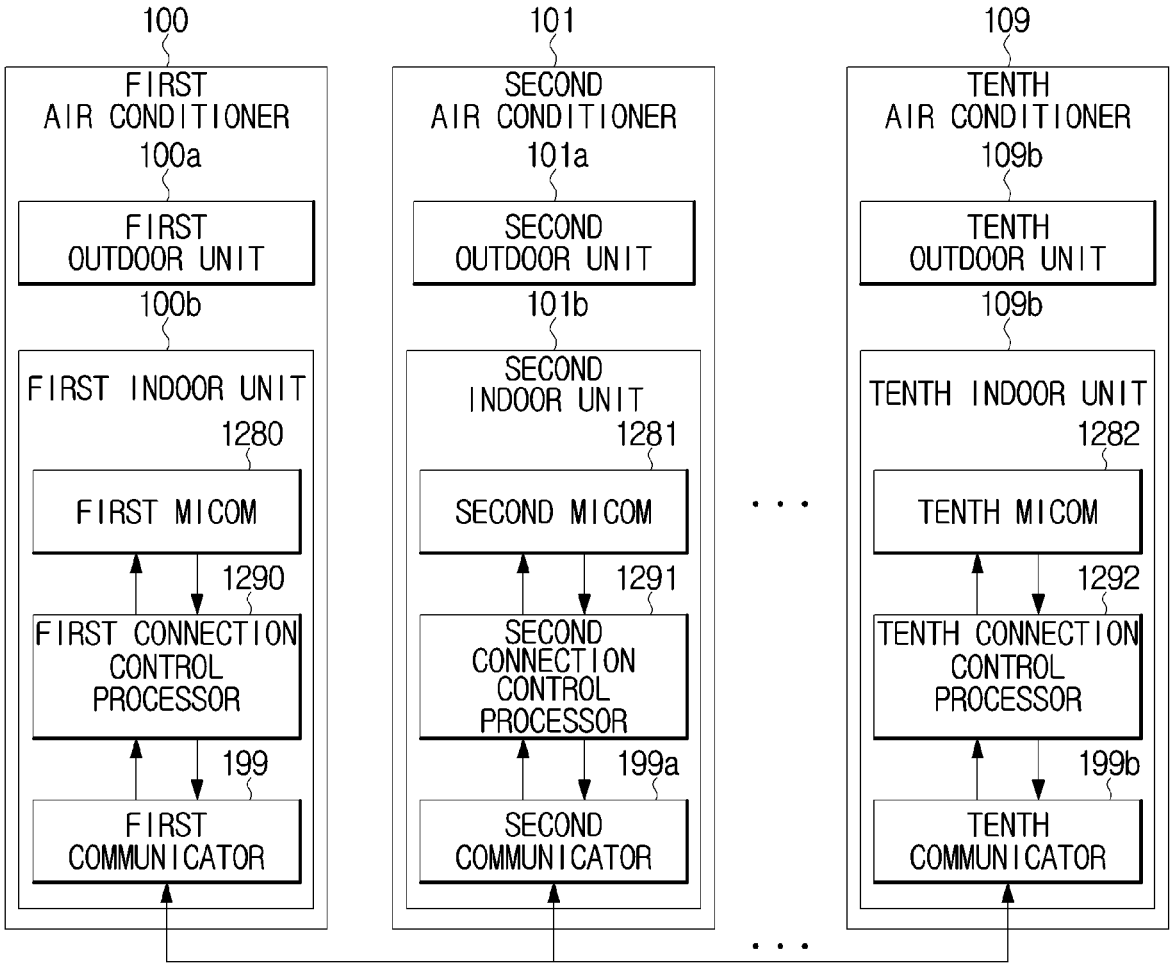

【Fig. 24】
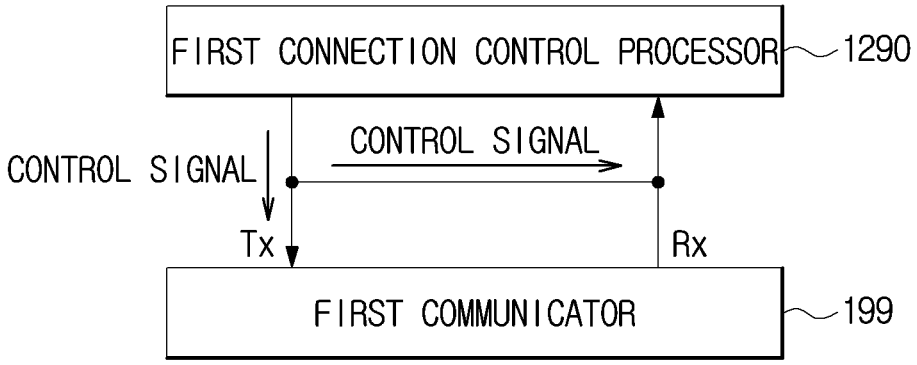

【Fig. 25】
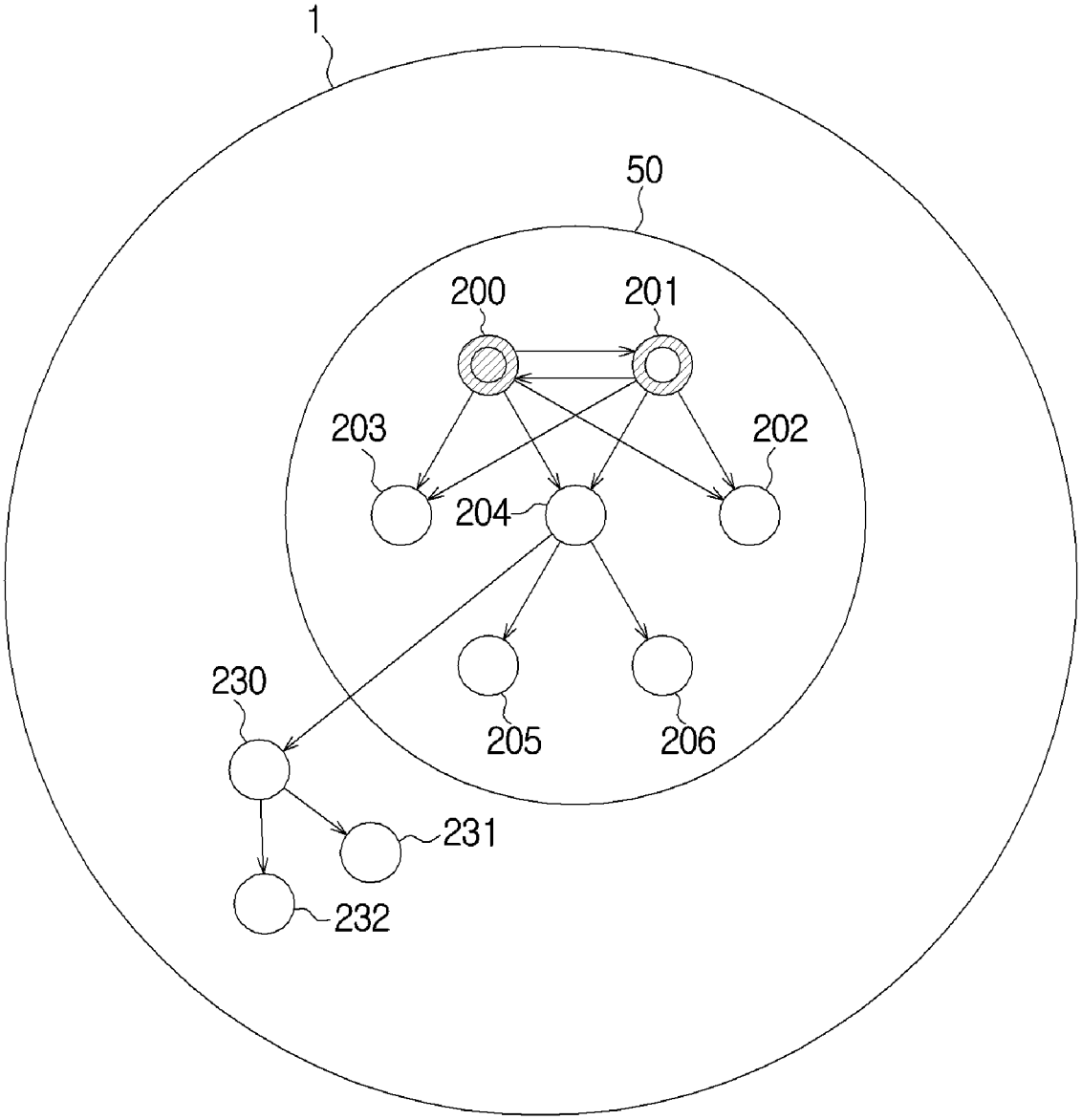

【Fig. 26】
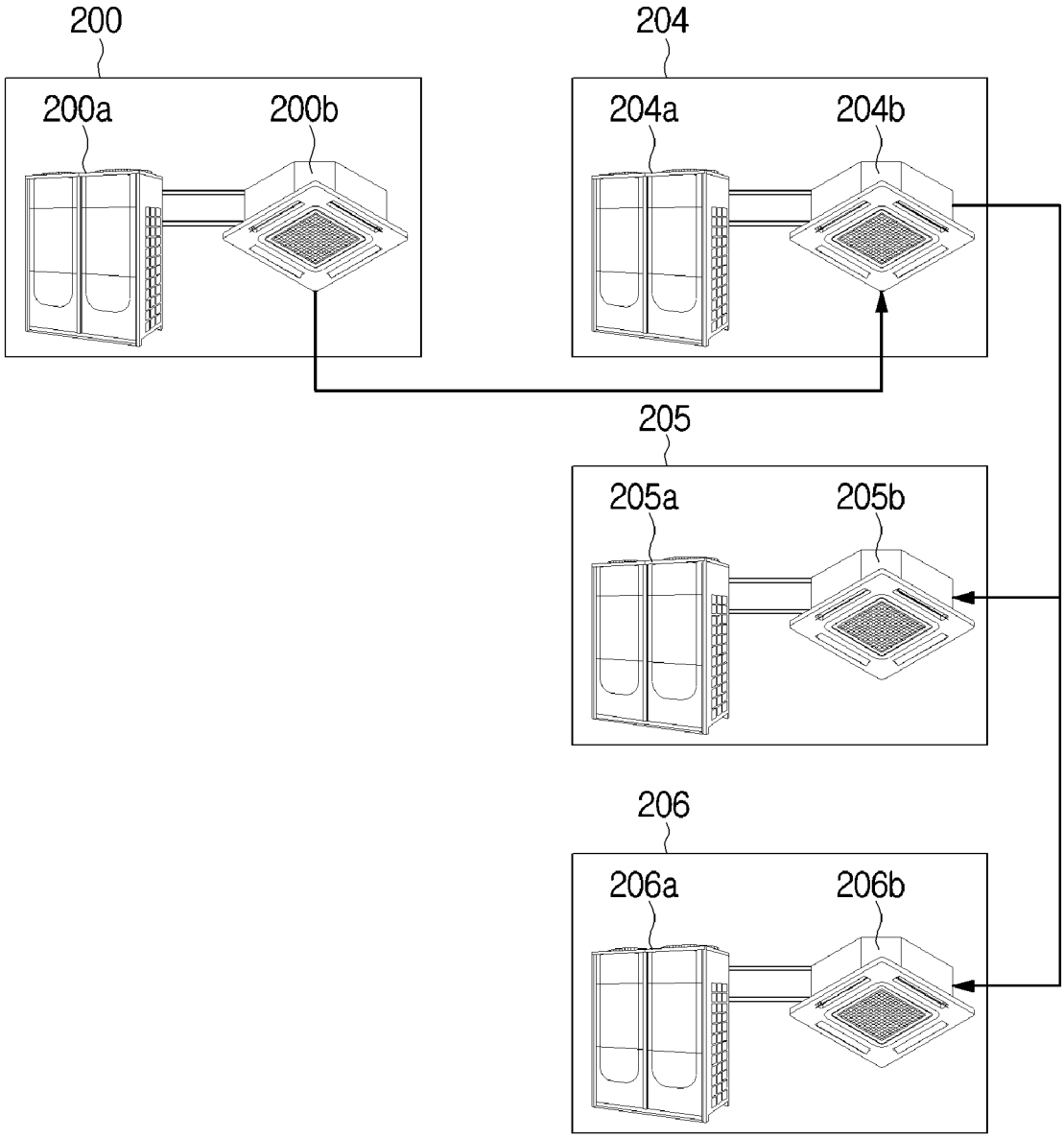

[Fig. 27]
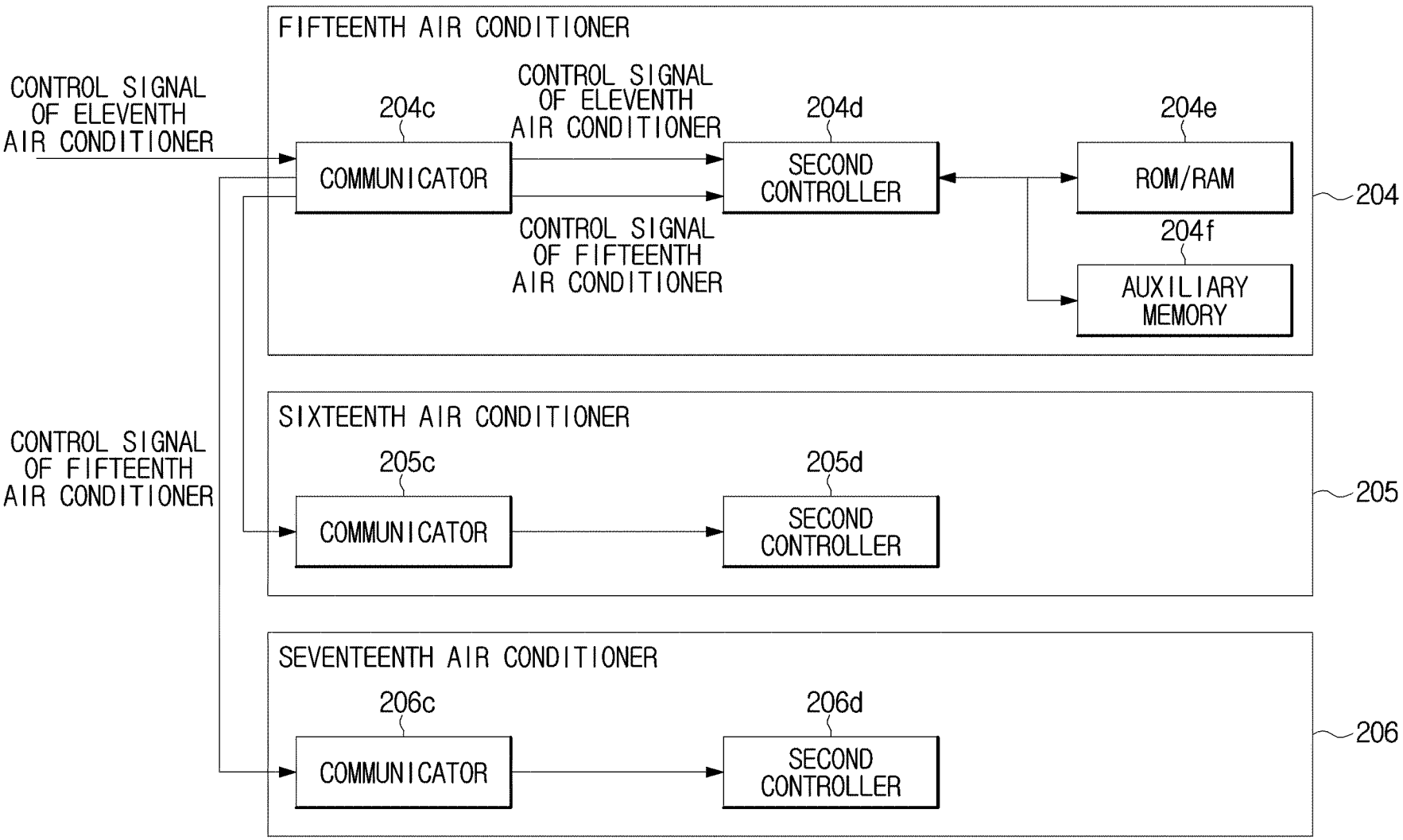

【Fig. 28】
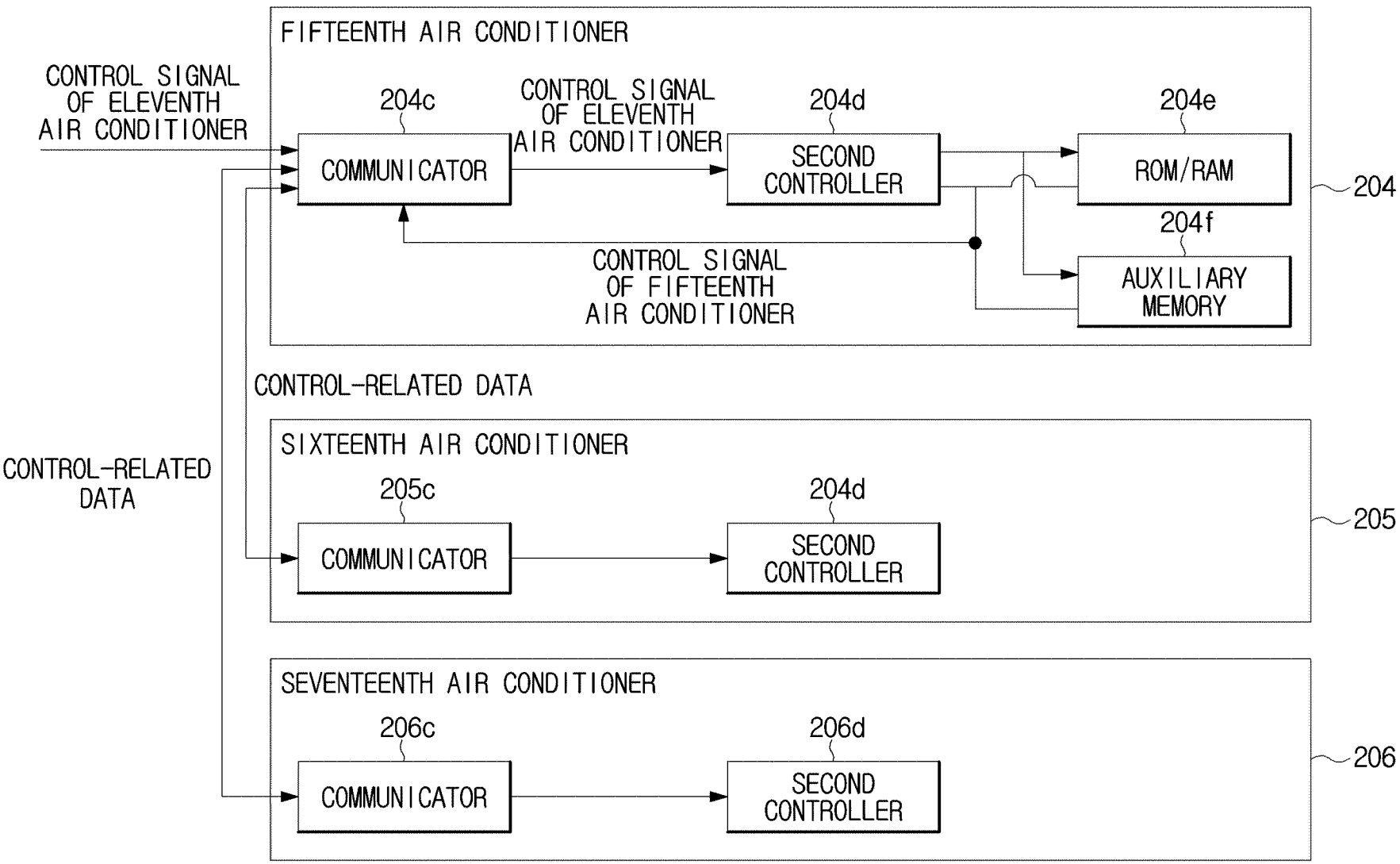

【Fig. 29】
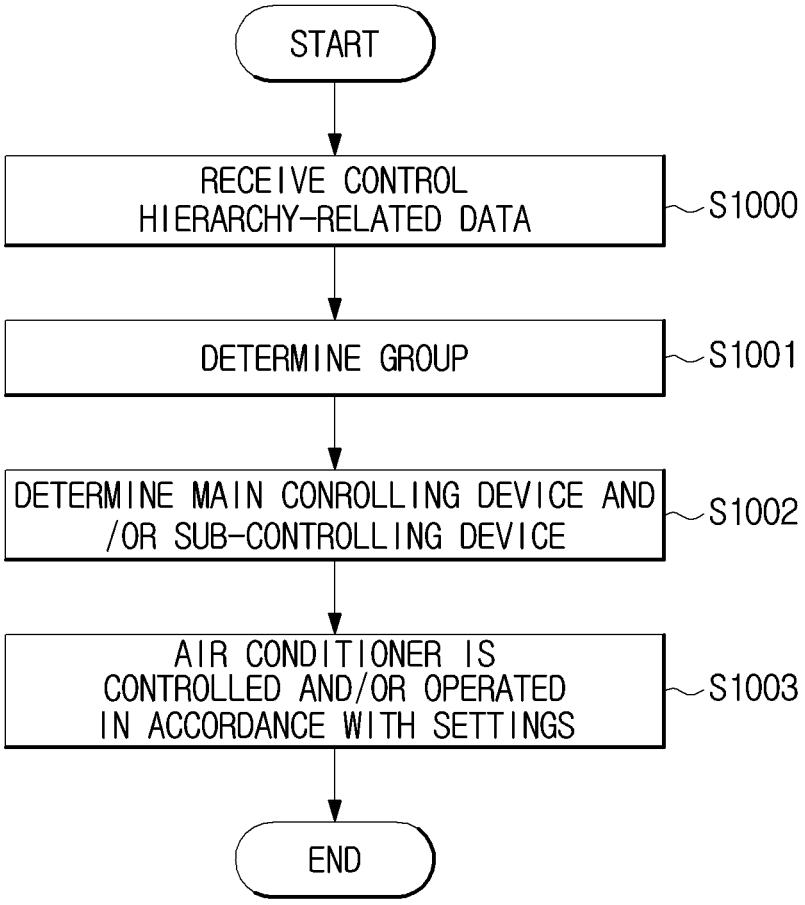

【Fig. 30】
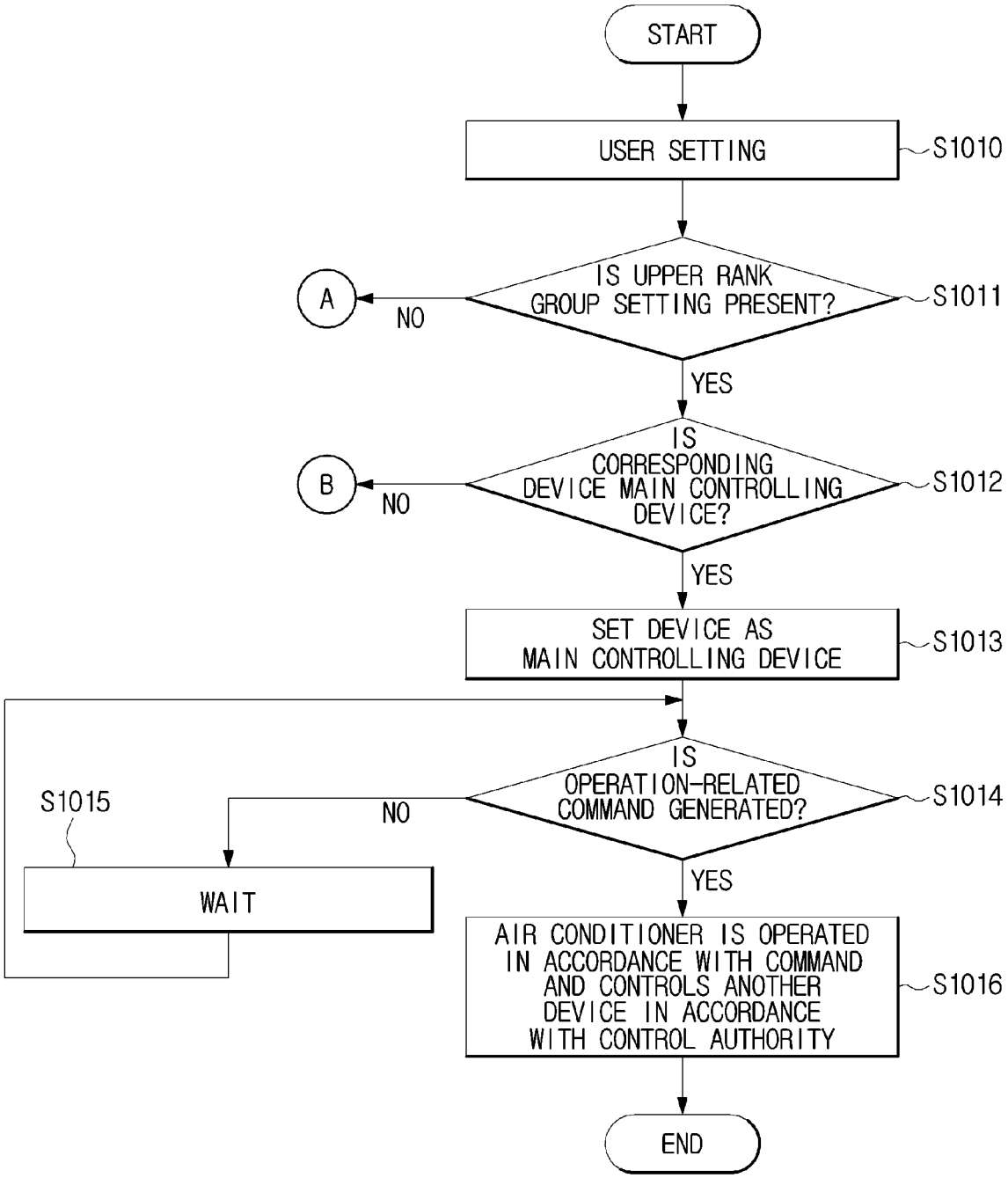

【Fig. 31】
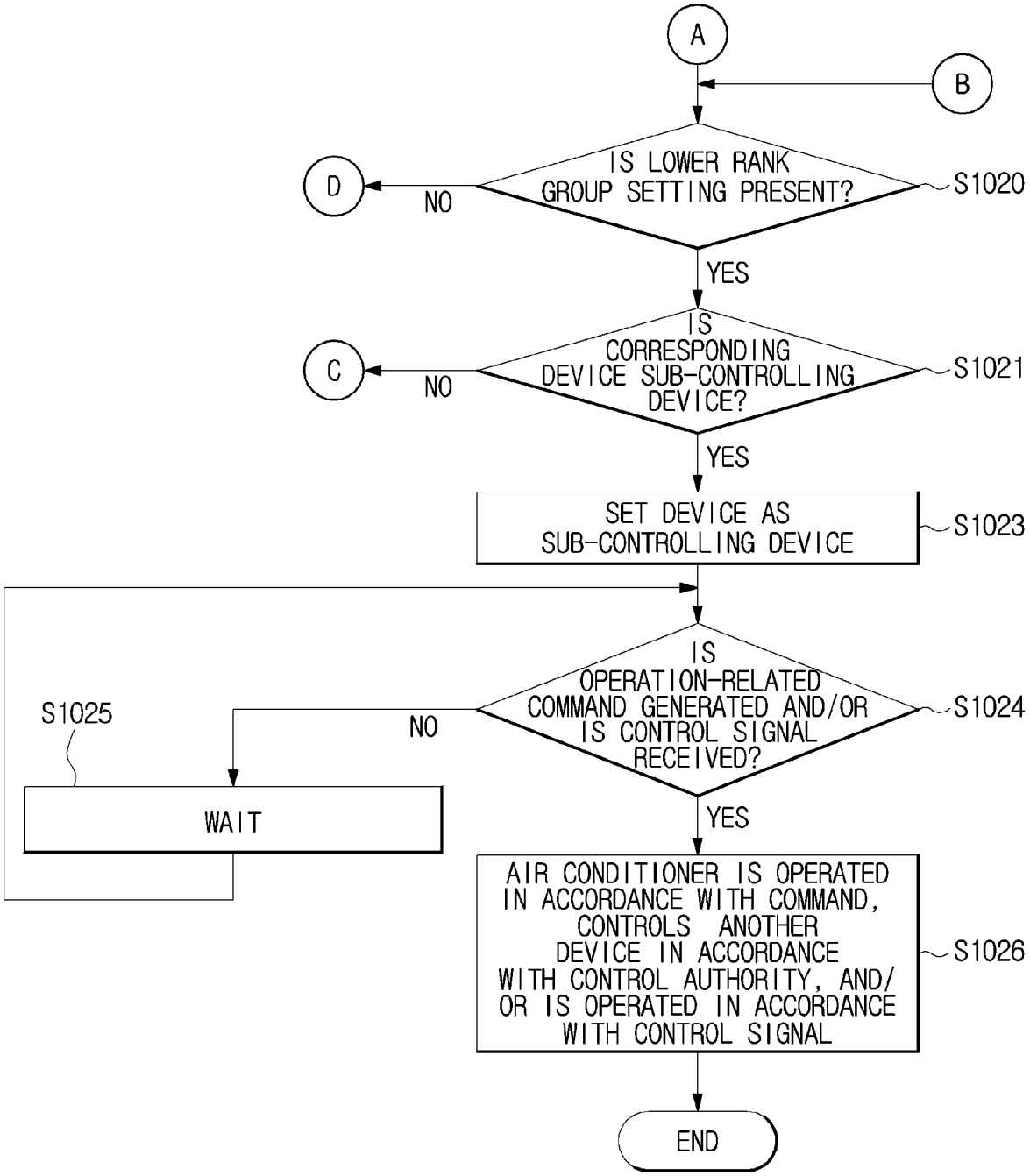

【Fig. 32】
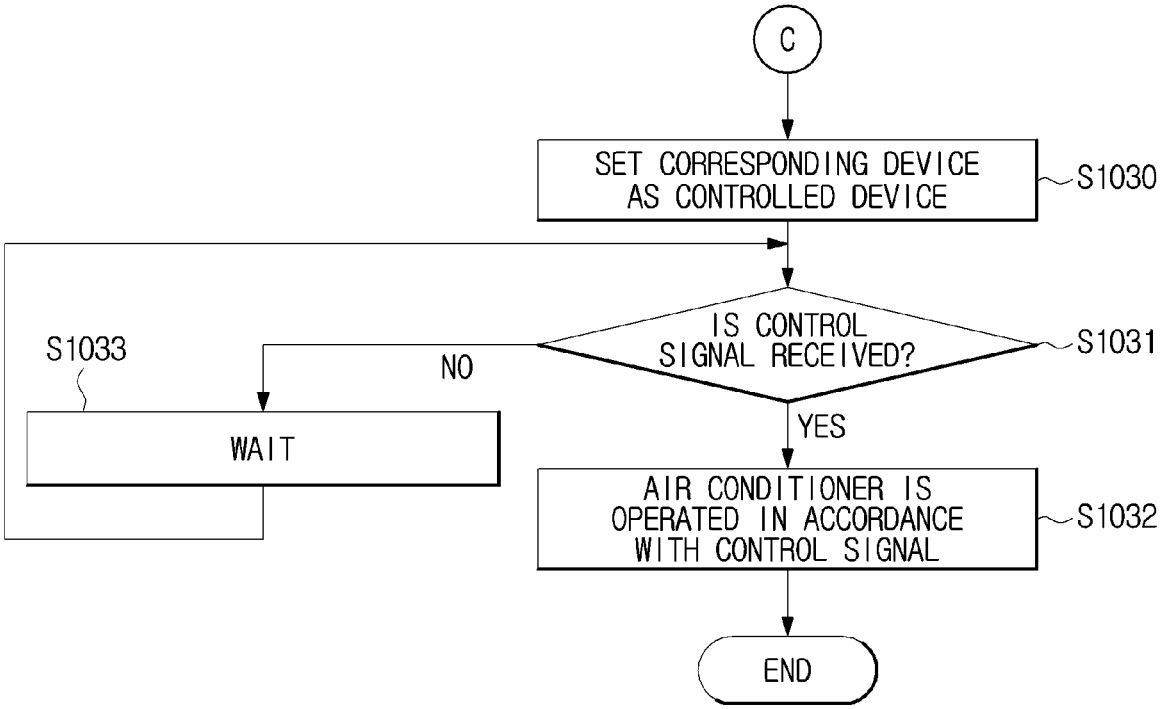

【Fig. 33】
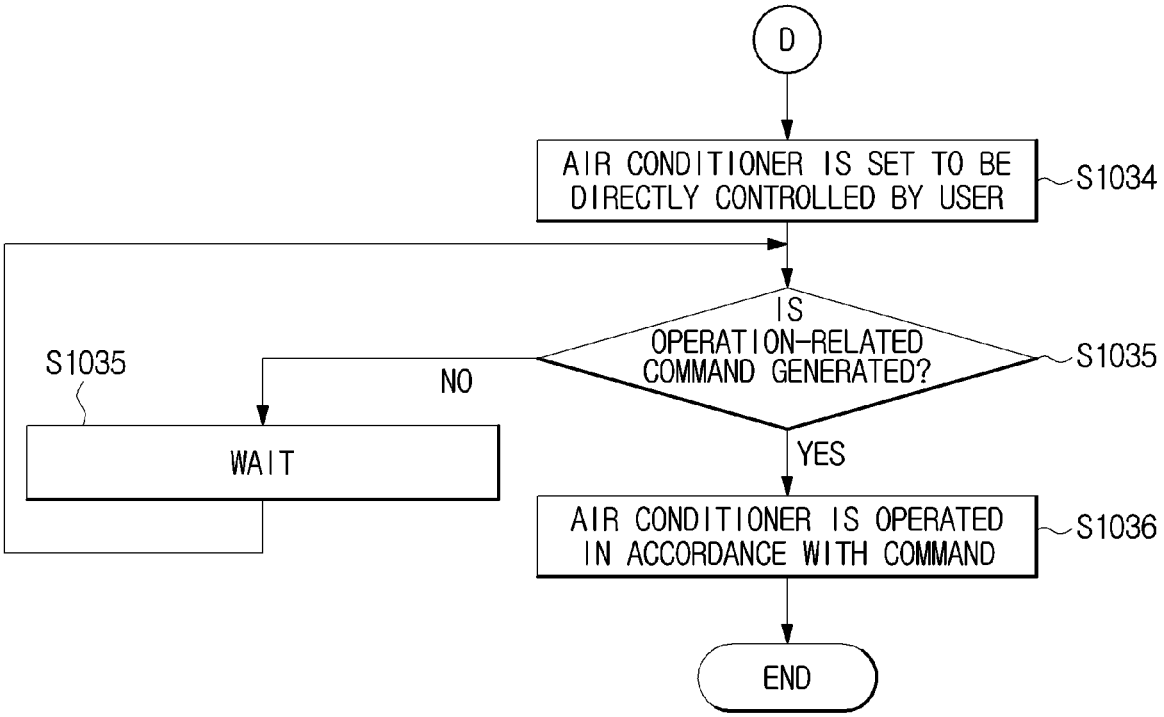

[Fig. 34]
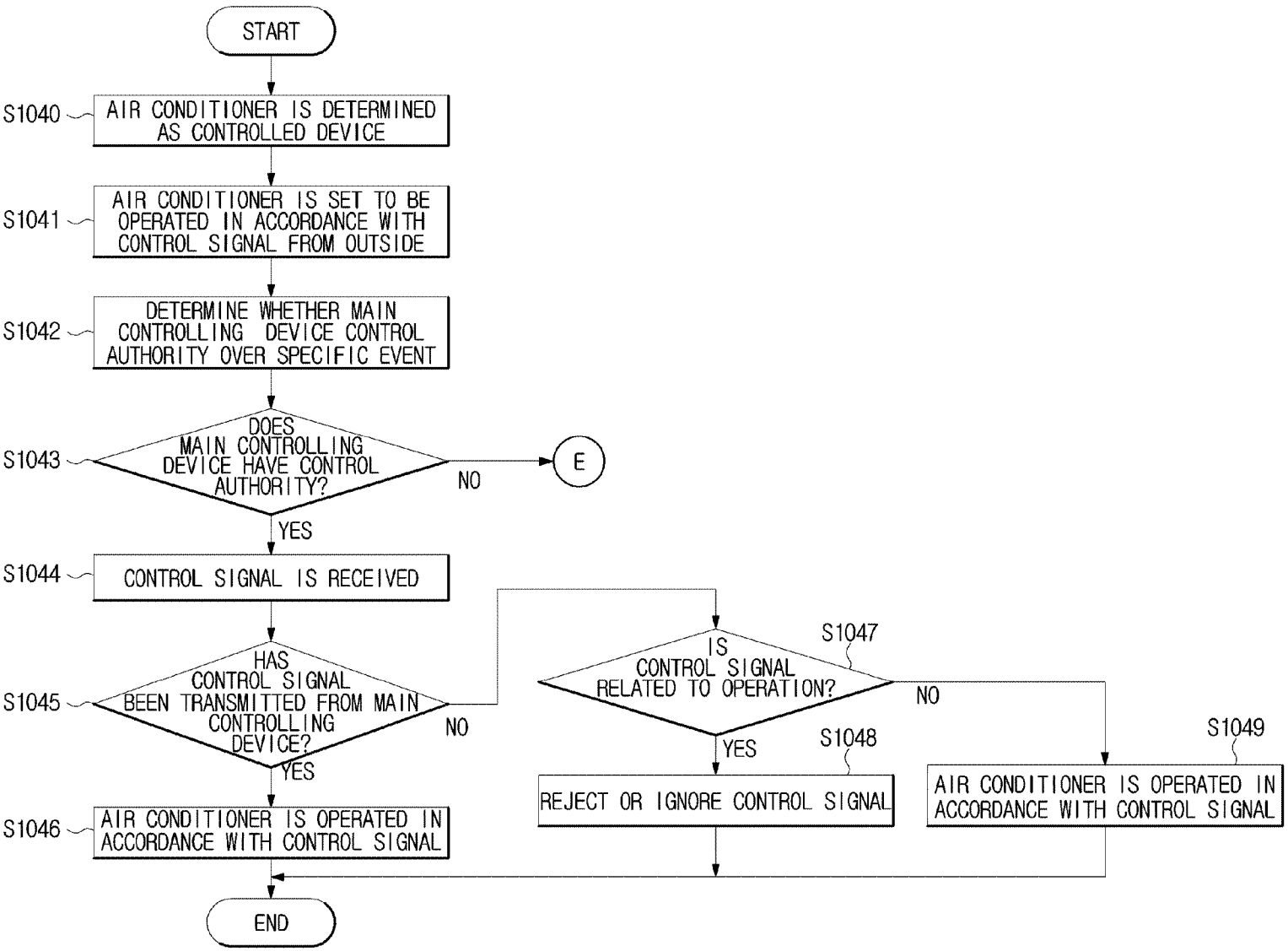

【Fig. 35】
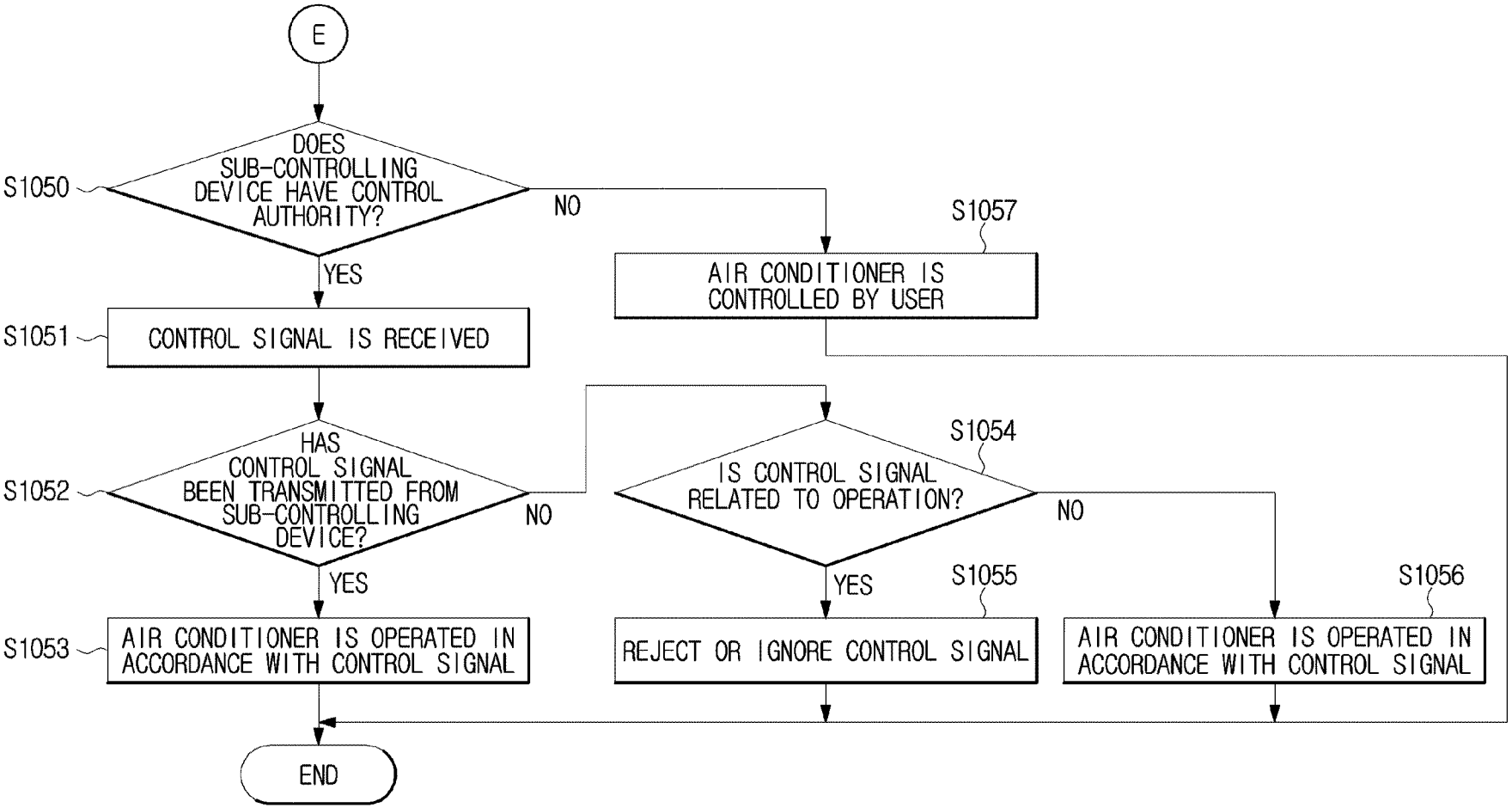

【Fig. 36】
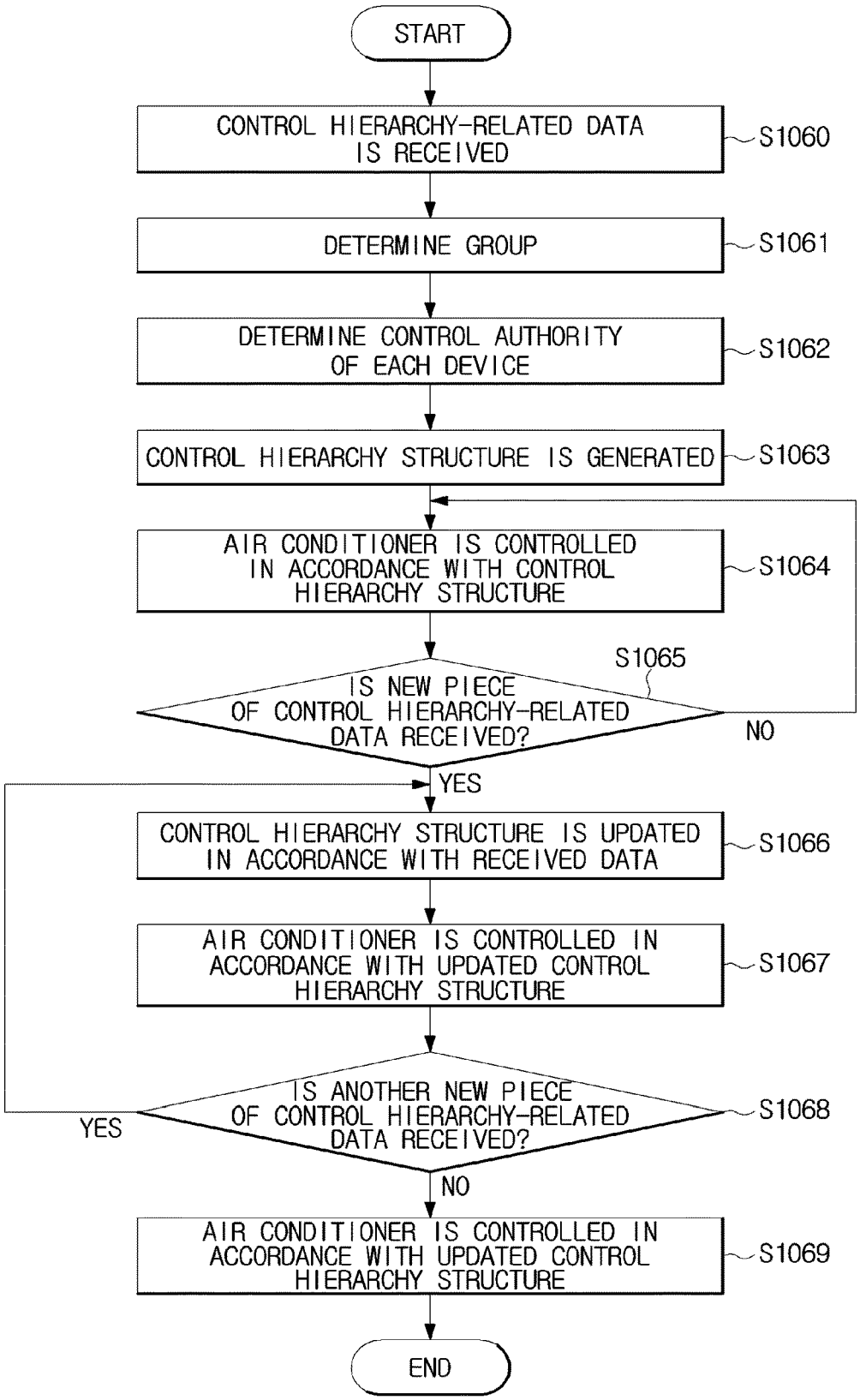

【Fig. 37】
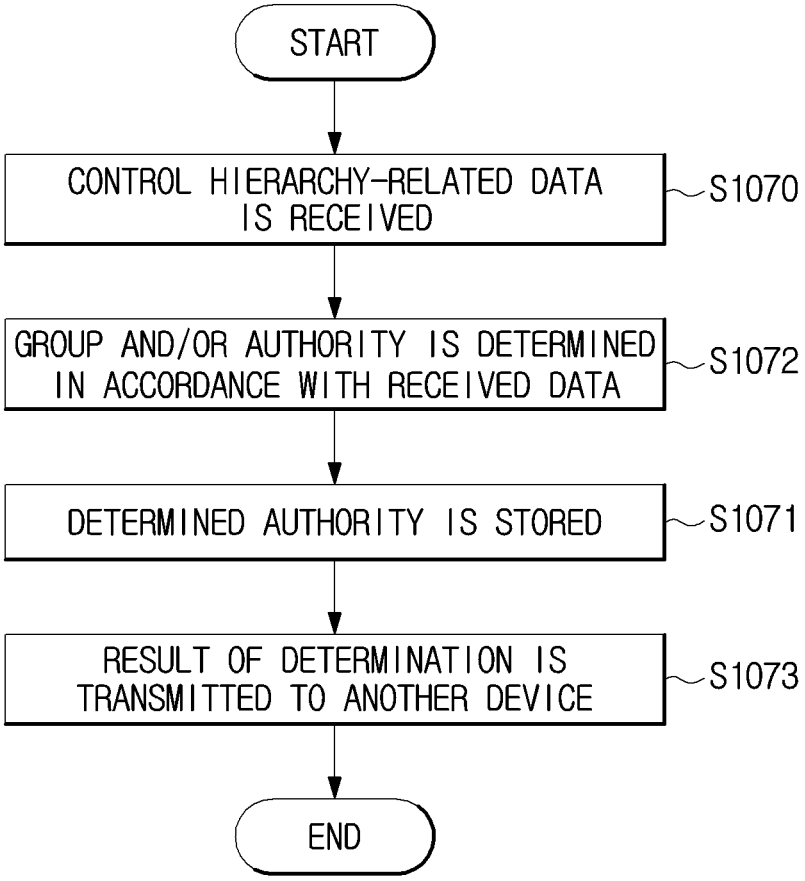

【Fig. 38】
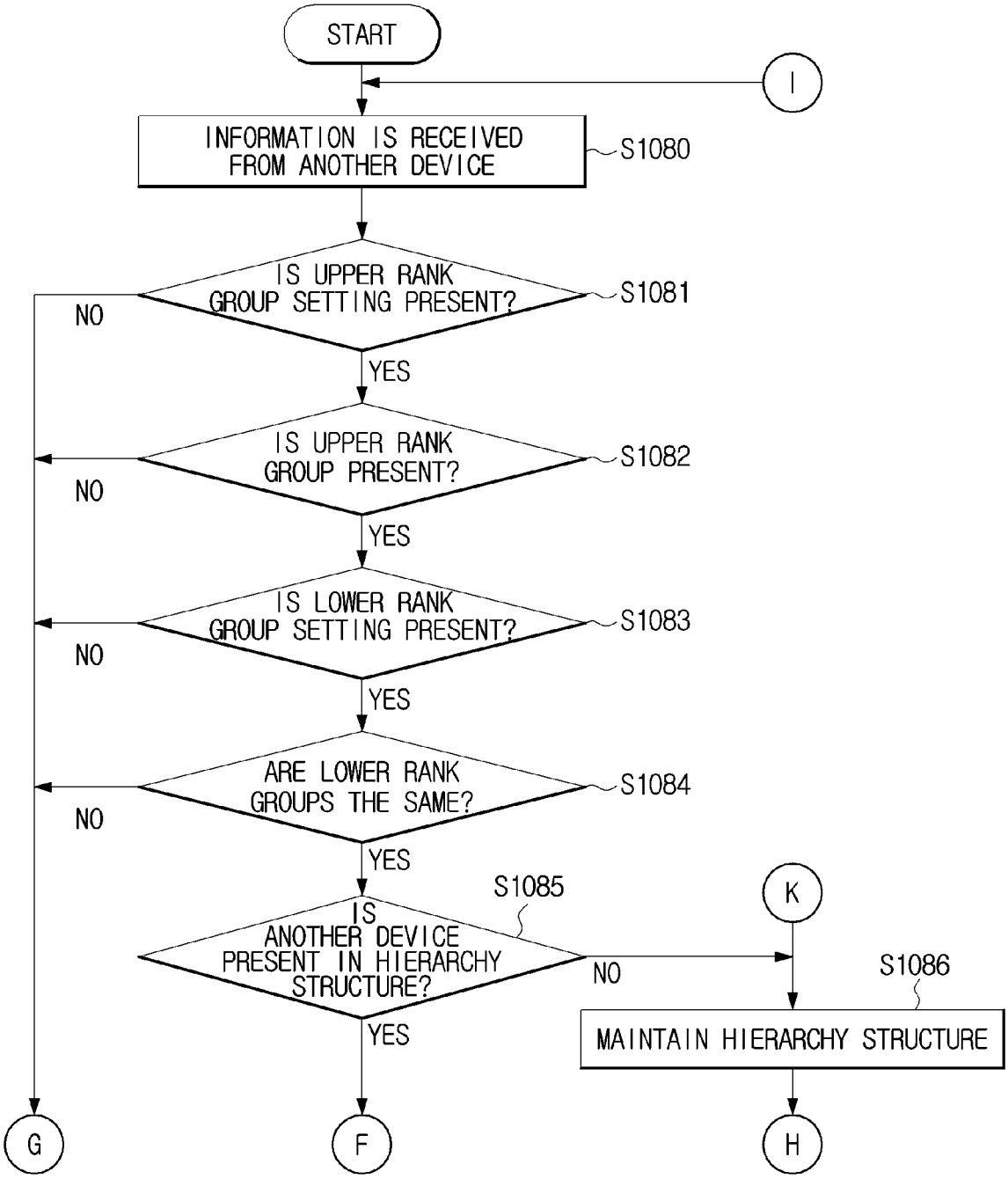

【Fig. 39】
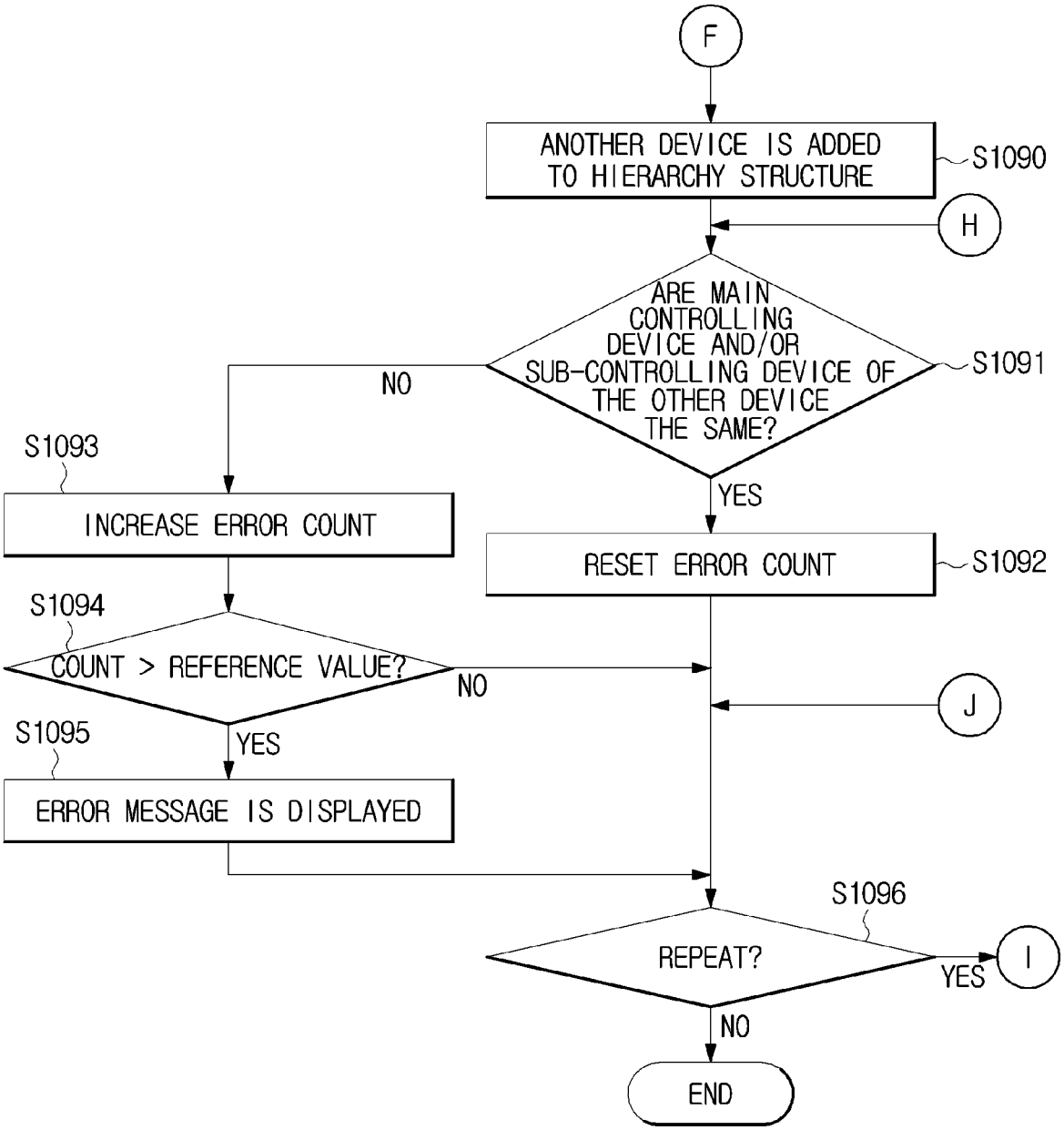

【Fig. 40】
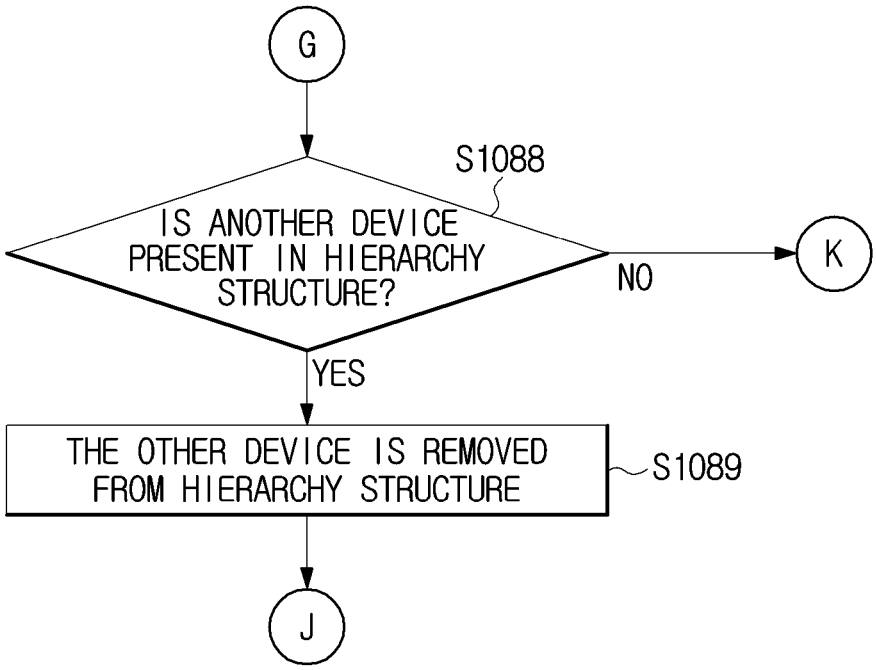

【Fig. 41】
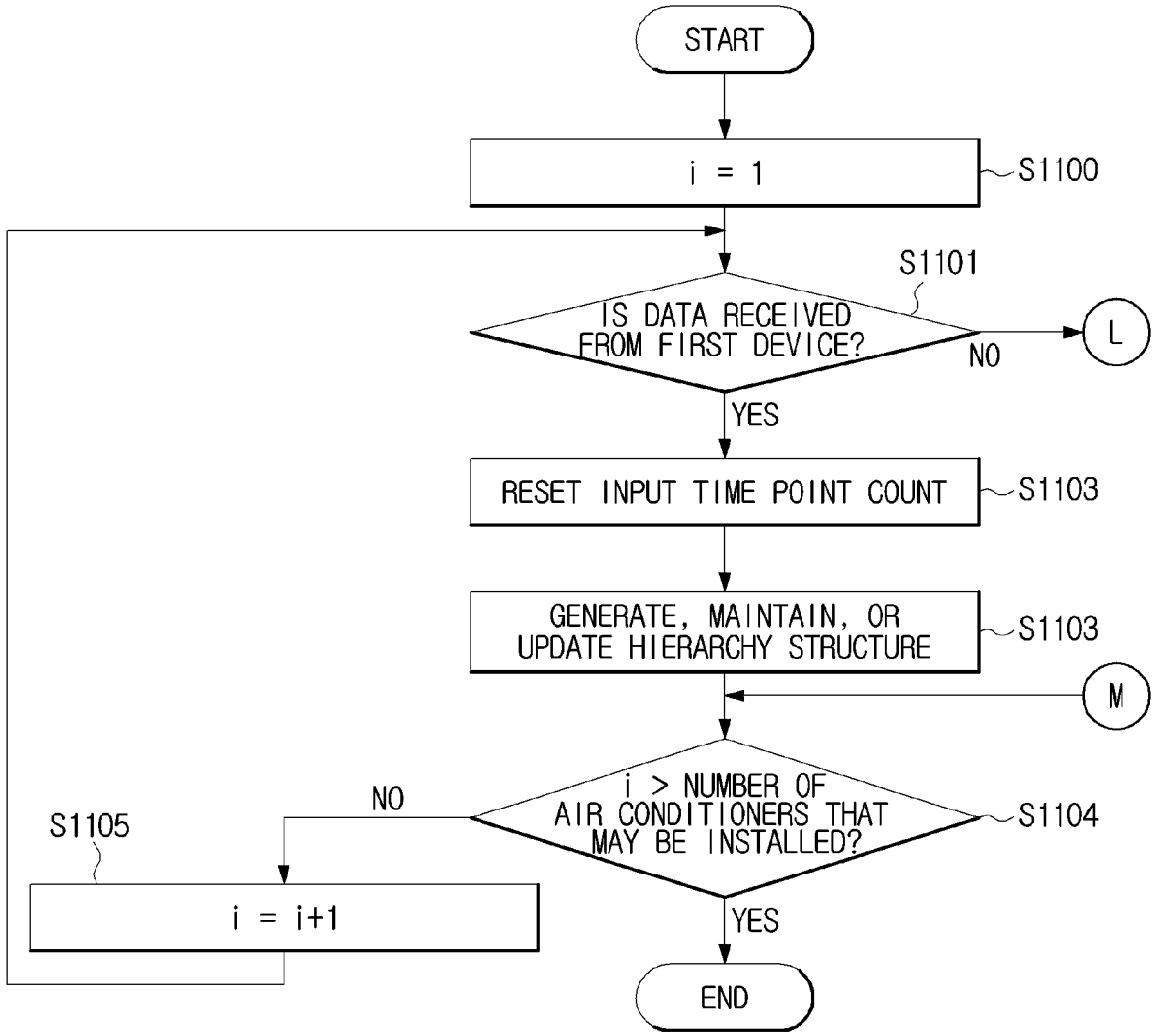

【Fig. 42】
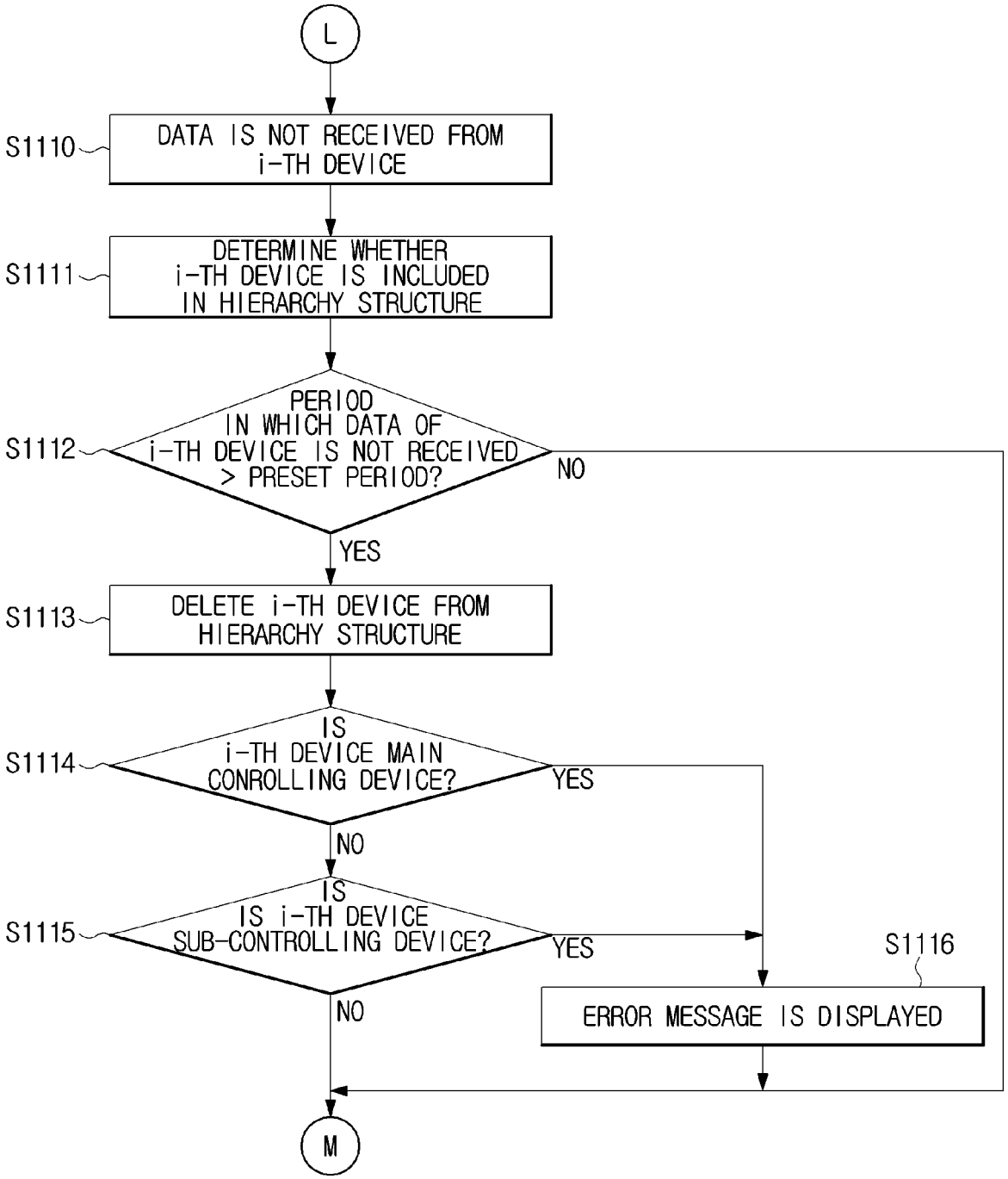

【Fig. 43】
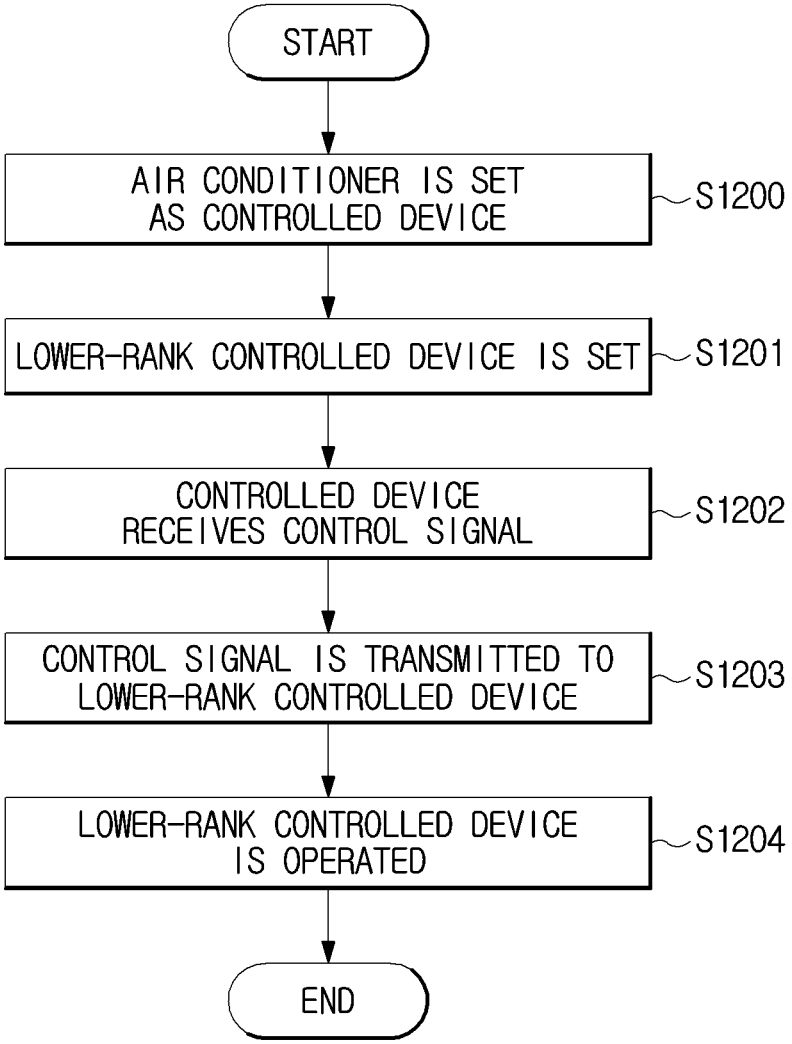

【Fig. 44】
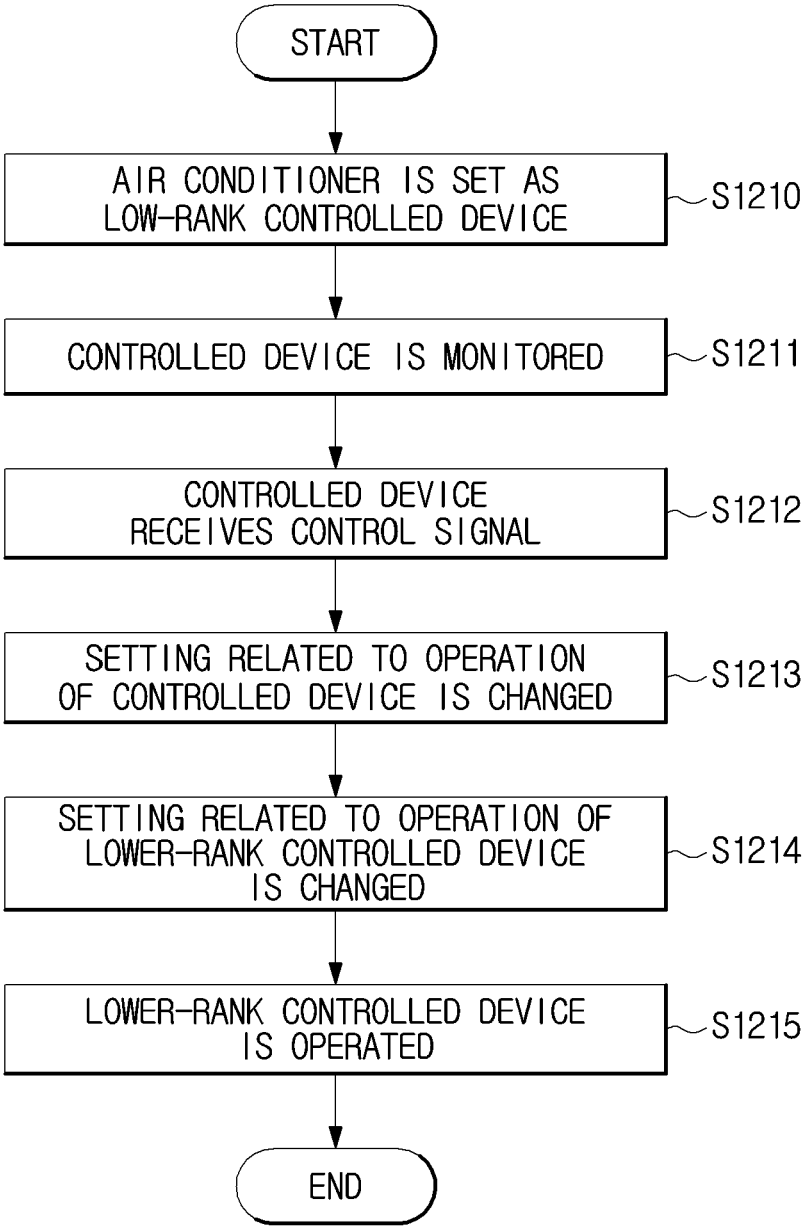

AIR CONDITIONER CONTROLLING SYSTEM AND AIR CONDITIONER CONTROLLING METHOD

CROSS-REFERENCE TO RELATED APPLICATIONS AND CLAIM OF PRIORITY

This application is a 371 of International Application No. PCT/KR2016/014296 filed Dec. 7, 2016, which claims priority to Korean Patent Application No. KR 10-2015-0181148 filed Dec. 17, 2015, the disclosures of which are herein incorporated by reference in their entirety.

BACKGROUND

1. Field

The present disclosure relates to an air conditioner, an air conditioner controlling system, and an air conditioner controlling method.

2. Description of Related Art

An air conditioner is an apparatus for adjusting indoor air to suit purpose of use, and is an apparatus for adjusting temperature, humidity level, air purity, air flow, or the like of indoor air. An air conditioner may be used in various locations such as general homes, offices, factories, and vehicles, and may have various forms or structures in accordance with locations in which the air conditioner is installed.

Generally, an air conditioner may emit cooled air, which is acquired through a cooling cycle consisting of a process of compressing, condensing, expanding, and evaporating a refrigerant, to an indoor space to adjust indoor air.

For example, an air conditioner may include a compressor, a condenser, an expansion valve, an evaporator, and a cooling fan, and is provided to use a refrigerant flowing therethrough to adjust indoor air. As an example of adjusting indoor air by the air conditioner, first, the compressor of the air conditioner may compress a gaseous refrigerant, e.g., Freon gas, and the condenser may condense the compressed refrigerant. The condensed refrigerant is expanded in the expansion valve and is changed to a state in which the condensed refrigerant is easy to be evaporated. The expanded refrigerant is evaporated in the evaporator and absorbs surrounding heat. Accordingly, air around the evaporator may be cooled. The cooling fan emits air, which is cooled as described above, to an indoor space to adjust the temperature of indoor air. The refrigerant evaporated by the evaporator is re-introduced into the compressor, and the above-described refrigeration cycle is repeatedly performed such that the air conditioner may adjust indoor air.

SUMMARY

It is an aspect of the present disclosure to provide an air conditioner, an air conditioner controlling system, and an air conditioner controlling method capable of easily and promptly controlling a plurality of air conditioners in association with each other at a low cost.

It is another aspect of the present disclosure to provide an air conditioner, an air conditioner controlling system, and an air conditioner controlling method capable of properly controlling a plurality of air conditioners in association with each other without separate control devices for the air conditioners.

An air conditioner controlling system includes one or more controlled air conditioners, a main controlling air conditioner having control authority over, from among the one or more controlled air conditioners, one or more controlled air conditioners that belong to an upper rank group corresponding to the main controlling air conditioner, and a sub-controlling air conditioner having control authority over, from among the one or more controlled air conditioners, one or more controlled air conditioners that belong to a first lower rank group, wherein the upper rank group includes one or more lower rank groups, and, from among the one or more lower rank groups, the first lower rank group corresponds to the sub-controlling air conditioner.

The main controlling air conditioner may include an air conditioner that belongs to any one lower rank group from among the one or more lower rank groups.

The sub-controlling air conditioner may include an air conditioner that belongs to the first lower rank group.

The control authority of the sub-controlling air conditioner may include control authority that is different from the control authority of the main controlling air conditioner over the one or more controlled air conditioners belonging to the first lower rank group, in accordance with at least one of a user's choice and a predefined setting.

At least one of the main controlling air conditioner, the sub-controlling air conditioner, and the one or more controlled air conditioners may determine a control hierarchy structure of the air conditioner controlling system on the basis of at least one of information input by a user and a predefined setting.

The information input by the user may include information on the upper rank group and information on the main controlling air conditioner.

The information input by the user may further include information on the first lower rank group and information on the sub-controlling air conditioner.

The one or more controlled air conditioners determine at least one of the main controlling air conditioner and the sub-controlling air conditioner having the control authority over the one or more controlled air conditioners, on the basis of the control hierarchy structure of the air conditioner controlling system.

The one or more controlled air conditioners may be operated in accordance with a control signal transmitted from an air conditioner having control authority over the one or more controlled air conditioners and ignore a control signal transmitted from an air conditioner other than the air conditioner having the control authority over the one or more controlled air conditioners.

The one or more controlled air conditioners may determine whether the control signal transmitted from the air conditioner other than the air conditioner having the control authority over the one or more controlled air conditioners is a control signal related to operation of the controlled air conditioners, and may be operated in accordance with the transmitted control signal when the control signal transmitted from the air conditioner other than the air conditioner having the control authority over the one or more controlled air conditioners is determined to be a control signal irrelevant to operation of the controlled air conditioners.

At least one of the main controlling air conditioner, the sub-controlling air conditioner, and the one or more controlled air conditioners may periodically or non-periodically receive information on at least one other air conditioner from the at least one other air conditioner.

At least one of the main controlling air conditioner, the sub-controlling air conditioner, and the one or more controlled air conditioners may use the information received from the at least one other air conditioner to determine whether the at least one other air conditioner is included in the control hierarchy structure.

When the at least one other air conditioner is included in the control hierarchy structure, and the at least one other air conditioner does not exist in pre-stored information on the control hierarchy structure, at least one of the main controlling air conditioner, the sub-controlling air conditioner, and the one or more controlled air conditioners may add the at least one other air conditioner to the information on the control hierarchy structure, or when the at least one other air conditioner is not included in a pre-stored control hierarchy structure, and the at least one other air conditioner exists in pre-stored information on the control hierarchy structure, at least one of the main controlling air conditioner, the sub-controlling air conditioner, and the one or more controlled air conditioners may remove the at least one other air conditioner from the information on the control hierarchy structure.

At least one of a controlling air conditioner, the sub-controlling air conditioner, and the one or more controlled air conditioners may use information on the at least one other air conditioner to determine an air conditioner having control authority over the at least one other air conditioner, or at least one of the main controlling air conditioner, the sub-controlling air conditioner, and the one or more controlled air conditioners may remove the at least one other air conditioner from pre-stored information on an air conditioner control hierarchy structure when information on the at least one other air conditioner is not received from the at least one other air conditioner for a predetermined amount of time or longer.

The air conditioner controlling system may further include one or more lower-rank controlled air conditioners configured to perform the same operation as the one or more controlled air conditioners.

An air conditioner controlling method may further include receiving, by a first air conditioner, information on a group to which the first air conditioner and at least one other air conditioner belong and control authority therefor, generating, by the first air conditioner, information on a control hierarchy structure related to the first air conditioner and the at least one other air conditioner on the basis of the information received by the first air conditioner, and operating the first air conditioner in accordance with the control hierarchy structure.

According to the above-described air conditioner, air conditioner controlling system, and air conditioner controlling method, a plurality of air conditioners can be easily and promptly controlled in association with each other at a low cost.

When the above-described air conditioner, air conditioner controlling system, and air conditioner controlling method are used, air conditioners installed in a large-scale space such as an auditorium or a gym can be properly controlled in association with each other, and a plurality of air conditioners can be properly controlled even when a high load is required in air conditioning operations.

According to the above-described air conditioner, air conditioner controlling system, and air conditioner controlling method, a plurality of air conditioners can be easily and properly controlled in association with each other simultaneously or sequentially even when air conditioning cycles of the plurality of air conditioners are operated separately from each other.

According to the above-described air conditioner, air conditioner controlling system, and air conditioner controlling method, operation times or loads of a plurality of air conditioners can be properly adjusted and decomposed to optimally control the plurality of air conditioners in association with each other.

According to the above-described air conditioner, air conditioner controlling system, and air conditioner controlling method, since an expensive control device is not required for a separately-provided air conditioner, a cost for installing the air conditioner and the air conditioner controlling system can be reduced.

According to the above-described air conditioner, air conditioner controlling system, and air conditioner controlling method, a plurality of air conditioners can be properly controlled in association with each other even when problems occur in controlling the air conditioners, such as when a problem occurs in some of the plurality of air conditioners associated with each other, when a problem occurs in a control device for controlling the plurality of air conditioners, or when connection between the plurality of air conditioners and the control device is interrupted.

BRIEF DESCRIPTION OF THE DRAWINGS

FIG. 1 is a block diagram of an air conditioner controlling system including a plurality of air conditioners according to an embodiment.

FIG. 2 is a view illustrating an example of an upper rank group and a lower rank group.

FIG. 3 is another block diagram of an air conditioner controlling system including a plurality of air conditioners according to an embodiment.

FIG. 4 is a view for describing an outdoor unit according to an embodiment.

FIG. 5 is a view for describing an indoor unit according to an embodiment.

FIG. 6 is a control block diagram of a second controller according to an embodiment.

FIG. 7 is a view illustrating an example of information transmitted to any one air conditioner.

FIG. 8 is a view illustrating another example of information transmitted to any one air conditioner.

FIG. 9 is a view illustrating still another example of information transmitted to any one air conditioner.

FIG. 10 is a view illustrating yet another example of information transmitted to any one air conditioner.

FIG. 11 is a control block diagram of a control information processor according to an embodiment.

FIG. 12 is a control block diagram of a group determiner according to an embodiment.

FIG. 13 is a view illustrating an example of a table related to control authority.

FIG. 14 is a view for describing transfer and reclamation of authority between a main controlling air conditioner and a sub-controlling air conditioner.

FIG. 15 is a block diagram of a control hierarchy structure processor according to an embodiment.

FIG. 16 is a view illustrating an example of a control hierarchy structure.

FIG. 17 is a view for describing a method of counting the number of error occurrences.

FIG. 18 is a view illustrating a first operation controller according to an embodiment.

FIG. 19 is a view for describing controlling a controlled air conditioner by a main controlling air conditioner.

FIG. 20 is a view for describing controlling a controlled air conditioner by a sub-controlling air conditioner.

FIG. 21 is a view for describing an operation of a controlled air conditioner in response to a control signal by an air conditioner without control authority.

FIG. 22 is a control block diagram for describing an example in which each air conditioner is operated in an air conditioner controlling system.

FIG. 23 is a view for describing an example in which each air conditioner transmits a control signal in an air conditioner controlling system.

FIG. 24 is a view for describing a method of synchronizing control between a plurality of air conditioners.

FIG. 25 is a view for describing an air conditioner controlling system according to another embodiment.

FIG. 26 is a view for describing an air conditioner controlling system including lower-rank controlled air conditioners according to an embodiment.

FIG. 27 is a control block diagram for describing an operation between lower-rank controlled air conditioners according to an embodiment.

FIG. 28 is a control block diagram for describing an operation between lower-rank controlled air conditioners according to according to another embodiment.

FIG. 29 is a flowchart of an air conditioner controlling method according to an embodiment.

FIG. 30 is a first flowchart of a process of setting control authority of a specific air conditioner according to an embodiment.

FIG. 31 is a second flowchart of a process of setting control authority of a specific air conditioner according to an embodiment.

FIG. 32 is a third flowchart of a process of setting control authority of a specific air conditioner according to an embodiment.

FIG. 33 is a fourth flowchart of a process of setting control authority of a specific air conditioner according to an embodiment.

FIG. 34 is a first flowchart of a process in which a controlled air conditioner is controlled by at least one of a main controlling air conditioner and a sub-controlling air conditioner according to an embodiment.

FIG. 35 is a second flowchart of a process in which a controlled air conditioner is controlled by at least one of a main controlling air conditioner and a sub-controlling air conditioner according to an embodiment.

FIG. 36 is a flowchart of a process of updating a control hierarchy structure according to an embodiment.

FIG. 37 is a flowchart of data transmission between air conditioners according to an embodiment.

FIG. 38 is a first flowchart of a process of processing transmitted data when data is transmitted from another air conditioner according to an embodiment.

FIG. 39 is a second flowchart of a process of processing transmitted data when data is transmitted from another air conditioner according to an embodiment.

FIG. 40 is a third flowchart of a process of processing transmitted data when data is transmitted from another air conditioner according to an embodiment.

FIG. 41 is a first flowchart of a process of processing transmitted data when data is transmitted from another air conditioner according to still another embodiment.

FIG. 42 is a second flowchart of a process of processing transmitted data when data is transmitted from another air conditioner according to still another embodiment.

FIG. 43 is a flowchart of a method of controlling a controlled air conditioner according to an embodiment.

FIG. 44 is a flowchart of a method of controlling a controlled air conditioner according to another embodiment.

DETAILED DESCRIPTION

Hereinafter, various embodiments of an air conditioner and an air conditioner controlling system including a plurality of air conditioners will be described with reference to FIGS. 1 to 28. Hereinafter, for convenience of description, a separate ordinal may be added in front of each "air conditioner" term like "a k-th air conditioner." Such an expression is arbitrarily added to distinguish each air conditioner and is not intended to represent a specific order. Such an expression may be arbitrarily modified and changed in accordance with a designer's choice.

FIG. 1 is a block diagram of an air conditioner controlling system including a plurality of air conditioners according to an embodiment.

According to FIG. 1, an air conditioner controlling system 1 may include a main controlling air conditioner 2, a sub-controlling air conditioner 3, and a controlled air conditioner 4. The main controlling air conditioner 2, the sub-controlling air conditioner 3, and the controlled air conditioner 4 may be provided to belong to an upper rank group 5, and the sub-controlling air conditioner 3 and the controlled air conditioner 4 may be provided to belong to a lower rank group 6 that belongs to the upper rank group 5. Here, the main controlling air conditioner 2 may not belong to the lower rank group 6 as illustrated in FIG. 1 or may be an air conditioner that belongs to the lower rank group 6.

Here, the groups 5 and 6 may be assemblies of one or more air conditioners, the upper rank group 5 may be a set to which one or more pre-selected air conditioners belong, and the lower rank group 6 may be a set of one or more air conditioners selected from among the one or more air conditioners belonging to the upper rank group 5. Therefore, the one or more air conditioners belonging to the lower rank group 6 also belong to the upper rank group 5. Depending on the embodiment, one or more air conditioners belonging to the lower rank group 6 may be the same as the one or more air conditioners belonging to the upper rank group 5. In other words, the upper rank group 5 and the lower rank group 6 may be set to be identical. Hereinafter, to facilitate understanding, a case in which some of a plurality of air conditioners that belong to the upper rank group 5 belong to the lower rank group 6 will be described as an example.

Each of the air conditioners 2 to 4 may be operated to adjust temperature or the like of indoor air by a control signal generated by itself or a control signal transmitted from the outside. Here, the control signal transmitted from the outside may include, for example, at least one of a control signal transmitted from another air conditioner 2 or 3 and a control signal transmitted from a user interface 94 (see FIG. 3) that may be manipulated by a user.

The main controlling air conditioner 2 refers to an air conditioner capable of controlling the air conditioners 3 and 4 belonging to the upper rank group 5 in accordance with user manipulation or a predefined setting.

Specifically, the main controlling air conditioner 2 may control the controlled air conditioner 4 and the sub-controlling air conditioner 3 that belong to one or more lower rank groups 6 that belong to the upper rank group 5. In this case, the main controlling air conditioner 2 may generate a control signal and transmit the generated control signal to at least one of the sub-controlling air conditioner 3 and the controlled air conditioner 4 to control operation of at least one of the sub-controlling air conditioner 3 and the controlled air conditioner 4. Here, the control signal refers to a control signal corresponding to all or some operations from among operations that may be performed by the air conditioners 2 to 4. In other words, the main controlling air conditioner 2 is provided to have authority to control predetermined operation of the air conditioners 2 to 4, i.e., control authority. Here, the air conditioners 2 to 4 may perform a plurality of operations, and in this case, a plurality of control authorities corresponding to different operations may be set. The main controlling air conditioner 2 may have all of the plurality of control authorities or may be set to have some of the plurality of control authorities. The main controlling air conditioner 2 may control operation of the sub-controlling air conditioner 3 and the controlled air conditioner 4 in accordance with control authorities that the main controlling air conditioner 2 has.

The main controlling air conditioner 2 may also directly perform air conditioning operations such as adjusting temperature or the like of indoor air in accordance with control of a controller 180 (see FIG. 6) provided in the main controlling air conditioner 2.

The main controlling air conditioner 2 may be set to belong to the upper rank group 5 or may be set to belong to any one of the lower rank groups 6 belonging to the upper rank group 5, in accordance with user manipulation or a predefined setting.

According to an embodiment, only one main controlling air conditioner 2 may be present in a single upper rank group.

The sub-controlling air conditioner 3 refers to an air conditioner capable of controlling an air conditioner 4 that belongs to a specific lower rank group 6. In this case, the sub-controlling air conditioner 3 may be provided to control another controlled air conditioner 4 that belongs to the lower rank group 6 to which the sub-controlling air conditioner 3 belongs. The sub-controlling air conditioner 3 may generate a control signal for some of the operations that the air conditioners 2 to 4 may perform, and transmit the generated control signal to the controlled air conditioner 4 to control the controlled air conditioner 4. In other words, the sub-controlling air conditioner 3 is provided to have control authority over some of the operations of the controlled air conditioner 4. Here, the control authority of the sub-controlling air conditioner 3 may include control authority except for one or more control authorities of the main controlling air conditioner 2 from among the plurality of control authorities over the air conditioners 2 to 4. Therefore, the sub-controlling air conditioner 3 may control the air conditioners 3 and 4 belonging to the lower rank group 6 to perform some of the operations that the air conditioners 3 and 4 may perform.

When the main controlling air conditioner 2 belongs to the same lower rank group 6 as the sub-controlling air conditioner 3, the sub-controlling air conditioner 3 may control the main controlling air conditioner 2 belonging to the same lower rank group 6. In this case, the sub-controlling air conditioner 3 may be designed to control the main controlling air conditioner 2 in accordance with control authority that the sub-controlling air conditioner 3 has.

The sub-controlling air conditioner 3 may also perform air conditioning operations in accordance with a controller provided in the sub-controlling air conditioner 3.

The sub-controlling air conditioner 3 may also be set to belong to any one of the lower rank groups 6 belonging to the upper rank group 5 in accordance user manipulation or a predefined setting.

According to an embodiment, a single lower rank group 6 may be set to include only one sub-controlling air conditioner 3.

The controlled air conditioner 4 refers to an air conditioner that is controlled by separate air conditioners 2 and 3. The controlled air conditioner 4 may belong to the upper rank group 5 or may be set to belong to any one of the lower rank groups 6 belonging to the upper rank group 5 in accordance with user settings. The controlled air conditioner 4 may be controlled by at least one of the main controlling air conditioner 2 and the sub-controlling air conditioner 3 in accordance with a group to which the controlled air conditioner 4 belongs.

The main controlling air conditioner 2, the sub-controlling air conditioner 3, and the controlled air conditioner 4 may be the same type of air conditioner or different types of air conditioners. For example, all of the main controlling air conditioner 2, the sub-controlling air conditioner 3, and the controlled air conditioner 4 may be an air conditioner designed so that an indoor unit is mounted on a ceiling or the like. As another example, the main controlling air conditioner 2 may be a ceiling-mounted type having an indoor unit mounted on a ceiling, the sub-controlling air conditioner 3 may be a standing type having an indoor unit placed on a floor surface, and the controlled air conditioner 4 may be a wall-mounted type having an indoor unit mounted on a wall. Depending on the embodiment, any one of the air conditioners may be a window-mounted type mounted on a window.

The main controlling air conditioner 2, the sub-controlling air conditioner 3, and the controlled air conditioner 4 may be manufactured with some components different from those of other air conditioners. For example, a display means for displaying states of the air conditioners 2 to 4 may be provided in the main controlling air conditioner 2, and such a display means may not be provided in the sub-controlling air conditioner 3 and the controlled air conditioner 4. In addition, the main controlling air conditioner 2, the sub-controlling air conditioner 3, and the controlled air conditioner 4 may be various other air conditioners that the designer may take into consideration.

Hereinafter, the air conditioner controlling system 1 according to an embodiment will be described in more detail with reference to FIGS. 2 to 24.

FIG. 2 is a view illustrating an example of an upper rank group and a lower rank group, and FIG. 3 is another block diagram of an air conditioner controlling system including a plurality of air conditioners according to an embodiment. In FIG. 3, some air conditioners are omitted to reduce complexity of description.

According to FIG. 2, one or more lower rank groups, e.g., four lower rank groups 10, 20, 30, and 40 may be included in a single upper rank group 9, and one or more air conditioners 100 to 109 may be included in the lower rank groups 10, 20, 30, and 40.

The upper rank group 9 may include all of the air conditioners 100 to 109 having control authority and/or subjected to control. The air conditioners 100 to 109 belonging to the upper rank group 9 may be determined in accordance with a designer's setting or a user's arbitrary choice. Specifically, whether specific air conditioners 100 to 109 belong to the upper rank group 9 may be changed in accordance with the designer's setting or the user's arbitrary choice. In other words, some of the air conditioners 100 to 109 belonging to the upper rank group 9 may be removed from the upper rank group 9 as necessary in accordance with the designer's or user's choice so that the removed air conditioners do not belong to the upper rank group 9, or another separate air conditioner may be added to the upper rank group 9 to be an air conditioner that belongs to the upper rank group 9.

The number of air conditioners 100 to 109 that may belong to the upper rank group 9 may be restricted as necessary. For example, when the excessive number of air conditioners 100 to 109 is attempted to be controlled, since an overload may occur during operation of a main controlling air conditioner, for example, a first air conditioner 100, the designer may restrict the number of air conditioners 100 to 109 that may belong to the upper rank group 9 to be equal to or less than a predetermined number.

The lower rank groups 10, 20, 30, and 40 may be set to include all or some of the air conditioners 100 to 109 belonging to the upper rank group 9. The number of lower rank groups 10, 20, 30, and 40 belonging to the upper rank group 9 may be changed in accordance with the designer's setting or the user's arbitrary choice. For example, the number of lower rank groups 10, 20, 30, and 40 may be four as illustrated in FIG. 2, but the number of lower rank groups 10, 20, 30, and 40 is not limited thereto.

As described above, the lower rank groups 10, 20, 30, and 40 may include the one or more air conditioners 100 to 109. For example, as illustrated in FIG. 2, from among the plurality of lower rank groups, the first lower rank group 10 may be set to include four air conditioners 100 to 103, the second lower rank group 20 may be set to include two air conditioners 104 and 105, the third lower rank group 30 may be set to include a single air conditioner 106, and the fourth lower rank group may be set to include three air conditioners 107 to 109. However, the number of air conditioners 100 to 109 belonging to the lower rank group 10, 20, 30, and 40 is merely illustrative, and the lower rank groups 10, 20, 30, and 40 may include various other numbers of air conditioners 100 to 109 in accordance with the designer's or user's choice.

Any one lower rank group, e.g., the first lower rank group 10, from among the plurality of lower rank groups 10, 20, 30, and 40 may include any one air conditioner, e.g., the first air conditioner 100, that serves as the main controlling air conditioner. Here, as described above, the main controlling air conditioner refers to an air conditioner capable of controlling any of the air conditioners 100 to 109 belonging to the upper rank group 9.

Each of the plurality of lower rank groups 10, 20, 30, and 40 may include any one air conditioner, e.g., the second air conditioner 101, the fifth air conditioner 104, the seventh air conditioner 106, and the eighth air conditioner 107, that belongs to each of the lower rank groups 10, 20, 30, and 40 and serves as a sub-controlling air conditioner. In this case, each of the lower rank groups 10, 20, 30, and 40 may include only one air conditioner that serves as the sub-controlling air conditioner. The second air conditioner 101, the fifth air conditioner 104, the seventh air conditioner 106, and the eighth air conditioner 107 which serve as the sub-controlling air conditioners may be provided to control one or more air conditioners 100 to 109 that belong to the lower rank groups 10, 20, 30, and 40, and in this case, the second air conditioner 101, the fifth air conditioner 104, the seventh air conditioner 106, and the eighth air conditioner 107 are set to control operations other than the operation that is directly controlled by the first air conditioner 100 (that is, the main controlling air conditioner).

Referring to FIG. 3, the first air conditioner 100 to the tenth air conditioner 109 are provided to transmit or receive data to or from one another. For example, the first air conditioner 100 to the tenth air conditioner 109 may be provided to communicate with each other using the Internet-of-Things (IoT) technology.

Specifically, the first air conditioner 100 to the tenth air conditioner 109 may communicate with one another through a predetermined communication network 8, and more specifically, the first air conditioner 100 to the tenth air conditioner 109 may be electrically connected to one another to communicate with one another using at least one of a wired communication network and a wireless communication network. In this case, some of the first air conditioner 100 to the tenth air conditioner 109 may be connected to communicate through the wired communication network, and the remaining air conditioners 100 to 109 may be connected to communicate using the wireless communication network.

Here, the wired communication network may be implemented using various cables such as a pair cable, a coaxial cable, an optical fiber cable, and an Ethernet cable. The wireless communication network may be implemented using a near-field communication standard or a mobile communication standard. The wireless communication network using a near-field communication standard may be implemented by employing a wireless communication network using various communication standards such as wireless fidelity (Wi-Fi), Bluetooth, ZigBee, Wi-Fi Direct (WFD), ultra wideband (UWB), infrared data association (IrDA), Bluetooth Low Energy, and near-field communication. The wireless communication network using a mobile communication standard may be implemented using various wireless communication technologies such as 3rd Generation Partnership Project (3GPP)-based wireless communication technologies such as evolved high speed packet access (HSPA+) or long-term evolution (LTE), 3GPP2-based wireless communication technologies such as optimized evolution-data (EV-DO), and World Interoperability for Microwave Access (WIMAX)-based wireless communication technologies such as wireless broadband (WiBro) evolution. In addition, the first air conditioner 100 to the tenth air conditioner 109 may be provided to communicate with one another using various communication means that allow communication between devices.

The first air conditioner 100 to the tenth air conditioner 109 may be further connected to at least one of a user interface 94 and an external control device 90, which are separately provided, for communication therewith. At least one of the user interface 94 and the external control device 90 may be connected to the first air conditioner 100 to the tenth air conditioner 109 for communication therewith using at least one of the wired communication network and the wireless communication network described above.

According to an embodiment, at least one of the user interface 94 and the external control device 90 may be set to communicate only with any one air conditioner of the plurality of air conditioners 100 to 109, e.g., set to communicate only with the first air conditioner 100, which serves as the main controlling air conditioner, and to be unable to communicate with other air conditioners 101 to 109. The user interface 94 and the external control device 90 may also be set to communicate with the main controlling air conditioner and the sub-controlling air conditioner.

The user interface 94 may be provided to be spaced apart from the first air conditioner 100. For example, the user interface 94 may be a remote control device attached to any one wall surface of an indoor space in which the first air conditioner 100 is installed, or a separate desktop computer apparatus, a laptop computer apparatus, a smartphone, a cellular phone, a tablet personal computer (PC), or the like.

In addition, various other devices that the designer may take into consideration and are capable of receiving a command from a user and providing information to the user may be examples of the user interface 94.

According to an embodiment, the user interface 94 may include an input unit 95, a display 96, a third controller 97, and a communicator 98.

The input unit 95 may receive various commands from a user. For example, the input unit 95 may receive commands related to a group setting of the air conditioners 100 to 109, commands related to control authority setting related to the air conditioners 100 to 109, commands related to operations that the air conditioners 100 to 109 will perform, or the like. The input unit 95 may be implemented using at least one of a physical button, a keyboard, a mouse, a track ball, a knob, a touchpad, a paddle, various levers, a handle, a joystick, and a touchscreen.

The display 96 may display various pieces of information related to operation of the air conditioners 100 to 109. For example, the display 96 may display an error that has occurred in the air conditioner controlling system 1 or an error that has occurred in at least one of the air conditioners 100 to 109 to provide information thereon to the user. Here, the error that has occurred in the air conditioner controlling system 1 may include a group setting error, control authority setting error such as overlapping of control authorities, or various errors related to the air conditioner controlling system 1. In addition, the display 96 may display various errors related to operation of the air conditioners 100 to 109.

The display 96 may be implemented using a plasma display panel (PDP), a light emitting diode (LED) display panel, a liquid crystal display (LCD), or the like. Here, the LED panel may include an organic LED (OLED) or the like, and the OLED may include a passive matrix OLED (PMOLED) or an active matrix OLED (AMOLED).

The third controller 97 may generate various control signals related to operation of the user interface 94. For example, the third controller 97 may interpret an electrical signal generated from the input unit 95 in accordance with user manipulation of the input unit 95 and generate the control signal in accordance with an interpretation result. The generated control signal may be transmitted to each component of the user interface 94 or any one air conditioner, e.g., the first air conditioner 100.

The communicator 98 may perform communication with the air conditioners 100 to 109 and transmit the control signal or predetermined information to the air conditioners 100 to 109 or receive various pieces of information from the air conditioners 100 to 109. The communicator 98 may be provided to communicate only with any one air conditioner of the plurality of air conditioners 100 to 109, e.g., the first air conditioner 100. The communicator 98 may be implemented using a communication module corresponding to a method of communication with the air conditioners 100 to 109.

In addition, the user interface 94 may further include a sound output device (not illustrated) configured to transmit various pieces of information, e.g., an error message, to a user through sound or voice, or a lighting device (not illustrated) configured to provide various pieces of information to a user by changing color or flickering in a predetermined pattern in accordance with the designer's choice. Here, the sound output device may be implemented using a speaker device or the like, and the lighting device may be implemented using various light-emitting means such as an LED lamp.

The external control device 90 is provided to control the air conditioners 100 to 109 from the outside. The external control device 90 may include a server device 91 connected to communicate with the air conditioners 100 to 109, and an external control user interface 92 configured to receive a user command and transmit received information to the server device 91. The server device 91 of the external control device 90 may be provided to communicate only with any one air conditioner of the plurality of air conditioners 100 to 109, e.g., the first air conditioner 100 serving as the main controlling air conditioner, as described above. The server device 91 may be implemented using one or more computer apparatuses, and the one or more computer apparatuses may be apparatuses that are separately manufactured to serve as a server. The external control user interface 92 may be configured to receive a command from a user or provide information to the user and, depending on the embodiment, may be implemented using the desktop computer apparatus, the laptop computer apparatus, the smartphone, the cellular phone, the tablet PC, or the like.

At least one of the user interface 94 and the external control device 90 may be omitted in accordance with the designer's arbitrary choice.

Hereinafter, the air conditioners 100 to 109 will be described in more detail.

Referring to FIG. 3, the first air conditioner 100 to the tenth air conditioner 109 may respectively include outdoor units 100*a*, 101*a*, 102*a*, . . . 109*a* and indoor units 100*b*, 101*b*, 102*b*, . . . 109*b*. The first air conditioner 100 to the tenth air conditioner 109 may circulate refrigerant and adjust indoor air using the outdoor units 100*a*, 101*a*, 102*a*, . . . 109*a* and the indoor units 100*b*, 101*b*, 102*b*, . . . 109*b*, respectively.

Hereinafter, for convenience of description, the air conditioners 100 to 109 will be described using the first air conditioner 100 as an example. However, structures, operations, or the like of components which will be described below are not limitedly applied to the first air conditioner 100, which will be described below, and may also be applied from the second air conditioner 101 to the tenth air conditioner 109 either identically or with some modifications in accordance with the designer's choice.

As described above, the first air conditioner 100 may include the first outdoor unit 100*a* and the first indoor unit 100*b*.

The first outdoor unit 100*a* may compress and condense a refrigerant, which is flowing, and emit heat generated due to the compression and condensation of the refrigerant to the outside. The first indoor unit 100*b* may evaporate the compressed and condensed refrigerant to cool air, and emit the cooled air to an indoor space to adjust temperature of the indoor space.

The first outdoor unit 100*a* and the first indoor unit 100*b* may be connected to each other via external piping 100*c*, the first outdoor unit 100*a* may transfer the compressed and condensed refrigerant to the first indoor unit 100*b* via the external piping 100*c*, and the first indoor unit 100*b* may transfer the evaporated refrigerant back to the first outdoor unit 100*a* via the external piping 100*c*.

The external piping 100*c* configured to connect the first outdoor unit 100*a* and the first indoor unit 100*b* may include a pipe which is hollow to allow a refrigerant to flow therethrough and various connecting members configured to connect a plurality of pipes. The pipes or the connecting members may be implemented using materials such as metal, synthetic resin, or rubber. One end of the external piping 100*c* may extend from piping 150 and 155 connected to a compressor 110 (see FIG. 4), an outdoor heat exchanger 111 (condenser), or an electronic expansion valve (EEV) 112 of the first outdoor unit 100*a*. The other end of the external piping 100*c* extends from piping 250 and 252 connected to an EEV 112 or an indoor heat exchanger 171 of the first indoor unit 100*b*.

A halogen compound refrigerant such as chlorofluorocarbon (CFC), a hydrocarbon refrigerant, carbon dioxide, ammonia, water, air, an azeotropic refrigerant, chloromethyl, or the like may be used as the refrigerant. In addition, various other types of substances that the designer may take into consideration may be used as the refrigerant.

Hereinafter, the first outdoor unit 100*a* will be described.

FIG. 4 is a view for describing an outdoor unit according to an embodiment.

Referring to FIG. 4, a first outdoor unit 100*a* may include a compressor, an outdoor heat exchanger 111, an EEV 112, refrigerant paths 150 to 155 configured to connect the compressor 110, the outdoor heat exchanger 111, and the EEV 112 to one another, and an outdoor unit fan 114 and, depending on the embodiment, may further include a four-way valve 113. The first outdoor unit 100*a* may further include at least one of a first controller 120, a main memory 121 such as a read-only memory (ROM) or a random access memory (RAM), an auxiliary memory 122, and an outdoor temperature measurer 130 as necessary.

Arrows shown in the refrigerant paths 150 to 155 in FIG. 4 represent refrigerant flow directions when the first air conditioner 100 is performing a cooling operation. When the air conditioner 1 is performing a heating operation, the refrigerant may flow in directions opposite from those shown in FIG. 4. The cooling operation refers to operation of the first air conditioner 100 that is performed to decrease indoor air temperature, and the heating operation refers to operation of the first air conditioner 100 that is performed to increase the indoor air temperature.

One end of the external piping 100*c* enters the first outdoor unit 100*a* and is connected to the refrigerant paths 150 and 155 inside the outdoor unit 100*a*.

The compressor 110 is directly or indirectly connected to the refrigerant paths 150 and 155 connected to the external piping 100*c*, and receives refrigerant via the refrigerant paths 150 and 151. The refrigerant transferred via the refrigerant paths 150 and 151 may include refrigerant evaporated by an indoor heat exchanger 171 (see FIG. 5). The compressor 110 may absorb refrigerant supplied via the refrigerant paths 150 and 151 and change the absorbed refrigerant into a high-temperature, high-pressure gas. The high-temperature, high-pressure gas may be transferred to the outdoor heat exchanger 111 via a refrigerant path 152 configured to connect the compressor 110 and the outdoor heat exchanger 111.

The compressor 110 may be implemented by employing a positive displacement type compressor or a dynamic type compressor, and various other types of compressors that a designer may take into consideration may be used as the compressor 110.

To change refrigerant into the high-temperature, high-pressure gas, a predetermined motor may be provided in the compressor 110. The motor may be rotated at a predetermined speed in accordance with control of the first controller 120. When an inverter air compressor is used as the compressor 110 of the outdoor unit 100*a*, an operational frequency of the motor may vary, and in this case, the operational frequency of the motor may be determined in accordance with a control signal transmitted from the first controller 120. A cooling ability of the first air conditioner 100 may be changed in accordance with the operational frequency of the motor.

When the first air conditioner 100 performs the cooling operation, the outdoor heat exchanger 111 may serve as a condenser and liquefy a high-temperature, high-pressure gaseous refrigerant into a high-temperature, high-pressure liquid. In the outdoor heat exchanger 111, the refrigerant emits heat to the outside as the refrigerant is being liquefied, and accordingly, temperature of the refrigerant is decreased. The refrigerant condensed in the outdoor heat exchanger 111 may be moved to the EEV 112 via the refrigerant paths 154 and 155 provided in the outdoor heat exchanger 111.

Conversely, when the first air conditioner 100 performs the heating operation, the outdoor heat exchanger 111 may serve as an evaporator, and the refrigerant may absorb surrounding heat while being evaporated around the outdoor heat exchanger 111.

According to an embodiment, the outdoor heat exchanger 111 may be implemented using a cooling pipe formed to be curved in a zigzag shape, and in this case, one end of the cooling pipe may be connected to the refrigerant path 152 connected to the compressor 110, and the other end of the cooling pipe may be connected to the refrigerant path 154 connected to the EEV 112 of the first outdoor unit 100*a* or connected to external piping 155.

The outdoor heat exchanger 111 may be implemented by employing various types of compressors such as a water-cooling condenser, an evaporating condenser, or an air-cooling condenser. Further, the outdoor heat exchanger 111 may be implemented by employing various other types of condensers that a designer may take into consideration.

The EEV 112 may expand the high-temperature, high-pressure liquid refrigerant and discharge a refrigerant in which a low-temperature, low-pressure gas and liquid are mixed. The EEV 112 may also adjust the amount of refrigerant introduced into the indoor heat exchanger 171 of the first indoor unit 100*b* in accordance with control. The refrigerant discharged from the EEV 112 may be transferred to the first outdoor unit 100*a* via the refrigerant path 155 and the external piping 100*c*.

Various types of valves such as a thermoelectric EEV using deformation of a bimetal, a thermodynamic EEV using volumetric expansion due to heating of sealed wax, a pulse width modulation type EEV that opens or closes a solenoid valve by a pulse signal, or a stem motor type EEV that opens or closes a valve using the motor may be used as the EEV 112.

Depending on the embodiment, the EEV 112 of the first outdoor unit 100*a* may be omitted. In this case, an EEV 170 (see FIG. 5) may be provided in the first indoor unit 100*b*.

The four-way valve 113 may switch the flow direction of the high-temperature, high-pressure gaseous refrigerant discharged from the compressor 110. In other words, the four-way valve 113 may cause the refrigerant to flow from the compressor 110 to the outdoor heat exchanger 111 (direction indicated by the arrows in FIG. 4) during the cooling operation and cause the refrigerant to flow from the outdoor heat exchanger 111 to the compressor 110 (direction opposite to that indicated by the arrows in FIG. 4) during the heating operation.

The four-way valve 113 is provided to be connected to the first refrigerant path 150 connected to the external piping 100*c*, the second refrigerant path 151 and the third refrigerant path 152 connected to the compressor 110, and the fourth refrigerant path 153 connected to the outdoor heat exchanger 111, and at least two from among the first refrigerant path 150 to the fourth refrigerant path 153 may be connected to each other or cut as necessary to change the flow of the refrigerant.

For example, during the cooling operation, the four-way valve 113 may connect the first refrigerant path 150 and the second refrigerant path 151 and cause the refrigerant to be introduced into the compressor 110 and connect the third refrigerant path 152 and the fourth refrigerant path 153 and cause the refrigerant discharged from the compressor 110 to be introduced into the outdoor heat exchanger 111. During the heating operation, the four-way valve 113 may connect the first refrigerant path 150 and the third refrigerant path 152 and cause the refrigerant discharged from the compressor 110 to flow to the external piping 100*c* via the first refrigerant path 150 and connect the second refrigerant path 151 and the fourth refrigerant path 153 to cause the refrigerant discharged from the outdoor heat exchanger 111 to be introduced into the compressor 110.

The four-way valve 113 may be implemented using an electromagnet or the like or may be omitted in accordance with a designer's choice.

The outdoor unit fan 114 may emit air around the outdoor heat exchanger 111 to the outside and serve to disperse heat that is emitted as refrigerant is liquefied in the outdoor heat exchanger 111. The outdoor unit fan 114 may be implemented using one or more wings and the motor for rotating the wings. The outdoor unit fan 114 may be installed around the outdoor heat exchanger 111 for efficient emission of heat.

The refrigerant paths 150 to 155 may have the shape of a pipe which is hollow, and the hollow inner space may be used as a path through which the refrigerant flows. The refrigerant paths 150 to 155 may be implemented with materials such as metal or rubber.

The first controller 120 may control the overall operation of the first outdoor unit 100*a*, and for this, the first controller 120 may transmit a control signal to various components inside the first outdoor unit 100*a*. For example, the first controller 120 may generate a predetermined control signal, which is an electrical signal, and then transmit the generated control signal to the compressor 110, the EEV 112, or the four-way valve 113 via a circuit or cable to control operations thereof.

For example, the first controller 120 may control the motor of the compressor 110 to adjust a refrigerant circulation speed, and more specifically, change the operational frequency of the motor of the compressor 110 to adjust the refrigerant circulation speed.

The first controller 120 may control operation of the first outdoor unit 100*a* in accordance with a result of determination by itself, or receive a control command or data from a second controller 180 of the first indoor unit 100*b* and control operation of the first outdoor unit 100*a* in accordance with the received control command or data. The first controller 120 may also transmit the control command or acquired data to the second controller 180 of the first indoor unit 100*b*.

For example, the first controller 120 may be implemented using a central processing unit (CPU) or a microcomputer (MiCOM).

Such the CPU and MiCOM may be implemented with one or more semiconductor chips and components related thereto. The one or more semiconductor chips that implement the CPU or MiCOM may be provided on a printed circuit board built in and installed in the outdoor unit 100*a*, and may be electrically connected to various components such as the compressor 110 via a circuit formed on the printed circuit board, a separate cable, or the like.

The main memory 121 and the auxiliary memory 122 may temporarily or non-temporarily store various pieces of information related to operation of the first controller 120. The main memory 121 may be implemented using a solid state drive such as the ROM or the RAM, and the auxiliary memory 122 may be implemented using an optical disk drive, the solid state drive, a magnetic disk drive, or a magnetic drum drive. In addition, the main memory 121 and the auxiliary memory 122 may be implemented using various other storage media that the designer may take into consideration.

The outdoor temperature measurer 130 may measure air temperature of an outdoor space in which the outdoor unit 100*a* is installed and transmit a measured result to a first processor 120. The outdoor temperature measurer 130 may be implemented using a bimetal thermometer, a thermistor thermometer, an infrared thermometer, or the like. The outdoor temperature measurer 130 may be installed at an outer surface of an external housing of the outdoor unit 100*a* to accurately measure outdoor air temperature, and may also be installed to be spaced a predetermined distance apart from the external housing as necessary.

At least one of the first controller 120, the main memory 121, the auxiliary memory 122, and the outdoor temperature measurer 130 may be omitted in accordance with the designer's arbitrary choice.

Hereinafter, the first indoor unit 100*b* will be described.

FIG. 5 is a view for describing an indoor unit according to an embodiment.

According to FIG. 5, the indoor unit 100*b* may include an indoor heat exchanger 171, a blower fan 172, a second controller 180, a storage 191, an outlet 175, refrigerant paths 160 to 162, and a communicator 199, and further include an input unit 193 and a display 198 as necessary. Depending on the embodiment, the indoor unit 100*b* may further include at least one of an EEV 170, an indoor temperature measurer 194, and a humidity level measurer 198.

The other end of the external piping 100*c* connected to the outdoor unit 100*a* enters the indoor unit 100*b* and is connected to the refrigerant paths 160 and 161 inside the indoor unit 100*b*, and the refrigerant paths 160 and 161 inside the indoor unit 100*b* connected to the external piping 100*c* are connected to the EEV 170 or the indoor heat exchanger 171.

The EEV 170 is connected to the refrigerant path 160 connected to the external piping 100*c*. When the cooling operation is performed while the EEV 112 is not provided in the outdoor unit 100*a*, the EEV 170 may receive a high-temperature, high-pressure liquid refrigerant from the outdoor unit 100*a* via the refrigerant path 160. The EEV 170 may expand a received high-temperature, high-pressure liquid refrigerant and discharge refrigerant in which a low-temperature, low-pressure gas and liquid are mixed. The EEV 170 may also adjust the amount of refrigerant introduced into the indoor heat exchanger 171 of the indoor unit 100*b*. When the EEV 112 is provided in the outdoor unit 100*a*, the EEV 170 of the indoor unit 100*b* may be omitted.

The refrigerant discharged from the EEV 112 of the outdoor unit 100*a* or the EEV 170 of the indoor unit 100*b* may be transferred to the indoor heat exchanger 171 via the refrigerant path 161.

The indoor heat exchanger 171 is provided to emit cold air 174 using the refrigerant transferred thereto. Specifically, while passing through the indoor heat exchanger 171, the refrigerant absorbs latent heat, is evaporated, and causes temperature of air in an inner space 173 of the indoor unit 100*b* to decrease. Accordingly, the indoor heat exchanger 171 may emit the cold air 174 to the inner space 173 of the indoor unit 100*b*. The indoor heat exchanger 171 may include a flow path through which the refrigerant flows, and the flow path may be implemented using a tubular body formed with a material such as metal or synthetic resin. The tubular body may have a zigzag shape that is curved multiple times.

The refrigerant evaporated by the indoor heat exchanger 171 moves to the external piping 100*c* via the refrigerant path 162 connected to each of the indoor heat exchanger 171 and the external piping 100*c*, and the refrigerant discharged to the external piping 100*c* is transferred to the outdoor unit 100*a*. The refrigerant transferred to the outdoor unit 100*a* is introduced into the compressor 110 again via the refrigerant paths 150 and 151 provided in the outdoor unit 100*a*.

The blower fan 172 moves the cold air 174 emitted to the inner space 173 toward the outlet 175, and the outlet 175 emits the cold air 174 to an indoor space. The blower fan 172 may include one or more wings and a motor configured to rotate the wings, and the strength of the cold air 174 emitted via the outlet 175 may be adjusted in accordance with operation of the motor.

When the heating operation is performed, as illustrated in FIG. 5, the refrigerant flows in the opposite direction, heat is emitted from the indoor heat exchanger 171, and hot air is emitted to the indoor space from the outlet 175.

A second controller 180 may generate a control signal for each component of the indoor unit 100*b* and transmit the generated control signal to each corresponding component to control the overall operation of the indoor unit 100*b*. For example, the second controller 180 may control the blower fan 172 to be operated, the EEV 170 to be opened or closed, or the display 198 to display a specific image. The control signal generated from the second controller 180 may be transmitted to each component of the indoor unit 100*b* via a circuit or a cable built in the external housing of the indoor unit 100*b*.

The second controller 180 may communicate with the first controller 120 of the outdoor unit 100*a* via a wired communication network or a wireless communication network.

The second controller 180 may determine an upper rank group 9 to which a corresponding device, i.e., a first air conditioner 100, belongs, one or more of lower rank groups 10 to 40 to which the corresponding device belongs, one or more of the air conditioners 100 to 109 having control authority over the air conditioners 100 to 109 that belong to one or more of the lower rank groups 10 to 40, and the like. In this case, the second controller 180 may also determine the air conditioner having control authority over one or more of the air conditioners 100 to 109 in the upper rank group 9 from among the plurality of air conditioners 100 to 109 or control authority over specific operations of one or more of the air conditioners 100 to 109 in the upper rank group 9, e.g., whether the first air conditioner 100 has such control authority, and determine the air conditioner having control authority over specific operations of the air conditioners 100 to 103 in a specific lower rank group, e.g., the first lower rank group 10.

The second controller 180 may generate the control signal for controlling other air conditioners 101 to 109, or interpret the control signal transmitted from the other air conditioners 101 to 109, generate the control signal corresponding to the transmitted control signal, and transmit the generated control signal to each component of the indoor unit 100*b* or the first controller 120 of the outdoor unit 100*a*.

The second controller 180 may determine groups to which the other air conditioners 101 to 109 belong and control authorities of the other air conditioners 101 to 109.

The second controller 180 may generate information on a control hierarchy structure of the air conditioner controlling system or update the generated information on the control hierarchy structure as necessary.

The second controller 180 may determine whether a signal transmitted from the outside is the control signal generated in accordance with proper authority and cause operation of the first air conditioner 100 to be controlled in accordance with a result of determination.

Furthermore, the second controller 180 may also generate information on a state of the first air conditioner 100 and control the generated information on the state of the first air conditioner 100 to be transmitted to the other air conditioners 101 to 109.

Various operations and functions of such the second controller 180 will be described in detail below.

The second controller 180 may be implemented using, for example, a CPU or a MiCOM, and such the CPU or the MiCOM may be implemented using one or more semiconductor chips and components related thereto. The one or more semiconductor chips that implement the CPU or the MiCOM may be provided on a printed circuit board built and installed in the outdoor unit 100*a*, and may be electrically connected to various components inside the indoor unit 100*b* via a circuit formed on the printed circuit board, a separate cable, or the like.

The storage 191 may store various pieces of information related to operation of the second controller 180, and according to an embodiment, store information on the upper rank group 9 and the lower rank group 10 to which the corresponding air conditioner, i.e., the first air conditioner 100, belongs or store information on the control hierarchy structure of the air conditioner controlling system 1.

The storage 191 may include a main memory 191*a* and an auxiliary memory 191*b*. The main memory 191*a* and the auxiliary memory 191*b* may temporarily or non-temporarily store various pieces of information required for control of the indoor unit 100*b* and assist operation of the second controller 180. For example, the main memory 191*a* may temporarily store information on states of the other air conditioners 101 to 109 transmitted from the other air conditioners 101 to 109 for the second controller 180 to easily determine groups to which the other air conditioners 101 to 109 belong or control authorities thereof. For example, the auxiliary memory 191*b* may also store information on the control hierarchy structure of the air conditioner controlling system 1.

The input unit 193 may receive various commands for controlling the first air conditioner 100 from a user. The input unit 193 may be provided at an outer surface of the external housing of the indoor unit 100*b* for convenience of user manipulation. The input unit 193 may be implemented using at least one of a physical button, a keyboard, a mouse, a track ball, a knob, a touchpad, a paddle, various levers, a handle, a joystick, and a touchscreen. In addition, examples of the input unit 193 may include various other devices capable of generating an electrical signal in accordance with a user manipulation and directly or indirectly transmitting the generated electrical signal to the first controller 120 or the second controller 180.

The indoor temperature measurer 194 may measure air temperature of the indoor space in which the indoor unit 100*b* is installed and transmit a measured result to the second controller 180. The indoor temperature measurer 194 may be implemented by employing a bimetal thermometer, a thermistor thermometer, an infrared thermometer, or the like. The indoor temperature measurer 194 may be provided at an outer surface of an external housing 230 of the indoor unit 100*b* for accuracy and convenience of temperature measurement, and more specifically, provided at a front surface of the external housing 230.

The humidity level measurer 198 may measure humidity level of the indoor space. The humidity level measurer 198 may be provided at outer surface of an external housing of the indoor unit 100*b* to accurately measure the humidity level of the indoor space. The humidity level measurer 198 may be implemented using a psychrometer, a dew point hygrometer, a resistive polymer thin film-type hygrometer, or a capacitive polymer thin film-type hygrometer, and may also be implemented using various other types of hygrometers that a designer may take into consideration.

The display 198 may display a state of the first air conditioner 100 or various pieces of information for user convenience to the outside. The display 198 may display various pieces of information on whether a test operation has been normally ended, whether the first air conditioner 100 is abnormal, a type of error that has occurred in the first air conditioner 100, or a way to solve an error that has occurred to a user and allow the user to easily grasp the state of the first air conditioner 100.

The display 198 may output an error message when a problem occurs in terms of control authority or group setting in the air conditioner controlling system 1.

The display 198 may be implemented using a PDP, an LED display panel, a LCD, or the like.

Depending on the embodiment, a lighting device (not illustrated) or a sound output device (not illustrated) may be further provided to provide a state of the first air conditioner 100 or various pieces of information for user convenience to the user. The lighting device may be implemented using various light-emitting means such as an LED lamp, and the sound output device may be implemented using a speaker or the like.

Hereinafter, operations and functions of the second controller 180 will be described in more detail with reference to FIGS. 6 to 21.

FIG. 6 is a control block diagram of a second controller according to an embodiment.

According to FIG. 6, a second controller 180 may include a signal input unit 181, a control information processor 182, a first operation controller 187, a second operation controller 188, and a state information transmission controller 189. The signal input unit 181, the control information processor 182, the first operation controller 187, the second operation controller 188, and the state information transmission controller 189 of the second controller 180 which will be described below may be physically distinguished or logically distinguished depending on the embodiment.

The signal input unit 181 is electrically connected to the input unit 95 of the user interface 94 and the input unit 193 or the communicator 199 of the indoor unit 100*b*, and receives an electrical signal corresponding to a control command or various pieces of information transmitted from the input unit 95 of the user interface 94 and the input unit 193 or the communicator 99 of the indoor unit 100*b*.

The signal input unit 181 may transmit a received electrical signal to the control information processor 182, the first operation controller 187, and the second operation controller 188. In this case, the signal input unit 181 may transmit a received electrical signal to a proper control block from among the control information processor 182, the first operation controller 187, and the second operation controller 188. For example, the signal input unit 181 may transmit various pieces of information related to control of the air conditioners 100 to 109 to the control information processor 182, transmit control commands transmitted from the other air conditioners 100 to 109 to the first operation controller 187, and transmit a user command related to operation of a first air conditioner 100 input in accordance with manipulation of the input units 95 and 193 to the second operation controller 188.

Here, the various pieces of information related to the control of the air conditioners 100 to 109 may include information related to the groups 9 and 10 to 40 to which the air conditioners 100 to 109 belong and control authorities thereof. Hereinafter, the information related to the groups 9 and 10 to 40 to which the air conditioners 100 to 109 belong and control authorities thereof will be referred to as control hierarchy structure basic information.

According to an embodiment, the control hierarchy structure basic information may be input by a user manipulating the input unit 95 of the separately-provided user interface 94, or may be input by the user manipulating the input unit 193 of a predetermined air conditioner, e.g., the first air conditioner 100. The control hierarchy structure basic information may also be input by the user manipulating an input means provided at the external control user interface 92 provided at the separately-provided external control device 90. Furthermore, in addition, the control hierarchy structure basic information may also be transmitted from the outside in accordance with a predefined setting.

According to another embodiment, the control hierarchy structure basic information transmitted to the first air conditioner 100 may be transmitted from the air conditioners 101 to 109 other than the first air conditioner 100. For example, the other air conditioners 101 to 109 may periodically or non-periodically transmit the control hierarchy structure basic information of the air conditioners 101 to 109 themselves to the first air conditioner 100, and the first air conditioner 100 may receive the pieces of control hierarchy structure basic information which are periodically or non-periodically transmitted. More specifically, for example, the air conditioners 101 to 109 may periodically or non-periodically transmit state information related to states of the air conditioners 101 to 109 autonomously to the first air conditioner 100, and such pieces of state information may include the control hierarchy structure basic information. Accordingly, the other air conditioners 101 to 109 autonomously transmit control hierarchy structure basic information of the air conditioners 101 to 109 to the first air conditioner 100.

FIG. 7 is a view illustrating an example of information transmitted to any one air conditioner, and FIG. 8 is a view illustrating another example of information transmitted to any one air conditioner. FIG. 9 is a view illustrating still another example of information transmitted to any one air conditioner.

As illustrated in FIGS. 7 to 9, pieces of control hierarchy structure basic information i1 to i3 may only include information on groups 9 and 10 to 40 to which specific air conditioners, e.g., a first air conditioner 100, belong and air conditioners having control authority over each group.

Specifically, referring to FIGS. 7 to 9, one or more pieces of control hierarchy structure basic information i1 to i3 may be transmitted to the first air conditioner 100, and the one or more transmitted pieces of control hierarchy structure basic information i1 to i3 may include information on the groups 9 and 10 to 40 to which the air conditioners 100 to 109 belong and control authorities thereof. For example, the control hierarchy structure basic information may include control hierarchy structure basic information i1 on the first air conditioner 100, and include pieces of control hierarchy structure basic information on other air conditioners, e.g., the second air conditioner 101 to the tenth air conditioner 109. Although only pieces of control hierarchy structure basic information i2 and i3 related to the second air conditioner 101 and the tenth air conditioner 109 are illustrated in FIGS. 8 and 9 as examples of other air conditioners, pieces of control hierarchy structure basic information on other air conditioners 102 to 108 may also be provided in the same way.

The pieces of control hierarchy structure basic information i1 to i3 may include a plurality of records, and the records may include records related to an upper rank group to which the corresponding air conditioners 100 to 109 belong, records related to a lower rank group, a record related to control authority over the upper rank group, and a record related to control authority over the lower rank group. In this case, information on the upper rank group to which the corresponding air conditioners 100 to 109 belong, information on the lower rank group, information on the control authority over the upper rank group, and information on the control authority over the lower rank group are recorded in fields of the records.

Here, text, symbols, or numbers of an upper rank group field value and a lower rank group field value respectively represent the upper rank group and the lower rank group to which the first air conditioner 100 belongs. Specifically, for example, as illustrated in FIG. 7, in the control hierarchy structure basic information i1 on the first air conditioner 100, the upper rank group field value may be 1, which indicates that the upper rank group to which the first air conditioner 100 belongs is the first upper rank group 9. In addition, the lower rank group field value may be 1, which indicates that the lower rank group to which the first air conditioner 100 belongs is the first lower rank group 10.

An upper rank group control authority field value and a lower rank group control authority field value respectively represent a main controlling air conditioner having control authority over the upper rank group and a sub-controlling air conditioner having control authority over the lower rank group corresponding to the lower rank group field value. Referring to FIG. 7, the upper rank group control authority field value may be 1, which indicates that the first air conditioner 100 has control authority over air conditioners 100 to 109 of the upper rank group 9 to which the first air conditioner 100 belongs. A lower rank group control authority field value may be 2, which indicates that the second air conditioner 101 has sub-control authority over the air conditioners 100 to 105 of the lower rank group to which the first air conditioner 100 belongs, i.e., the first lower rank group 10. In other words, in the air conditioner controlling system 1 having a hierarchy structure as illustrated in FIG. 2, a main controlling air conditioner is the first air conditioner 100, and the sub-controlling air conditioner of the first lower rank group 10 is the second air conditioner 101.

Likewise, referring to FIG. 8, control hierarchy structure basic information i2 on the second air conditioner 101 indicates that the second air conditioner 101 belongs to a first upper rank group 2 and the first lower rank group 10, the main controlling air conditioner is the first air conditioner 100, and the sub-controlling air conditioner of the first lower rank group 10 is the second air conditioner 101.

Likewise, referring to FIG. 9, control hierarchy structure basic information i3 on the tenth air conditioner 109 indicates that the tenth air conditioner 109 belongs to the first upper rank group 2 and the fourth lower rank group 40, the main controlling air conditioner is the first air conditioner 100, and the sub-controlling air conditioner of the fourth lower rank group 40 is the eighth air conditioner 107.

Control hierarchy structure basic information transmitted to a single air conditioner, e.g., the first air conditioner 100, may include the control hierarchy structure basic information i1 related to the first air conditioner 100, or include pieces of control hierarchy structure basic information (e.g., i2, i3) related to one or more of the air conditioners 101 to 109 other than the first air conditioner 100.

When the control hierarchy structure basic information i1 related to the first air conditioner 100 is transmitted, the first air conditioner 100 may be able to determine a group to which the first air conditioner 100 itself belongs or control authority thereof using the control hierarchy structure basic information i1 on the first air conditioner. When pieces of control hierarchy structure basic information (e.g., i2, i3) related to one or more of the other air conditioners 101 to 109 are transmitted, the first air conditioner 100 may be able to determine one or more groups 9 and 10 to 40 to which the other air conditioners 101 to 109 belong or control authority thereof using the pieces of control hierarchy structure basic information i2 and i3 on one or more of the other air conditioners 101 to 109.

Like the first air conditioner 100, the air conditioners 101 to 109 other than the first air conditioner 100 may receive pieces of control hierarchy structure basic information on the other air conditioners 101 to 109 themselves and further receive pieces of control hierarchy structure basic information on the other air conditioners 100 to 109 in addition to the pieces of control hierarchy structure basic information on the air conditioners 101 to 109 themselves. The other air conditioners 100 to 109 may also determine groups 9 and 10 to 40 to which themselves and the other air conditioners 100 to 109 belong or control authorities thereof using the pieces of control hierarchy structure basic information transmitted thereto.

FIG. 10 is a view illustrating yet another example of information transmitted to any one air conditioner.

In FIG. 10, a upper rank group field value "1" indicates that a specific air conditioner belongs to a first upper rank group, a lower rank group field value "1" indicates that corresponding air conditioners, e.g., a first air conditioner 100 to a fourth air conditioner 103, belong to a first lower rank group, the lower rank group field value "2" indicates that the corresponding air conditioners, e.g., a fifth air conditioner 104 and a sixth air conditioner 105, belong to a second lower rank group, the lower rank group field value "3" indicates that the corresponding air conditioner, e.g., a seventh air conditioner 106, belongs to a third lower rank group, and the lower rank group field value "4" indicates that the corresponding air conditioners, e.g., an eighth air conditioner 107 to a tenth air conditioner 109, belong to a fourth lower rank group.

Likewise, the upper rank group control authority field value "1" indicates that the first air conditioner 100 has control authority over the air conditioners 100 to 109 belonging to the upper rank group 9, and the lower rank group control authority field values 2, 5, 7, and 8 indicate that the second air conditioner 101, the fifth air conditioner 104, the seventh air conditioner 106, and the eighth air conditioner 107 have control authorities over the air conditioners 100 to 109 in the corresponding lower rank groups 10 to 40.

As illustrated in FIG. 10, control hierarchy structure basic information i10 may include both information on groups 9 and 10 to 40 to which a plurality of air conditioners, e.g., the first air conditioner 100 to the tenth air conditioner 109, belong and information on control authorities over the groups 9 and 10 to 40. In cases of the pieces of control hierarchy structure basic information it to i3 described above with reference to FIGS. 7 to 9, each of the pieces of control hierarchy structure basic information i1 to i3 may be separately transmitted to at least one air conditioner, e.g., the first air conditioner 100. However, when the control hierarchy structure basic information i10 includes all pieces of information related to the plurality of air conditioners 100 to 109 as described above, the control structure-related information i10 may collectively transmit pieces of information on groups and control authorities of the air conditioners 100 to 109 to at least one air conditioner, e.g., the first air conditioner 100.

FIG. 11 is a control block diagram of a control information processor according to an embodiment.

According to an embodiment, a control information processor 182 may include a group determiner 183, control authority determiner 184, control authority processor 185, and a control hierarchy structure processor 186.

The group determiner 183 may determine a group to which a corresponding air conditioner belongs and groups to which other air conditioners belong. For example, when the second controller 180 is the first air conditioner 100, the corresponding air conditioner refers to the first air conditioner 100, and the other air conditioners refer to, for example, the second air conditioner 101 to the tenth air conditioner 109.

FIG. 12 is a control block diagram of a group determiner according to an embodiment.

As illustrated in FIGS. 11 and 12, a group determiner 183 may include a first group determiner 183*a* and a second group determiner 183*b*.

The first group determiner 183*a* may determine at least one of an upper rank group and a lower rank group to which a corresponding air conditioner, e.g., a first air conditioner 100, belongs. In this case, the first group determiner 183*a* may determine at least one of the upper rank group and the lower rank group to which the first air conditioner 100 belongs with reference to control hierarchy structure basic information i1 on the first air conditioner 100.

More specifically, the first group determiner 183*a* may include at least one of an upper rank group determiner 183*c* and a lower rank group determiner 183*d*. The upper rank group determiner 183*c* may determine an upper rank group to which the first air conditioner 100 is set to belong, and the lower rank group determiner 183*d* may determine a lower rank group to which the first air conditioner 100 is set to belong. For example, when the control hierarchy structure basic information i1 is given as illustrated in FIG. 7, the upper rank group determiner 183*c* may determine on the basis of the control hierarchy structure basic information i1 that the first air conditioner 100 belongs to the first upper rank group, and the lower rank group determiner 183*d* may determine on the basis of the control hierarchy structure basic information i1 that the first air conditioner 100 belongs to the first lower rank group.

A result of determination by the first group determiner 183*a* may be transmitted to the control authority determiner 184. Depending on the embodiment, the upper rank group determiner 183*c* may transmit a result of determination to a main controlling device determiner 184*a*, and the lower rank group determiner 183*d* may transmit a result of determination to a sub-controlling air conditioner determiner 184*b*.

According to an embodiment, the lower rank group determiner 183*d* may be omitted, and the first group determiner 183*a* may only include the upper rank group determiner 183*c*.

When, as a result of determination, it is not known which group the first air conditioner 100 belongs to, such as when an upper rank group 9 set regarding the first air conditioner 100 does not exist, the first group determiner 183*a* may control an error message to be output. Specifically, the first group determiner 183*a* may generate a control signal for at least one of the display 198 of the first air conditioner 100 and the display 96 of the user interface 94 to display a message indicating that there is an error in setting a group to which the first air conditioner 100 belongs. Depending on the embodiment, the first group determiner 183*a* may also generate the control signal for a sound output device provided in the user interface 94 or the first air conditioner 100 to output voice or sound corresponding to the error message or for a lighting device to emit light in response to the error message.

The second group determiner 183*b* may determine at least one of the upper rank group and the lower rank group to which other air conditioners, e.g., the second air conditioner 101 to the tenth air conditioner 109, belong. In this case, the second group determiner 183*b* may determine the upper rank groups or the lower rank groups to which the other air conditioners 101 to 109 belong with reference to pieces of control hierarchy structure basic information (e.g., i2 and i3) on the other air conditioners 101 to 109 or determine both the upper rank group and the lower rank group.

Like the first group determiner 183*a*, the second group determiner 183*b* may include at least one of an upper rank group determiner 183*e* and a lower rank group determiner 183*f* The upper rank group determiner 183*e* may determine upper rank groups to which the other air conditioners 101 to 109 are set to belong, and the lower rank group determiner 183*f* may determine lower rank groups to which the other air conditioners 101 to 109 are set to belong. For example, when control hierarchy structure basic information i2 regarding the second air conditioner 101 is given as illustrated in FIG. 8, the upper rank group determiner 183*e* may determine on the basis of the control hierarchy structure basic information i2 that the second air conditioner 101 belongs to the first upper rank group, and determine on the basis of the control hierarchy structure basic information i2 that the second air conditioner 101 belongs to the first lower rank group.

Likewise, a result of determination by the second group determiner 183*b* may be transmitted to the control authority determiner 184, and depending on the embodiment, the upper rank group determiner 183*e* may transmit a result of determination to the main controlling device determiner 184*a*, and the lower rank group determiner 183*f* may transmit a result of determination to the sub-controlling air conditioner determiner 184*b*.

When, as a result of determination, it is not known which group one or more other air conditioners 101 to 109 belong to, such as when at least one of the upper rank group 9 and the lower ranks 10 to 40 set regarding the other air conditioners 101 to 109 does not exist, the second group determiner 183*b* may control the error message to be provided to a user.

The control authority determiner 184 may determine the air conditioner having control authority in each group.

Specifically, the control authority determiner 184 may include the main controlling device determiner 184*a* and the sub-controlling air conditioner determiner 184*b*. The main controlling device determiner 184*a* may determine an air conditioner having control authority over the air conditioners 100 to 109 in the upper rank group 9, i.e., the main controlling air conditioner, from among the plurality of air conditioners 100 to 109, and the sub-controlling air conditioner determiner 184*b* may determine an air conditioner having control authority over the air conditioners 100 to 105 that belong to the same lower rank group 10, i.e., the sub-controlling air conditioner, from among the air conditioners 100 to 105 belonging to at least one of the plurality of lower rank groups 10, 20, 30, and 40, e.g., the first lower rank group 10.

When a result of determination regarding the upper rank group 9 to which the first air conditioner 100 belongs is transmitted from the upper rank group determiners 183*c* and 183*e*, the main controlling device determiner 184*a* may determine an air conditioner that serves as the main controlling air conditioner from among the plurality of air conditioners 100 to 109 belonging to the upper rank group 9 to which the first air conditioner 100 is included, with reference to the control hierarchy structure basic information i1. For example, the main controlling device determiner 184*a* may determine that the first air conditioner 100 is the main controlling air conditioner. Therefore, the main controlling device determiner 184*a* may determine whether an air conditioner in which the main controlling device determiner 184*a* is provided, e.g., the first air conditioner 100, is the main controlling air conditioner.

When there is an error in setting of the main controlling air conditioner, such as when information on the main controlling air conditioner does not exist in the control hierarchy structure basic information i1 or when an air conditioner (not illustrated) that does not belong to the upper rank group 9, which is determined by the upper rank group determiners 183*c* and 183*e* as a group to which the first air conditioner 100 belongs, is set as the main controlling air conditioner, the main controlling device determiner 184*a* may control at least one of the display 198 of the first air conditioner 100 and the display 96 of the user interface 94 to display a predetermined error message. In this case, the main controlling device determiner 184*a* may also control a sound output device to output voice or sound corresponding to the error message or control a lighting device to emit light in response to the error message.

When a result of determination regarding a lower rank group to which the first air conditioner 100 belongs is transmitted from the lower rank group determiners 183*d* and 183*f*, the sub-controlling device determiner 184*b* may determine an air conditioner that is selected as the sub-controlling air conditioner from among the plurality of air conditioners 100 to 105 belonging to a lower rank group which is determined as a group to which the first air conditioner 100 belongs, e.g., the first lower rank group 10. For example, the sub-controlling air conditioner determiner 184*b* may determine that the second air conditioner 101 of the first lower rank group 10 is the sub-controlling air conditioner. Therefore, when the sub-controlling air conditioner determiner 184*b* is provided in the second air conditioner 101, the second air conditioner 101 may be determined as the sub-controlling air conditioner.

When there is an error in setting of the sub-controlling air conditioner, the sub-controlling device determiner 184*b* may control at least one of the display 198 of the first air conditioner 100 and the display 96 of the user interface 94 to display a predetermined error message. In this case, the sub-controlling air conditioner determiner 184*b* may also control a sound output device to output voice or sound corresponding to the error message, or control a lighting device to emit light in response to the error message. Here, examples of a case when there is an error in setting of the sub-controlling air conditioner may include a case when information on the sub-controlling air conditioner does not exist in the control hierarchy structure basic information i1, a case when the air conditioners 105 to 109 that do not belong to a lower rank group which is determined by the lower rank group determiners 183*d* and 183*f*, e.g., the first lower rank group 10, are set as the sub-controlling air conditioners regarding the first lower rank group 10, or the like.

When it is determined from control hierarchy structure basic information that a specific air conditioner, e.g., the third air conditioner 102, is neither the main controlling air conditioner nor the sub-controlling air conditioner, a controlled device determiner 184*c* may determine that the third air conditioner 102 is a controlled air conditioner. When the controlled device determiner 184*c* belongs to the third air conditioner 102, the third air conditioner 102 determines that the third air conditioner 102 is a controlled air conditioner.

The control authority processor 185 may perform various processes related to control authority.

According to an embodiment, the control authority processor 185 may include control authority determiner 185*a*. The control authority determiner 185*a* may determine whether the other air conditioners 101 to 109 are controllable, air conditioners that control the other air conditioners 101 to 109 from among the air conditioners 101 to 109, operations that may be controlled from among operations of the other air conditioners 101 to 109, or the like.

Specifically, when it is determined by the main controlling device determiner 184*a* of the first air conditioner 100 that the first air conditioner 100 is the main controlling air conditioner, the control authority determiner 185*a* may determine that the first air conditioner 100 has control authority over all of the air conditioners 100 to 109 belonging to the upper rank group 9.

When it is determined by the sub-controlling air conditioner determiner 184*b* of the second air conditioner 100 that the second air conditioner 101 is a sub-controlling air conditioner over the first lower rank group 10, the control authority determiner 185*a* of the second air conditioner 101 may determine that the second air conditioner 101 has control authority over some of the air conditioners 100 to 105 belonging to the first lower rank group 10.

When it is determined by the controlled device determiner 184*c* of the third air conditioner 102 that the third air conditioner 102 is a controlled air conditioner, the control authority processor 185 may determine that the third air conditioner 102 has no control authority over the other air conditioners 100, 101, 103 to 109, and cause the third air conditioner 102 to be controlled in accordance with a control signal transmitted from the other air conditioners 101 and 102.

FIG. 13 is a view illustrating an example of a table related to control authority.

Depending on the embodiment, a control authority processor 185 may further include a control authority range determiner 185*b*.

The control authority range determiner 185*b* may determine parts controlled by a main controlling air conditioner, e.g., a first air conditioner 100, and parts controlled by a sub-controlling air conditioner, e.g., a second air conditioner 101.

In this case, the control authority range determiner 185*b* may browse a table related to control authority illustrated in FIG. 13 and determine a range of control authority of the main controlling air conditioner and a range of control authority of the sub-controlling air conditioner. The table related to control authority may be set by a designer or a user. The table related to control authority may be designed to be changed in accordance with a user's arbitrary choice. The range of control authority of the main controlling air conditioner and the range of control authority of the sub-controlling air conditioner may be defined not to overlap each other in the table related to control authority.

In FIG. 13, "1" in an authority field signifies a part controlled by the main controlling air conditioner, and "2" in an authority field signifies a part controlled by the sub-controlling air conditioner. For example, as illustrated in FIG. 13, parts controlled by the main controlling air conditioner may include on/off of the air conditioner, an increase of set temperature, a decrease of set temperature, timer setting, or the like, and parts controlled by the sub-controlling air conditioner may include whether to perform a blowing operation, whether to perform a dehumidifying operation, or whether to rotate a standing type air conditioner.

The control authority range determiner 185*b* may browse values in authority fields to check parts controlled by the main controlling air conditioner, e.g., the first air conditioner 100, and check parts controlled by the sub-controlling air conditioner, e.g., the second air conditioner 101, and accordingly, cause the first air conditioner 100 to generate control signals for the parts controlled by the first air conditioner 100 and transmit the generated control signals to all of the air conditioners 100 to 109 in the upper rank group 9, and cause the second air conditioner 101 to generate control signals for the parts controlled by the second air conditioner 101 and transmit the generated control signals to the air conditioners 100 to 105 in the first lower rank group 10, or determine whether a control signal transmitted from the outside has proper authority and be operated in accordance with a result of determination.

FIG. 14 is a view for describing transfer and reclamation of authority between a main controlling air conditioner and a sub-controlling air conditioner.

According to FIG. 14, the main controlling air conditioner, e.g., a first air conditioner 100, may transfer or reclaim control authority to or from the sub-controlling air conditioner of a first lower rank group 10, e.g., a second air conditioner 101.

According to an embodiment, the first air conditioner 100 may have control authority over operations of any of the air conditioners 100 to 109 in an upper rank group 9 in accordance with settings. In this case, when a user changes a value in a predetermined authority field of a table related to control authority, some control authority may be transferred from the first air conditioner 100 to the second air conditioner 101. In this case, the first air conditioner 100 may transmit the changed table related to control authority to the second air conditioner 101 or transmit content indicating that a table related to control authority has been changed and details of the changes to the second air conditioner 101 for the second air conditioner 101 to control the air conditioners 100 to 105 in the first lower rank group 10 in accordance with the control authority transferred thereto. In this case, the first air conditioner 100 only has remaining control authority, except for the control authority transferred to the second air conditioner 101, over the air conditioners 100 to 105 in the first lower rank group 10, and controls the air conditioners 100 to 105 in the first lower rank group 10 in accordance with the remaining control authority.

Conversely, in a case in which the first air conditioner 100 only has control authority over some operations of the air conditioners 100 to 105 in a specific lower rank group 10, and the second air conditioner 101 has control authority over the remaining operations when a user changes a value in a predetermined authority field of a table related to control authority and sets the first air conditioner 100 to also have control authority over the remaining operations, the first air conditioner 100 may reclaim control authority corresponding to the authority field, in which a value is changed, from the control authority for the remaining operations that the second air conditioner 101 has from the second air conditioner 101.

By such a method, control authority may be transferred and reclaimed between the main controlling air conditioner and the sub-controlling air conditioner.

FIG. 15 is a block diagram of a control hierarchy structure processor according to an embodiment, and FIG. 16 is a view illustrating an example of a control hierarchy structure.

A control hierarchy structure processor 186 is set to generate and update a control hierarchy of an air conditioner controlling system 1. Referring to FIG. 11, the control hierarchy structure processor 186 may include a control hierarchy structure generator 186*a* and a control hierarchy structure updater 186*b*.

The control hierarchy structure generator 186*a* may generate information on a control hierarchy structure illustrated in FIG. 16, on the basis of determinations made by a group determiner 183, control authority determiner 184, and control authority processor 185. Specifically, the control hierarchy structure generator 186*a* may generate information on the control hierarchy structure on the basis of a result of determination by the group determiner 183 related to groups 9 and 10 to 40 to which air conditioners 100 to 109 belong, a result of determination by the group determiner 183 related to the main controlling air conditioner and/or the sub-controlling air conditioner of the groups 9 and 10 to 40, and a result of determination related to control authority of the main controlling air conditioner and/or the sub-controlling air conditioner.

For example, when, as illustrated in FIG. 2, the air conditioners 100 to 109, which are included in the same upper rank group 9, are classified into a plurality of lower rank groups 10 to 40, the first air conditioner 100 is set as the main controlling air conditioner, and the second air conditioner 101, a fifth air conditioner 104, a seventh air conditioner 106, and an eighth air conditioner 107 are respectively set as sub-controlling air conditioners over the lower rank groups 10 to 40, as illustrated in FIG. 16, the control hierarchy structure generator 186*a* may arrange the first air conditioner 100 at an uppermost portion, arrange the second air conditioner 101, the fifth air conditioner 104, the seventh air conditioner 106, and the eighth air conditioner 107 below the first air conditioner 100, arrange the first air conditioner 100, the third air conditioner 102, and the fourth air conditioner 103 below the second air conditioner 101, arrange the sixth air conditioner 105 below the fifth air conditioner 104, not arrange any air conditioner below the seventh air conditioner 106, and arrange a ninth air conditioner 108 and a tenth air conditioner 109 below the eighth air conditioner 107 to generate information on the control hierarchy structure. Within the information on the control hierarchy structure, a control signal is transmitted from an air conditioner arranged above to an air conditioner arranged therebelow. That is, the first air conditioner 100 may transmit a control signal to the second air conditioner 101, the fifth air conditioner 104, the seventh air conditioner 106, or the eighth air conditioner 107 which are present below the first air conditioner 100, and also transmit a control signal to other air conditioners 102, 103, 105, 108, and 109 which are present below the second air conditioner 101, the fifth air conditioner 104, the seventh air conditioner 106, and the eighth air conditioner 107. When a sub-controlling air conditioner is set to have some authority, the first air conditioner 100 may receive a control signal from the second air conditioner 101, which is a sub-controlling air conditioner belonging to the same lower rank group 10.

According to an embodiment, when transmitting control signals to other air conditioners 100 to 109, the first air conditioner 100, the second air conditioner 101, the fifth air conditioner 104, the seventh air conditioner 106, and the eighth air conditioner 107 may use the transmitted control signals for the air conditioners that have transmitted the control signals, i.e., the first air conditioner 100, the second air conditioner 101, the fifth air conditioner 104, the seventh air conditioner 106, and the eighth air conditioner 107, to be controlled. This will be described below. When set as listed above, information on a control hierarchy structure may be generated so that, as illustrated in FIG. 16, the first air conditioner 100, the second air conditioner 101, the fifth air conditioner 104, the seventh air conditioner 106, and the eighth air conditioner 107, which are arranged at an upper portion, are arranged below the first air conditioner 100, the second air conditioner 101, the fifth air conditioner 104, the seventh air conditioner 106, and the eighth air conditioner 107.

Depending on the embodiment, the control hierarchy structure generator 186*a* may also generate information on a control hierarchy structure that only includes an air conditioner directly related to the air conditioners 100 to 109 to which the control hierarchy structure generator 186*a* belongs. For example, the fifth air conditioner 104 may generate a hierarchy structure only using information on the main controlling air conditioner 101 having some control authority over the air conditioner 105 and the fifth air conditioner 104 that belong to the second lower rank group 20.

The control hierarchy structure updater 186*b* may update generated information on the control hierarchy structure by methods such as adding a new air conditioner to the generated information on the control hierarchy structure, removing an existing air conditioner from the control hierarchy structure, changing the main controlling air conditioner and/or the sub-controlling air conditioner of the control hierarchy structure, or the like.

According to an embodiment, the control hierarchy structure updater 186*b* may update generated information on the control hierarchy structure on the basis of state information on states of other air conditioners 101 to 109 which have been generated by the state information transmission controller 189 of the air conditioners 100 to 109 and then transmitted to the control hierarchy structure updater 186*b* via the communicator 199. Here, the state information may include information indicating states of the air conditioners 100 to 109 such as current operational states of the air conditioners 100 to 109, whether power is applied to the air conditioners 100 to 109, and whether a failure has occurred in the air conditioners 100 to 109, and may include information on groups 9 and 10 to 40 to which the air conditioners 100 to 109 belong and control authority thereof, that is, control hierarchy structure basic information.

As illustrated in FIG. 15, the control hierarchy structure updater 186*b* may include a device deleter 186*c*, a device adder 186*d*, and an error determiner 186*e*.

The state information transmission controller 189 of the air conditioners 100 to 109 may periodically generate state information of the air conditioners 100 to 109 and periodically transmit the generated information to other air conditioners 100 to 109. In this case, the device deleter 186*c* may delete all or some of the air conditioners 100 to 109 from information on a control hierarchy structure in accordance with the state information of the air conditioners 100 to 109.

For example, the group determiner 183 may browse received state information on specific air conditioners 100 to 109, and when information on groups 9 and 10 to 40 to which the specific air conditioners 100 to 109 belong cannot be detected from the state information on the specific air conditioners 100 to 109, may transmit information indicating that the information on the groups 9 and 10 to 40 to which the predetermined air conditioners 100 to 109 belong does not exist to the device deleter 186*c*. The device deleter 186*c* may determine whether the air conditioners 100 to 109, whose information on the groups 9 and 10 to 40 does not exist, are present in a control hierarchy structure, and when the air conditioners 100 to 109, whose information on the groups 9, 10 to 40 does not exist, are present in the control hierarchy structure, delete the air conditioners 100 to 109, whose information on the groups 9 and 10 to 40 does not exist, from the control hierarchy structure.

As another example, when state information on specific air conditioners 100 to 109 that have been periodically transmitted is not received, the device deleter 186*c* may delete the specific air conditioners 100 to 109 from the control hierarchy structure.

In this case, according to an embodiment, the device deleter 186*c* may be designed to delete the specific air conditioners 100 to 109 from the control hierarchy structure immediately after the state information on the specific air conditioners 100 to 109 is not received.

FIG. 17 is a view for describing a method of counting the number of error occurrences.

According to another embodiment, a device deleter 186*c* may be designed to count time using a clock that is separately provided in a controller 180, and when data related to specific air conditioners 100 to 109 is not received from the specific air conditioners 100 to 109 for a predetermined amount of time or longer, may delete the specific air conditioners 100 to 109 from a control hierarchy structure. Here, the data related to the specific air conditioners 100 to 109 may include, for example, state information or the control hierarchy structure basic information.

Specifically, the device deleter 186*c* may increase or reset a count value every time data is not received from other air conditioners 100 to 109 and may determine a period of time during which predetermined data is not received from specific air conditioners 100 to 109. For this, as illustrated in FIG. 17, the device deleter 186*c* may use a data sheet including indices and information on count values. Here, an index represents an identification number for identifying each air conditioner, a column that is marked "first time point" represents count values at a first time point, and a column marked "second time point" represents count values at a second time point. Although the count values at the first time point and the count values at the second time point are shown together in FIG. 17 for convenience of description, depending on the embodiment, count values at a previous time point may be deleted when count values at a subsequent time point are acquired.

Referring to FIG. 17, the device deleter 186*c* may count whether state information is not received from the air conditioners 100 to 109 at each time point. That is, when state information is received at a specific time point as with a first air conditioner and a second air conditioner in FIG. 17, the device deleter 186*c* may not increase count values, and when state information is not received at specific time points, e.g., a third time point and a fourth time point, as with a third air conditioner, the device deleter 186*c* may increase count values. In this case, when a count value exceeds a predefined value, e.g., 3, the device deleter 186*c* determines that a specific air conditioner, e.g., the third air conditioner 102, has disappeared from the control hierarchy structure and deletes the specific air conditioner from information on the control hierarchy structure. When state information begins to be received again as in the case of a fourth air conditioner, the device deleter 186*c* resets a count value to be modified to 0. By the above methods, the device deleter 186*c* may determine whether other air conditioners have become extinct from the control hierarchy structure, may delete specific air conditioners which have become extinct in the control hierarchy structure from information on the control hierarchy structure stored in the device deleter 186*c* itself, and may maintain air conditioners which have not become extinct in the control hierarchy structure in the information on the control hierarchy structure stored in the device deleter 186*c* itself.

When specific air conditioners 100 to 109 are deleted from the control hierarchy structure by the device deleter 186*c*, a result of deletion may be transmitted to a hierarchy structure error determiner 186*e*.

The device adder 186*d* may further add a specific air conditioner to information on the control hierarchy structure. For example, when a new air conditioner (not illustrated) other than existing air conditioners 100 to 109 is added to an upper rank group and added to any one lower rank group, the device adder 186*d* may add the added new air conditioner to pre-stored information on the control hierarchy structure.

For example, when a new air conditioner is added to a group, the added air conditioner may transmit its state information to other air conditioners 100 to 109 through a state information transmission controller 189. In this case, a group determiner 183 of another air conditioner, e.g., the first air conditioner 100, may determine whether an upper rank group and/or a lower rank group is set to the newly-added air conditioner, and determine whether the set upper rank group and/or the lower rank group is the same as the upper rank group and/or the lower rank group of the first air conditioner 100. When the upper rank group and/or the lower rank group of the newly-added air conditioners is the same as the upper rank group and/or the lower rank group of the first air conditioner 100, the device adder 186*d* may further add the newly-added air conditioner. In this case, the device adder 186*d* may newly add an air conditioner in accordance with a group of the newly-added air conditioners.

When a new air conditioner is added to information on the control hierarchy structure by the device adder 186*d*, a result of addition may be transmitted to the hierarchy structure error determiner 186*e*.

When a new device is added to information on the control hierarchy structure, or all or some of the existing devices 100 to 109 are deleted from the information on the control hierarchy structure, the hierarchy structure error determiner 186*e* may determine whether an error has occurred in the control hierarchy structure.

For example, when all or some of the existing devices 100 to 109 are deleted from information on the control hierarchy structure, the hierarchy structure error determiner 186*e* may determine whether a deleted air conditioner is a main controlling air conditioner, e.g., the first air conditioner 100, and when it is determined that the deleted air conditioner is the main controlling air conditioner, e.g., the first air conditioner 100, may determine that an error has occurred in the control hierarchy structure in accordance with a result of determination.

When a new device is added to information on the control hierarchy structure, the hierarchy structure error determiner 186*e* may determine whether a main controlling device related to the newly-added air conditioner determined by control authority determiner 184 is the same as an existing main controlling device, e.g., the first air conditioner 100, and when the main controlling device related to the newly-added air conditioner is different from the existing main controlling device, may determine that an error has occurred. For example, when the first air conditioner 100 is set as the main controlling device, and the newly-added air conditioner is also set as the main controlling device, the hierarchy structure error determiner 186*e* may determine that an error has occurred since there are a plurality of main controlling devices. According to an embodiment, the hierarchy structure error determiner 186*e* may determine whether the number of times in which the main controlling device related to the newly-added air conditioner is different from the existing main controlling device exceeds a predetermined number of times and may determine that an error has occurred in accordance with a result of determination. For example, when the main controlling device related to the newly-added air conditioner is different from the existing main controlling device, the hierarchy structure error determiner 186*e* may increase a count as illustrated in FIG. 17. The hierarchy structure error determiner 186*e* may increase or reset a count every time control hierarchy structure basic information or state information including the same is transmitted from the newly-added air conditioner, and when a count value exceeds a preset reference value, determine that an error has occurred.

When it is determined that an error has occurred in the control hierarchy structure as above, the hierarchy structure error determiner 186*e* may generate a control signal for at least one of a sound output device and a lighting device to output an error message to the outside and transmit the error message to each component.

FIG. 18 is a view illustrating a first operation controller according to an embodiment.

A first operation controller 187 may generate a control signal for controlling operations of air conditioners 100 to 109 in response to the control signal transmitted from a main controlling air conditioner, e.g., a first air conditioner 100, or a sub-controlling air conditioner, e.g., a second air conditioner 101, and transmit the generated control signal to corresponding components of the air conditioners 100 to 109.

According to an embodiment illustrated in FIG. 18, the first operation controller 187 may include a control authority presence determiner 187*a* and a control signal generator 187*b*.

When the control signal is transmitted from other air conditioners 100 to 109 outside, the control authority presence determiner 187*a* may determine from which of the air conditioners 100 to 109 the control signal has been transmitted, and determine whether the control signal has been transmitted from an air conditioner having proper control authority, e.g., a first air conditioner 100 or a second air conditioner 101 In this case, when the control signal related to specific operation is received, the control authority presence determiner 187*a* may determine whether the control signal related to the specific operation has been transmitted from air conditioners 100 and 101 having control authority over the specific operation, with reference to a table related to control authority illustrated in FIG. 13.

For example, the control authority presence determiner 187*a* may use sender information included in the transmitted control signal to determine from which air conditioner the control signal has been transmitted. Such sender information may be extracted and acquired from a source address or the like stored in a header of the transmitted control signal.

When the transmitted control signal has been transmitted from an air conditioner having proper control authority, the control authority presence determiner 187*a* may transmit a control signal generation command in accordance with a result of determination to the control signal generator 187*b* for the control signal generator 187*b* to generate the control signal for each component corresponding to the transmitted control signal.

Conversely, when the transmitted control signal has not been transmitted from an air conditioner having proper control authority, the control authority presence determiner 187*a* may reject or ignore such a control signal. The control authority presence determiner 187*a* may generate the control signal for at least one of a sound output device and a lighting device to output an error message to the outside as necessary and transmit the generated control signal to at least one of displays 96 and 198, the sound output device, and the lighting device.

For example, when the control signal related to on/off operation has been transmitted from a second air conditioner 101 without authority over such an operation, the control authority presence determiner 187*a* may ignore the control signal that has been transmitted from the second air conditioner 101.

According to an embodiment, when the transmitted control signal has not been transmitted from an air conditioner having proper control authority, the control authority presence determiner 187*a* may determine whether the transmitted control signal is a control signal related to operation of an air conditioner. For example, the control authority presence determiner 187*a* may determine whether the transmitted control signal is a control signal related to operation of an air conditioner such as changing set temperature or is a control signal irrelevant to operation of an air conditioner such as changing a control hierarchy structure. When the transmitted control signal is a control signal related to operation of an air conditioner, as described above, the control authority presence determiner 187*a* may ignore such a control signal. Conversely, when the transmitted control signal is not a control signal related to operation of an air conditioner, the control authority presence determiner 187*a* may transmit a control signal generation command to the control signal generator 187*b* for the control signal generator 187*b* to generate a control signal related to each component in accordance with the transmitted control signal. In other words, the control authority presence determiner 187*a* may cause the control signal generator 187*b* to either generate or not generate the control signal in accordance with a type of transmitted control signal.

The control signal generator 187*b* may generate the control signal related to each component corresponding to the transmitted control signal in accordance with a result of determination by the control authority presence determiner 187*a*, and transmit the generated control signal to each component via a circuit, a conducting wire, or the like. Accordingly, specific air conditioners 100 to 109 are operated in accordance with the control signal transmitted from the main controlling air conditioner, e.g., the first air conditioner 100, and/or the sub-controlling air conditioner, e.g., the second air conditioner 101.

Referring to FIG. 6, a second operation controller 188 may generate the control signal related to operation of other air conditioners 100 to 109 in accordance with user manipulation or a predefined setting, and transmit the generated control signal to the other air conditioners 100 to 109. Here, the control signal generated by the second operation controller 188 may be determined in accordance with control authority that an air conditioner has. For example, the first air conditioner 100 serving as the main controlling air conditioner may generate the control signal related to a specific operation illustrated in FIG. 13 for any of the air conditioners 100 to 109 in an upper rank group 9. The generated control signal may be transmitted to a communicator 199 and be transmitted to other air conditioners 100 to 109 through the communicator 199.

Depending on the embodiment, when a user's command input via a user interface 94 or the like is a command related to operation over which the sub-controlling air conditioner, i.e., the second air conditioner 101, has control authority, the second operation controller 188 may generate information indicating that a user's command related to operation over which the second air conditioner 101 has control authority has been input and may transmit the generated information to the second air conditioner 101 through the communicator 199. The second operation controller of the second air conditioner 101 may generate the control signal related to specific operation over which the second air conditioner 100 has control authority in accordance with information transmitted from the first air conditioner 100. Depending on the embodiment, the second operation controller of the second air conditioner 101 may generate a predetermined control signal in accordance with a user's command directly transmitted through an input unit of the second air conditioner and a control range of the second air conditioner 101 itself, and transmit the generated control signal to other air conditioners 102 and 103 within the same lower rank group.

Hereinafter, an example in which each air conditioner is controlled within an air conditioner controlling system will be described in more detail on the basis of the above description. Hereinafter, for convenience of description, a case in which the first air conditioner 100 is set as the main controlling air conditioner, and the second air conditioner 101 is set as the sub-controlling air conditioner, will be described as an example.

FIG. 19 is a view for describing controlling a controlled air conditioner by a main controlling air conditioner.

A first air conditioner 100 may be set to have control authority over all or some operations of all air conditioners 100 to 109 in an upper rank group 9. In this case, when the first air conditioner 11 transmits a control signal within an authority range to another air conditioner belonging to the upper rank group 9, e.g., a third air conditioner 102, the third air conditioner 102 determines that the control signal transmitted from the first air conditioner 100 is a proper control signal and is operated in accordance with the control signal transmitted from the first air conditioner 100.

FIG. 20 is a view for describing controlling a controlled air conditioner by a sub-controlling air conditioner.

A second air conditioner 101 may be set to have some authority transferred from a first air conditioner 100 in relation to all air conditioners 100 to 105 within a first lower rank group 10. In this case, when the second air conditioner 101 generates a control signal within a range of authority transferred from the first air conditioner 100 and then transmits the generated control signal to another air conditioner belonging to the first lower rank group 10, e.g., a third air conditioner 102, as described above, the third air conditioner 102 may determine that the control signal transmitted from the second air conditioner 101 is a proper control signal and may be operated in accordance with the control signal transmitted from the second air conditioner 101.

FIG. 21 is a view for describing an operation of a controlled air conditioner in response to a control signal by an air conditioner without control authority.

A second air conditioner 101 is merely set to have some authority transferred from a first air conditioner 100 in relation to all air conditioners 100 to 105 within a first lower rank group 10, and does not have control authority over air conditioners 104 and 105 within another lower rank group, e.g., a second lower rank group 20. Therefore, when an error occurs in the second air conditioner 101 or a problem occurs in a network, and a control signal generated from the second air conditioner 101 is transmitted to another air conditioner belonging to the second lower rank group 20, e.g., a fifth air conditioner 104, as described above, the fifth air conditioner 104 may determine that the control signal transmitted from the second air conditioner 101 has not been transmitted from an air conditioner having proper control authority, and ignore the control signal transmitted from the second air conditioner 101. In this case, the fifth air conditioner 104 may wait until another control signal is transmitted thereto.

A state information transmission controller 189 may control state information of air conditioners 100 to 109, in which the state information transmission controller 189 is provided, to be transmitted to other air conditioners 100 to 109 through a communicator 199. Specifically, the state information transmission controller 189 may browse a storage 191, generate state information, transmit the generated state information to the communicator 199. Generation and transmission of state information may be performed periodically or non-periodically. For example, generation and transmission of state information may be performed every second. Here, as described above, the state information may include information related to groups 9 and 10 to 40 to which the air conditioners 100 to 109 belong and control authority thereof and control hierarchy structure basic information.

As illustrated in FIG. 6, the storage 191 may include a device information storage 192. The device information storage 192 is provided to store information on an air conditioner in which the storage 191 is provided, e.g., the first air conditioner 100, and/or information on the other air conditioners 101 to 109. The device information storage 192 may further store information on a control hierarchy structure.

Specifically, the device information storage 192 may include a first device information storage 192*a*, a second device information storage 192*b*, and a hierarchy structure information storage 192*c*. The first device information storage 192*a* is provided to store information on an air conditioner in which the storage 191 is provided, e.g., the first air conditioner 100, the second device information storage 192*b* is provided to store information on other air conditioners 101 to 109, and the hierarchy structure information storage 192*c* is provided to store information on the control hierarchy structure.

When determination has ended, the above-described group determiner 183, control authority determiner 184, and control authority processor 185 may simultaneously transfer a result of determination to other parts in a control information processor 182 and to the storage 191 for the device information storage 192 of the storage 191 to store the result of determination. In this case, each result of determination may be stored in a corresponding storage of the first device information storage 192*a* and the second device information storage 192*b*. A control hierarchy structure processor 186 may transmit generated or updated information on the control hierarchy structure to the hierarchy structure information storage 192*c* simultaneously or at different time with generation or update of the control hierarchy structure, for the hierarchy structure information storage 192*c* to store the generated or updated information on the control hierarchy structure.

Depending on the embodiment, the first device information storage 192*a*, the second device information storage 192*b*, and the hierarchy structure information storage 192*c* may be implemented by the same physical storage device or different physical storage devices. Some of the first device information storage 192*a*, the second device information storage 192*b*, and the hierarchy structure information storage 192*c* may be implemented by the same physical storage device, and the other thereof may be implemented by different physical storage devices.

FIG. 22 is a control block diagram for describing an example in which each air conditioner is operated in an air conditioner controlling system.

Hereinafter, the overall operation of an air conditioner controlling system illustrated in FIGS. 2 and 3 will be described on the basis of the above description. Hereinafter, for convenience of description, a case in which the control hierarchy structure of an air conditioner controlling system is set to include a single upper rank group 9 and a first lower rank group 10 to a fourth lower rank group 40 that belong to the single upper rank group 9 will be described as an example. In the example, which will be described below, the first lower rank group 10 includes a first air conditioner 100 to a fourth air conditioner 103, the second lower rank group 20 includes a fifth air conditioner 104 and a sixth air conditioner 105, the third lower rank group 30 only includes a seventh air conditioner 106, the fourth lower rank group 40 includes an eighth air conditioner 107 to a tenth air conditioner 109, the first air conditioner 100 is set as a main controlling air conditioner, and the second air conditioner 101, the fifth air conditioner 104, the seventh air conditioner 106, and the eighth air conditioner 107 are respectively set as sub-controlling air conditioners of the first lower rank group 10 to the fourth lower rank group 40 in that order.

Referring to FIG. 22, at least one of a user interface 94 and an external control system 90 may receive a command or information related to operation of air conditioners 100 to 109 from a user. In this case, information input by a user may include control hierarchy structure basic information. A command or information input by a user may be transmitted to the first air conditioner 100. When information input by a user is the control hierarchy structure basic information, the control hierarchy structure basic information may be transmitted to all of the air conditioners 100 to 109, and in this case, the control hierarchy structure basic information may also be transmitted to other air conditioners 101 to 109 via the first air conditioner 100, which is a main controlling air conditioner, in accordance with a defined setting.

The first air conditioner 100 belongs to the first lower rank group 10, and may receive a user's command or information input via at least one of the user interface 94 and the external control system 90 and generate a control signal in accordance with the received user's command or information. Here, the generated control signal may be the control signal related to an operation over which the first air conditioner 100 has control authority. The generated control signal may be transmitted to all of the other air conditioners 101 to 109. When the control signal is transmitted from the first air conditioner 100, all of the other air conditioners 101 to 109 determine whether the first air conditioner 100 that has transmitted the control signal has proper control authority, and when it is determined that the first air conditioner 100 that has transmitted the control signal has proper control authority, are operated in accordance with the transmitted control signal. The first air conditioner 100 may transmit state information of the first air conditioner 100 to all of the other air conditioners 101 to 109 as necessary. The transmission of state information may be performed periodically or non-periodically in accordance with a user's choice or a designer's setting.

The second air conditioner 101 may generate the control signal related to other air conditioners 100, 102, and 103 belonging to the first lower rank group 10. The second air conditioner 101 may receive a user's command or information input via at least one of the user interface 94 and the external control system 90 and generate the control signal in accordance with the received user's command or information. Here, the generated control signal may be the control signal that has been generated on the basis of control authority transferred from the first air conditioner 100, or may be the control signal related to other operations over which the first air conditioner 100 does not have control authority. The second air conditioner 101 may transmit the generated control signal to the other air conditioners 100, 102, and 103 belonging to the first lower rank group 10, and in this case, the other air conditioners may include the first air conditioner 100 that serves as a main controlling device 100. When the control signal is transmitted from the second air conditioner 101, the other air conditioners 100 to 103 within the first lower rank group 10 determine whether the second air conditioner 101 that has transmitted the control signal has proper control authority or has control authority related to specific authority, and when it is determined as a result of determination that the control signal transmitted from the second air conditioner 101 is the control signal generated in accordance with proper control authority, are operated in accordance with the transmitted control signal. The second air conditioner 101 may transmit state information of the second air conditioner 100 to all of the other air conditioners 101 to 109 as necessary or to the air conditioners 101 to 103 within the first lower rank group 10, and such transmission of state information may be performed periodically or non-periodically.

The third air conditioner 102 and the fourth air conditioner 103 may be controlled in accordance with the control signal transmitted from the first air conditioner 100 and/or the second air conditioner 101. As illustrated in FIG. 13, some of the operations that may be performed by the third air conditioner 102 and the fourth air conditioner 103 may be performed in accordance with the control signal transmitted from the first air conditioner 100, and the other thereof may be performed in accordance with the control signal transmitted from the second air conditioner 101. The third air conditioner 102 and the fourth air conditioner 103 may transmit pieces of state information of the third air conditioner 102 and the fourth air conditioner 103 to all of the other air conditioners 101 to 109 as necessary or to all of the other air conditioners 101 to 103 within the same lower rank group to which the third air conditioner 102 and the fourth air conditioner 103 belong, i.e., the first lower rank group 10.

Like the above-described second air conditioner 101, the fifth air conditioner 104 belonging to the second lower rank group 20 may control operation of the sixth air conditioner 105 in accordance with control authority that the fifth air conditioner 104 has. In this case, control authority of the second air conditioner 101 and control authority of the fifth air conditioner 104 may be the same as or different from each other. For example, in the latter case, although the second air conditioner 101 has control authority over air blowing operation, dehumidifying operation, and rotating operation of the other devices 100, 102, and 103, the fifth air conditioner 104 may be set to only have control authority over dehumidifying operation and rotating operation of another device 105.

The sixth air conditioner 105 may be operated in accordance with the control signal transmitted by the first air conditioner 100 and/or the fifth air conditioner 104. In this case, a specific operation of the sixth air conditioner 105 may be performed in accordance with the control signal of the first air conditioner 100, and another operation thereof may be performed in accordance with the control signal of the fifth air conditioner 104.

The fifth air conditioner 104 and the sixth air conditioner 105 may transmit state information thereof to all of the other air conditioners 101 to 109 periodically or non-periodically as necessary, or to all of the other air conditioners 104 and 105 within the second lower rank group 10 periodically or non-periodically.

The seventh air conditioner 106 in the third lower rank group 30 may receive the control signal from the first air conditioner 100, some of the operations that may be performed by the seventh air conditioner 106 may be controlled by the control signal of the first air conditioner 100, and the other thereof may be controlled by the control signal generated by the seventh air conditioner 106 itself. Although the seventh air conditioner 106 has authority of a sub-controlling air conditioner, the seventh air conditioner 106 does not transmit a separate control signal to the outside since there is no other controlled air conditioner belonging to the same lower rank group 30. When a new controlled air conditioner is added to the third lower rank group 30, the seventh air conditioner 106 may transmit a predetermined control signal to the newly-added air conditioner in accordance with control authority and control the newly-added air conditioner. The control authority of the seventh air conditioner 106 may be the same as at least one of the control authority of the second air conditioner 102 and the control authority of the fifth air conditioner 104 or may be different from both thereof.

The seventh air conditioner 105 may transmit state information thereof to all of the other air conditioners 101 to 109 periodically or non-periodically as necessary.

Like the above-described second air conditioner 101, the eighth air conditioner 107 in the fourth lower rank group 40 may control other air conditioners 108 and 109 belonging to the same fourth lower rank group 40 in accordance with set control authority. The control authority of the eighth air conditioner 107 may be the same as at least one of the control authority of the second air conditioner 102, the control authority of the fifth air conditioner 104, and the control authority of the seventh air conditioner 106, or may have control authority different from those of all of the other sub-controlling air conditioners 101, 104, and 106.

As described above, the ninth air conditioner 108 and the tenth air conditioner 109 may be operated in accordance with the control signal transmitted from the first air conditioner 100 or operated in accordance with the control signal transmitted from the eighth air conditioner 107. In this case, some of the operations that may be performed by the ninth air conditioner 108 and the tenth air conditioner 109 may be performed on the basis of the control signal transmitted from the first air conditioner 100, and the other thereof may be performed on the basis of the control signal transmitted from the first air conditioner 100.

The eighth air conditioner 107 to the tenth air conditioner 109 may transmit pieces of state information thereof to all of the other air conditioners 101 to 109 periodically or non-periodically as necessary, or to all of the other air conditioners 107 to 109 within the same fourth lower rank group 40 periodically or non-periodically.

As described above, the first air conditioner 100 to the tenth air conditioner 109 may use the control hierarchy structure basic information included in state information transmitted from all of the air conditioners 100 to 109 within the same upper rank group or all air conditioners within the same lower rank group to generate information on a control hierarchy structure, and may be controlled by other air conditioners, e.g., the main controlling air conditioner 100 or the sub-controlling air conditioners 102, 104, 106, and 107, or control other controlled air conditioners 103, 105, 108, and 109 in accordance with the generated information on the control hierarchy structure.

Hereinafter, an example of a method in which the plurality of air conditioners 100 to 109 are controlled without time delay will be described.

FIG. 23 is a view for describing an example in which each air conditioner transmits a control signal in an air conditioner controlling system, and FIG. 24 is a view for describing a method of synchronizing control between a plurality of air conditioners.

As illustrated in FIGS. 3 and 23, each of air conditioners 100 to 109 may include outdoor units 100*a* to 109*b* and indoor units 100*b* to 109*b*. In this case, a second controller 180 of the indoor units 100*b* to 109*b* may be implemented using microcomputers 1280 to 1282 (hereinafter referred to as MICOM) and connection control processors 1290 to 1292. The MICOMs 1280 to 1282 and the connection control processors 1290 to 1292 may be logically separated from each other or physically separated from each other. When physically separated from each other, the MICOMs 1280 to 1282 and the connection control processors 1290 to 1292 may be implemented using separate semiconductor chips and related components.

Hereinafter, for convenience of description, a case in which each air conditioner transmits a control signal on the basis of the MICOM 1280 and a connection control processor 1290 of the first air conditioner 100 will be described as an example.

The first MICOM 1280 may generate a control signal for the air conditioners 100 to 109, and here, the control signal may include the control signal for the other air conditioners 101 to 109 in addition to the control signal for the air conditioner 100 in which the first MICOM 1280 is installed.

The first connection control processor 1290 may receive an electrical signal output from the first MICOM 1280 and transmit the received electrical signal to a communicator 199.

According to an embodiment, as illustrated in FIG. 24, the electrical signal that is output from the first connection control processor 1290 and transmitted to the communicator 199 may be given as feedback to the first connection control processor 1290 while being transmitted to the communicator 199. Specifically, when the control signal is transmitted from the first connection control processor 1290 to the first communicator 199 through a transmitting-end channel Tx, the control signal which is the same as the transmitted control signal may be transmitted to a receiving-end channel Rx through another channel connecting the transmitting-end channel Tx and the receiving-end channel Rx, and the transmitted control signal may be transmitted to the first connection control processor 1290 through the receiving-end channel Rx for the electrical signal, which is output from the first connection control processor 1290 and transmitted to the communicator 199, to be given as feedback to the first connection control processor 1290 while being transmitted to the communicator 199.

The first connection control processor 1290 may transmit the control signal given as feedback as above to the first MICOM 1280, and in response to the feedback control signal, the first MICOM 1280 may generate the control signal related to operation of the first air conditioner 100 corresponding to the received control signal. Accordingly, the first MICOM 1280 may receive a control signal related to the first air conditioner 100 at a time point at which a control signal related to the other air conditioners 101 to 109 is transmitted, and output a control signal corresponding to the received control signal for the control times of the other air conditioners 101 to 109 and the first air conditioner 100 to be synchronized.

When the first MICOM 1280 provided in a first indoor unit 100*b* of the first air conditioner 100 separately generates the control signal related to each component of the first air conditioner 100 and the control signal related to the other air conditioners 101 to 109, transmits the control signal related to the first air conditioner 100 to each of the components, and transmits the control signal related to the other air conditioners 101 to 109 through the first communicator 199, time delay may occur in transmitting and gathering the control signals. However, when, as described above, the transmitted control signal is given as feedback using the first connection control processor 1290, and then the control signal related to each of the components of the first air conditioner 100 is generated in accordance with the feedback control signal, the time delay problem may be solved since time synchronization may be achieved in relation to control of the air conditioners 100 to 109.

Hereinafter, an air conditioner controlling system according to another embodiment will be described with reference to FIGS. 25 to 28.

FIG. 25 is a view for describing an air conditioner controlling system according to another embodiment, and FIG. 26 is a view for describing an air conditioner controlling system including lower-rank controlled air conditioners according to an embodiment. FIG. 27 is a control block diagram for describing an operation between lower-rank controlled air conditioners according to an embodiment, and FIG. 28 is a control block diagram for describing an operation between lower-rank controlled air conditioners according to according to another embodiment.

According to FIGS. 25 and 26, an air conditioner controlling system 1 may include a plurality of air conditioners 200 to 232 that belong to an upper rank group 9. Some air conditioners 200 to 206 of the plurality of air conditioners 200 to 232 may be set to belong to any one lower rank group 50 (hereinafter referred to as a fifth lower rank group) that belongs to the upper rank group 9, and the remaining air conditioners 230 to 232 of the plurality of air conditioners 200 to 232 may be set to belong to the upper rank group 9 but not to belong to any lower rank group.

Here, the air conditioners 200 to 206 in the fifth lower rank group 50 may include a main controlling air conditioner, e.g., an eleventh air conditioner 200, a sub-controlling air conditioner for air conditioners 200 to 204 in the fifth lower rank group 50, e.g., a twelfth air conditioner 201, and the controlled air conditioners 202 to 204 controlled by at least one of the main controlling air conditioner 200 and the sub-controlling air conditioner 201. The air conditioners 200 to 206 in the fifth lower rank group 50 may also include lower-rank controlled air conditioners, e.g., the sixteenth air conditioner 205 and the seventeenth air conditioner 206, that perform operation which is the same as operation of any one of the controlled air conditioners 202 to 204, e.g., the fifteenth air conditioner 204 (hereinafter referred to as an upper-rank controlled air conditioner).

The lower-rank controlled air conditioners 205 and 206 may communicate with the upper-rank controlled air conditioner 204, and in this case, the lower-rank controlled air conditioners 205 and 206 may be provided to not be able to communicate with air conditioners other than the upper-rank controlled air conditioner 204, e.g., the controlling air conditioner 200, the sub-controlling air conditioner 201, and the other controlled air conditioners 202 and 203. In other words, the lower-rank controlled air conditioners 205 and 206 may be provided to transmit and receive data or commands to and from only the upper-rank controlled air conditioner 204, and the upper-rank controlled air conditioner 204 may be provided to transmit and receive data or commands to and from the other air conditioners 200 to 204 and the lower-rank controlled air conditioners 205 and 206.

The upper-rank controlled air conditioner 204 or the lower-rank controlled air conditioners 205 and 206 may respectively include outdoor units 204*a*, 205*a*, and 206*a* and indoor units 204*b*, 205*b*, and 206*b* like other air conditioners, e.g., the main controlling air conditioner 200, and controllers 204*d*, 205*d*, and 206*d* may be respectively provided in at least one of the outdoor units 204*a*, 205*a*, and 206*a* and the indoor units 204*b*, 205*b*, and 206*b*.

The upper-rank controlled air conditioner 204 may be operated in accordance with a control signal of the main controlling air conditioner 200 or be operated in accordance with control of the sub-controlling air conditioner 201. As described above, some of the operations of the upper-rank controlled air conditioner 204 are performed in accordance with control of the main controlling air conditioner 200, and the other thereof are operated in accordance with control of the sub-controlling air conditioner 201. The upper-rank controlled air conditioner 204 may be operated in the same manner as the above-described controlled air conditioners 102, 103, 105, 108, and 109, for example, transmit a state signal to the other air conditioners 200 to 206 and 230 to 232, determine presence of authority in accordance with the control signal transmitted from the outside, or the like.

The lower-rank controlled air conditioners 205 and 206 are provided to perform the same operation as the operation of the upper-rank controlled air conditioner 204. Specifically, the lower-rank controlled air conditioners 205 and 206 may be operated in accordance with the control signal transmitted from the upper-rank controlled air conditioner 204, or check operation of the upper-rank controlled air conditioner 204 periodically or non-periodically, and perform the same operation as the operation of the upper-rank controlled air conditioner 204 on the basis of a result of checking.

Specifically, according to an embodiment, as illustrated in FIG. 27, the upper-rank controlled air conditioner, i.e., the fifteenth air conditioner 204, may include a communicator 204*c*, a second controller 204*d*, a main memory 204*e*, and an auxiliary memory 204*f*, the communicator 204*c* may receive the control signal of the eleventh air conditioner 200, and the second conditioner 204*d* may perform various operations such as determining a group on the basis of the received control signal of the eleventh air conditioner, determining an air conditioner having control authority, generating and updating information on a control hierarchy structure, or generating the control signal for each component of the upper-rank controlled air conditioner 204 in accordance with the control signal transmitted thereto from the air conditioner having control authority. The main memory 204*e* and/or the auxiliary memory 204*f* may store information on a group, information on an air conditioner having control authority, information on a control hierarchy structure, and information on the transmitted control signal temporarily or non-temporarily.

Here, the second controller 204*d* of the upper-rank controlled air conditioner 204 may, in response to receiving the control signal of the eleventh air conditioner 200, generate the control signal of the upper-rank controlled air conditioner 204 corresponding to the control signal of the eleventh air conditioner 200, and transmit the generated control signal to lower-rank controlled air conditioners, i.e., the sixteenth air conditioner 205 and the seventeenth air conditioner 206. Here, the control signal of the upper-rank controlled air conditioner 204 corresponding to the control signal of the eleventh air conditioner 200 includes the control signal for controlling the lower-rank controlled air conditioners 205 and 206 to perform the same operation as the operation of the upper-rank controlled air conditioner 204 performed by the control signal of the eleventh air conditioner 200.

The lower-rank controlled air conditioners 205 and 206 may respectively include communicators 205*c* and 206*c* and second controllers 205*d* and 206*d*. The communicators 205*c* and 206*c* may receive the control signal of the upper-rank controlled air conditioner 204 and transmit the received control signal to the second controllers 205*d* and 206*d*, and the second controllers 205*d* and 206*d* may generate the control signal for each component of the lower-rank controlled air conditioners 205 and 206 in accordance with the transmitted control signal.

Accordingly, the lower-rank controlled air conditioners 205 and 206 may be operated in the same manner as the upper-rank controlled air conditioner 204.

According to another embodiment, as illustrated in FIG. 28, the upper-rank controlled air conditioner, i.e., the fifteenth air conditioner 204, may receive the control signal of the eleventh air conditioner 200, which is the main controlling air conditioner, through the communicator 204*c*, acquire at least one of information on a group, information on an air conditioner having control authority, information on a control hierarchy structure, and information on the transmitted control signal on the basis of the control signal received using the second controller 240*f*, and store the acquired information in at least one of the main memory 204*e* and the auxiliary memory 204*f* temporarily or non-temporarily.

The lower-rank controlled air conditioners 205 and 206 may periodically or non-periodically transmit a data transmission request to the upper-rank controlled air conditioner 204 through the communicators 205*c* and 206*c*, respectively, and the upper-rank controlled air conditioner 204 may transmit at least one of information on groups stored in the main memory 204*e* and the auxiliary memory 204*f*, information on an air conditioner having control authority, information on a control hierarchy structure, and information on the transmitted control signal to the lower-rank controlled air conditioners 205 and 206 through the communicator 204*c*.

The respective second controllers 205*d* and 206*d* of the lower-rank controlled air conditioners 205 and 206 check operation of the upper-rank controlled air conditioner 204 on the basis of transmitted information, and when it is determined as a result of checking that operation of the upper-rank controlled air conditioner 204 has been changed, generate the control signal for operations of the lower-rank controlled air conditioners 205 and 206 to be changed in accordance with the change in operation of the upper-rank controlled air conditioner 204, and transmits the generated control signal to each component. When operations of the upper-rank controlled air conditioner 204 and the lower-rank controlled air conditioners 205 and 206 are the same, and operation of the upper-rank controlled air conditioner 204 is not changed, the respective second controllers 205*d* and 206*d* of the lower-rank controlled air conditioners 205 and 206 may control the lower-rank controlled air conditioners 205 and 206 to maintain performance of the ongoing operation.

By the above-described method, the lower-rank controlled air conditioners 205 and 206 may be operated in the same manner as the upper-rank controlled air conditioner 204.

Other than the above-described method, various mirroring methods or synchronizing methods that a designer may take into consideration may be used for the lower-rank controlled air conditioners 205 and 206 to perform the same operation as the operation being performed by the upper-rank controlled air conditioner 204.

Although the example in which the lower-rank controlled air conditioners 205 and 206 belong to the same lower rank group 50 as the upper-rank controlled air conditioner 204 has been described above, the lower-rank controlled air conditioners 205 and 206 may not necessarily belong to the same lower rank group as the upper-rank controlled air conditioner 204. For example, lower-rank controlled air conditioners may be the other air conditioners 230 to 232 that do not belong to the fifth lower rank group 50. Even in this case, the lower-rank controlled air conditioners 230 to 232 may perform the same operation as that of the upper-rank controlled air conditioner 204 by the same method as that described above.

Some of the lower-rank controlled air conditioners 230 to 232, e.g., the seventeenth air conditioner 230, may be set to perform the same function as the above-described upper-rank controlled air conditioner 204 for other lower-rank controlled air conditions, e.g., an eighteenth air conditioner 231 and a nineteenth air conditioner 232. In other words, the seventeenth air conditioner 230 may be set to receive the control signal from the upper-rank controlled air conditioner, i.e., the fifteenth air conditioner 204, or check operation of the fifteenth air conditioner 204 to operate in the same manner as the fifteenth air conditioner 204, and the eighteenth air conditioner 231 and the nineteenth air conditioner 232 may receive the control signal from the seventeenth air conditioner 230 or check operation of the seventeenth air conditioner 230 to operate in the same manner as the seventeenth air conditioner 230.

By making some of the plurality of controlled air conditioners to serve as an upper-rank controlled air conditioner or serve as a lower-rank controlled air conditioner as described above, an overload of the main controlling air conditioner 200 or the sub-controlling air conditioner 201 may be reduced. When a distance between the main controlling air conditioner 200 or the sub-controlling air conditioner 201 and the lower-rank controlled air conditioners 205, 206, 230 to 232 is large or it is difficult for a cable to be directly connected therebetween, since, even without directly connecting the main controlling air conditioner 200 or the sub-controlling air conditioner 201 and the lower-rank controlled air conditioners 205, 206, 230 to 232, the lower-rank controlled air conditioners 205, 206, 230 to 232 may be controlled just by connecting another controlled air conditioner 204, which is relatively adjacent to the lower-rank controlled air conditioners 205, 206, 230 to 232, to the lower-rank controlled air conditioners 205, 206, 230 to 232 through a communication cable, a cost for installing communication cables between air conditioners may be reduced.

Hereinafter, an air conditioner controlling method according to various embodiments will be described with reference to FIGS. 29 to 44.

FIG. 29 is a flowchart of an air conditioner controlling method according to an embodiment.

According to FIG. 29, first, an air conditioner may receive information related to a control hierarchy structure (S1000). The information related to a control hierarchy structure may include pieces of information related to groups to which air conditioners included in an air conditioner controlling system belong and control authority of specific groups.

The air conditioner may receive the information related to the control hierarchy structure from an external device, or receive the information related to the control hierarchy structure through an input unit directly installed in the air conditioner. Here, the external device may include an external device that is spaced apart from the air conditioner and may be manipulated by a user, e.g., the above-described user interface or external control device.

Then, from the information related to the control hierarchy structure, the air conditioner may determine the group to which the corresponding air conditioner belongs (S1001). In this case, the air conditioner may determine an upper rank group to which the corresponding air conditioner belongs and determine a lower rank group to which the corresponding air conditioner belongs, from among lower rank groups belonging to the upper rank group.

When the groups to which the air conditioner belongs are determined, the air conditioner may determine an air conditioner having control authority over each group, i.e., at least one of a main controlling air conditioner having control authority over an air conditioner belonging to the upper rank group and a sub-controlling air conditioner having control authority over an air conditioner belonging to a lower rank group (S1002). In this case, the control authority of the main controlling air conditioner and the control authority of the sub-controlling air conditioner may not overlap each other. In this case, the air conditioner may determine whether the corresponding air conditioner is the main controlling air conditioner, the sub-controlling air conditioner, or a controlled air conditioner using information on control authority. The air conditioner may also determine which of the air conditioners in the air conditioner controlling system are the main controlling air conditioner, the sub-controlling air conditioner, or the controlled air conditioner.

When control authority of the air conditioner is determined, the air conditioner is operated in accordance with the determined control authority (S1003). When the air conditioner is the main controlling air conditioner, the air conditioner may control other air conditioners belonging to the same upper rank group in accordance with a range of control authority. When the air conditioner is the sub-controlling air conditioner, the air conditioner may control other air conditioners belonging to the same lower rank group in accordance with a range of control authority. When the air conditioner is the controlled air conditioner, the air conditioner may be operated in accordance with a control signal transmitted from another air conditioner that has been determined as the main controlling air conditioner or the sub-controlling air conditioner.

Hereinafter, the above-described air conditioner controlling method will be described in more detail.

FIG. 30 is a first flowchart of a process of setting control authority of a specific air conditioner according to an embodiment.

First, a user may manipulate an input unit provided in a user interface, an external control device, or an air conditioner and set a control structure or control authority of a specific air conditioner (S1010). Such settings may be temporarily transmitted to a controller of the air conditioner in a data form.

The air conditioner may determine whether the user has set an upper rank group on the basis of transmitted data (S1011).

When the user has set an upper rank group (YES in S1011), the air conditioner may determine whether the air conditioner itself has been set as a main controlling air conditioner (S1012).

When it is determined that the air conditioner has been set as the main controlling air conditioner, the air conditioner may set itself as the main controlling air conditioner, and accordingly, change various control-related settings stored therein for the air conditioner to serve as the main controlling air conditioner (S1013).

After the air conditioner is set as the main controlling air conditioner, the user may manipulate a user interface, an external control device, or an input unit provided in the air conditioner, and input a command related to operation (S1014).

When the command related to operation is input from the user (YES in S1014), an air conditioner may be operated in accordance with the command input by the user, generate a control signal related to another air conditioner in accordance with control authority, and transmit the generated control signal to the other controlled air conditioner (S1016). In this case, as described above, the air conditioner may first generate the control signal related to the other controlled air conditioner, transmit the generated control signal to a communicator, receive the control signal transmitted from the communicator as feedback, and generate the control signal related to itself to remove or reduce a control time difference between a plurality of air conditioners.

When a command related to operation is not input from the user (NO in S1014), the air conditioner waits until the command is input from the user (S1015). In this case, the air conditioner may continuously perform operation that was being performed, e.g., a cooling operation, as necessary.

FIG. 31 is a second flowchart of a process of setting control authority of a specific air conditioner according to an embodiment.

When a user has not set an upper rank group (NO in S1011), or when the air conditioner itself is not set as a main controlling air conditioner (NO in S1012), the air conditioner may determine whether a lower rank group setting exists (S1020).

When the lower rank group setting exists (YES in S1020), the air conditioner may determine whether the corresponding air conditioner is a sub-controlling air conditioner (S1021).

When the corresponding air conditioner is the sub-controlling air conditioner (YES in S1021), the air conditioner may set itself as the sub-controlling air conditioner and change various settings stored therein to serve as the sub-controlling air conditioner (S1023).

After the air conditioner is set as the sub-controlling air conditioner, the user may manipulate a user interface, an external control device, or an input unit provided in the air conditioner, and input a command related to operation (S1024). The input command may be transmitted to another air conditioner set as the main controlling air conditioner, and the other air conditioner set as the main controlling air conditioner may generate a control signal in response to the input command. The input command may also be directly input to the air conditioner set as the sub-controlling air conditioner.

When the command related to operation is input from a user, the control signal is transmitted from another main controlling air conditioner, or both of the cases occur (YES in S1024), the air conditioner set as the sub-controlling air conditioner performs predetermined operation, e.g., operation of changing set temperature, in accordance with a user command or the control signal transmitted from the main controlling air conditioner (S1026).

In this case, the air conditioner may generate the control signal related to another controlled air conditioner belonging to the same lower rank group as necessary, and transmit the generated control signal to the controlled air conditioner. The control signal generated by the air conditioner may be generated in accordance with control authority transferred from the main controlling air conditioner. For example, when it is determined that operation corresponding to the user command, which is directly input or transmitted through the main controlling air conditioner, is present within a control range of the air conditioner itself, the air conditioner may generate the control signal in accordance with the user command and transmit the generated control signal to another air conditioner. Here, the other air conditioner to which the control signal is transmitted may include the main controlling air conditioner.

As described above, the air conditioner set as the sub-controlling air conditioner may be designed to remove or reduce a control time difference between a plurality of air conditioners by first generating the control signal related to the other air conditioner, transmitting the generated control signal to a communicator, receiving the control signal transmitted from the communicator as feedback, and generating the control signal related to itself.

When the command related to operation is not input from the user (NO in S1024), the air conditioner may wait until the command is input from the user (S1025). In this case, the air conditioner may continue to perform operation that was being performed as necessary.

FIG. 32 is a third flowchart of a process of setting control authority of a specific air conditioner according to an embodiment.

When an air conditioner is not even a sub-controlling air conditioner (NO in S1021), the air conditioner is set as a controlled air conditioner (S1030).

In this case, the air conditioner may receive a control signal from another air conditioner which is set as at least one of a main controlling air conditioner and a sub-controlling air conditioner (S1031), and when the control signal is received (YES in S1031), the air conditioner is operated in accordance with the received control signal (S1032). When the control signal is not received (NO in S1031), the air conditioner may wait until the control signal is transmitted thereto while continuing to perform operation that was being performed (S1033).

FIG. 33 is a second flowchart of a process of setting control authority of a specific air conditioner according to an embodiment.

When upper rank group and lower rank group settings related to an air conditioner do not exist (NO in S1020), the air conditioner may be set to be directly controlled by the user (YES in S1034). In other words, the air conditioner is set to be unable to control another air conditioner in accordance with control authority and is set be unable to be controlled by another air conditioner which is set as at least one of a main controlling air conditioner and a sub-controlling air conditioner.

In this case, when the user uses an input unit provided in the air conditioner, a separately-provided user interface, or an external control device, and inputs a command related to operation (YES in S1035), the air conditioner is operated in accordance with a user command (S1036). When the user command is not input, the air conditioner may wait until the user command is input thereto while continuing to perform operation that was being performed (S1035).

FIG. 34 is a first flowchart of a process in which a controlled air conditioner is controlled by at least one of a main controlling air conditioner and a sub-controlling air conditioner according to an embodiment.

When any one air conditioner is determined as the controlled air conditioner (S1040), accordingly, the air conditioner is set as the controlled air conditioner and is operated in accordance with the control signal transmitted from another air conditioner which is set as at least one of a main controlling air conditioner and a sub-controlling air conditioner (S1041).

The air conditioner set as the controlled air conditioner may determine whether the main controlling air conditioner has control authority over a specific event, i.e., specific operation (S1043). In other words, the air conditioner set as the controlled air conditioner may determine whether the main controlling air conditioner has control authority over ON/OFF operation as illustrated in FIG. 13.

After it is determined that the main controlling device has control authority over specific operation (YES in S1043), when the air conditioner receives the control signal related to the specific operation from an external device (S1044), the air conditioner may determine whether the control signal related to the specific operation has been transmitted from the main controlling device (S1045). In this case, the air conditioner may browse a header or the like of the transmitted control signal and determine whether the control signal has been transmitted from the main controlling device.

When the control signal related to the specific operation over which the main controlling device has control authority has been transmitted from the main controlling device (YES in S1045), the air conditioner performs operation in accordance with the transmitted control signal (S1046).

When the control signal related to the specific operation over which the main controlling device has control authority has not been transmitted from the main controlling device (NO in S1045), the air conditioner may determine whether the transmitted control signal is the control signal related to operation of the air conditioner (S1047). When the transmitted control signal is determined as the control signal related to operation of the air conditioner (YES in S1047), the air conditioner may reject or ignore the transmitted control signal (S1048). Conversely, for example, when the transmitted control signal is determined as the control signal not related to operation of the air conditioner, such as a control hierarchy structure update command (NO in S1047), the air conditioner is operated in accordance with the transmitted control signal (S1049).

FIG. 35 is a second flowchart of a process in which a controlled air conditioner is controlled by at least one of a main controlling air conditioner and a sub-controlling air conditioner according to an embodiment.

When the main controlling device does not have control authority over a specific operation (NO in S1043), the air conditioner determines whether the sub-controlling air conditioner has control authority (S1050).

After the air conditioner determines that the sub-controlling air conditioner has control authority over the specific operation (YES in S1050), when the air conditioner receives a control signal related to the specific operation over which the sub-controlling air conditioner has control authority (S1051), the air conditioner may determine whether the control signal related to the specific operation has been transmitted from the sub-controlling air conditioner (S1052).

When the control signal related to the specific operation over which the sub-controlling air conditioner has control authority has been transmitted from the sub-controlling air conditioner (YES in S1052), the air conditioner may be operated in accordance with the control signal transmitted from the sub-controlling air conditioner (S1053).

Conversely, when the control signal related to the specific operation over which the sub-controlling air conditioner has control authority has not been transmitted from the sub-controlling air conditioner (NO in S1052), the air conditioner may determine whether the transmitted control signal is the control signal related to operation of the air conditioner (S1054), in accordance with a result of determination, reject or ignore the control signal (S1055), or be operated in accordance with the control signal (S1056). Specifically, when the control signal is the control signal related to operation (YES in S1054), the air conditioner may ignore the control signal, and when the control signal is not the control signal related to operation (NO in S1054), the air conditioner may be operated in accordance with the control signal (S1056).

When neither the main controlling air conditioner nor the sub-controlling air conditioner has control authority over the specific operation (NO in S1050), the air conditioner may be set to receive a control command related to such the specific operation by the user (S1057). Depending on the embodiment, when neither of the main controlling air conditioner nor the sub-controlling air conditioner has control authority over the specific operation (NO in S1050), the air conditioner may also output an error message.

FIG. 36 is a flowchart of a process of updating information on a control hierarchy structure according to an embodiment.

An air conditioner may receive control hierarchy structure basic information related to groups to which other air conditioners belong and control authority thereof from the other air conditioners periodically or non-periodically (S1060).

The air conditioner may browse the received control hierarchy structure basic information, determine a group to which another air conditioner, which has transmitted the control hierarchy structure basic information, belongs, i.e., at least one of an upper rank group and a lower rank group to which the other air conditioner belongs (S1061), and determine control authority over the other air conditioner (S1062). Steps S1061 and S1062 may be sequentially performed in that order, simultaneously performed, or performed in a reverse order.

The air conditioner may generate information on a control hierarchy structure on the basis of the group to which the other air conditioner belongs and the control authority thereof (S1063). The generated information on the control hierarchy structure may be stored in a storage provided in the air conditioner, and the air conditioner may control another air conditioner or be controlled by another air conditioner in accordance with the generated control hierarchy structure (S1064).

When new control hierarchy structure basic information, which is different from existing pieces of information, is not received (NO in S1065), the air conditioner may control another air conditioner or be controlled by another air conditioner in accordance with a pre-stored control hierarchy structure (S1065).

When the new control hierarchy structure basic information, which is different from the existing pieces of information, is received (YES in S1065), the air conditioner may update information on a control hierarchy structure in accordance with the received control hierarchy structure (S1066). Here, the new control hierarchy structure basic information, which is different from the existing pieces of information, may include the control hierarchy structure basic information transmitted from a new air conditioner or the control hierarchy structure basic information transmitted from an existing air conditioner and changed by a user or the like. When the information on the control hierarchy structure is updated, the air conditioner may control another air conditioner or be controlled by another air conditioner in accordance with the newly-updated information on the control hierarchy structure (S1067).

When another piece of the new control hierarchy structure basic information is received (YES in S1068), as described above, the air conditioner may update information on the control hierarchy structure in accordance with the received control hierarchy structure basic information (S1066), and control another air conditioner or be controlled by another air conditioner in accordance with the information on the control hierarchy structure that has been newly updated again (S1067).

When another piece of the new control hierarchy structure basic information is not received (No in S1068), the air conditioner may be controlled in accordance with a control hierarchy structure that has been updated previously (S1069).

FIG. 37 is a flowchart of data transmission between air conditioners according to an embodiment.

According to an embodiment, an air conditioner may transmit state information to another air conditioner periodically or non-periodically.

Specifically, according to FIG. 37, the air conditioner may receive control hierarchy structure basic information of itself, i.e., information related to its own control hierarchy (S1070), and determine at least one of a group to which the air conditioner itself belongs, control authority over the air conditioner itself, and control authority of the air conditioner itself in accordance with the received information (S1071). The air conditioner may store a result of such determination (S1072).

Then, the air conditioner may transmit the stored result of determination to another air conditioner in accordance with a predefined setting or user manipulation (S1073). In this case, the air conditioner may transmit a result of determination to another air conditioner periodically or non-periodically. That is, the air conditioner may transmit the control hierarchy structure basic information to another air conditioner, and in this case, state information may be transmitted together with the control hierarchy structure basic information. The other air conditioner may grasp the group to which the air conditioner itself belongs, control authority over the air conditioner itself, and control authority of the air conditioner itself in accordance with the result of determination transmitted from the air conditioner, and maintain or update the control hierarchy structure or output an error message in accordance with a grasped result.

FIG. 38 is a first flowchart of a process of processing transmitted data when data is transmitted from another air conditioner according to an embodiment, FIG. 39 is a second flowchart of a process of processing transmitted data when data is transmitted from another air conditioner according to an embodiment, and FIG. 40 is a third flowchart of a process of processing transmitted data when data is transmitted from another air conditioner according to an embodiment.

As illustrated in FIG. 38, at least one air conditioner may receive predetermined data from another air conditioner periodically or non-periodically (S1080). Here, the predetermined data may include state information, control hierarchy structure basic information, or the like.

When control structure update information of the other air conditioner is transmitted (S1080), the at least one air conditioner may determine whether a setting related to an upper rank group to which the other air conditioner belongs is present (S1081), whether the upper rank group to which the at least one air conditioner belongs is the same as the upper rank group to which the other air conditioner belongs (S1082), whether a setting related to a lower rank group to which the other air conditioner belongs is present (S1083), and whether the lower rank group to which the at least one air conditioner belongs is the same as the lower rank group to which the other air conditioner belongs (S1084). Steps S1081 to S1084 may be sequentially performed in that order or may be simultaneously performed. The order in which steps S1081 to S1084 are performed may be changed in accordance with a designer's choice.

When settings related to the upper rank group and the lower rank group to which the other air conditioner belongs are present, and the upper rank group and the lower rank group to which the at least one air conditioner belongs are the same as the upper rank group and the lower rank group to which the other air conditioner belongs (YES in S1081, YES in S1082, YES in S1083, and YES in S1084), the at least one air conditioner may determine whether the other air conditioner is present in a control hierarchy structure stored in a storage of the at least one air conditioner (S1085).

When the other air conditioner is not present in the control hierarchy structure stored in the storage of the at least one air conditioner (NO in S1085), the at least one air conditioner may add the other air conditioner to the control hierarchy structure (S1090). Conversely, when the other air conditioner is present in the control hierarchy structure stored in the storage of the at least one air conditioner (YES in S1085), the at least one air conditioner may maintain the control hierarchy structure stored therein (S1086).

After the at least one air conditioner determines to maintain the existing control hierarchy structure (S1086) or adds the other air conditioner to the control hierarchy structure (S1090), the at least one air conditioner may determine whether a main controlling air conditioner of itself is the same as the main controlling air conditioner of the other air conditioner from which the predetermined data is transmitted (S1091). The at least one air conditioner may also determine whether a sub-controlling air conditioner of itself is the same as a sub-controlling air conditioner of the other air conditioner as necessary.

When the main controlling air conditioner of the at least one air conditioner itself is different from the main controlling air conditioner of the other air conditioner (NO in S1901), the at least one air conditioner may increase a count (S1093), and compare the count with a preset reference value (S1094). When the count exceeds the preset reference value (YES in S1094), the at least one air conditioner may determine that an error has occurred, and output an error message to the outside using at least one of a display, a sound output device, and a lighting device (S1095). When the main controlling air conditioner of the at least one air conditioner itself is the same as the main controlling air conditioner of the other air conditioner, the at least one air conditioner may reset a count so that a count value is modified to 0

When settings related to the upper rank group and the lower rank group to which the other air conditioner belongs are not present (NO in S1082, NO in S1084), the upper rank group to which the at least one air conditioner belongs is different from the upper rank group to which the other air conditioner belongs (NO in S1083), or as necessary, the lower rank group to which the at least one air conditioner belongs is different from the lower rank group to which the other air conditioner belongs (NO in S1085), the air conditioner may determine whether the other air conditioner is present in a control hierarchy structure (S1088), and when the other air conditioner is present in the control hierarchy structure (YES in S1088), delete the other air conditioner from the control hierarchy structure (S1089). When the other air conditioner is not present in the control hierarchy structure, the air conditioner maintains the control hierarchy structure (S1086).

Steps S1080 to S1096 may be repeated every time predetermined information such as control hierarchy structure basic information is received from another air conditioner (S1096).

FIG. 41 is a first flowchart of a process of processing transmitted data when data is transmitted from another air conditioner according to still another embodiment, and FIG. 42 is a second flowchart of a process of processing transmitted data when data is transmitted from another air conditioner according to still another embodiment. In FIGS. 41 and 42, i refers to an index for identifying the air conditioner.

As illustrated in FIG. 41, at least one air conditioner may determine whether predetermined data, e.g., state information or control hierarchy structure information, has been received from a first air conditioner at a specific time point (S1100, S1101).

When the predetermined data, e.g., the state information or the control hierarchy structure information, has been received from the first air conditioner at the specific time point (YES in S1011), the at least one air conditioner resets and initializes a count value related to another air conditioner. For example, the at least one air conditioner may correct an existing count value to zero in the case of a fourth air conditioner at a fourth time point illustrated in FIG. 17 (S1102).

The at least one air conditioner may perform predetermined operation in accordance with the data transmitted thereto. For example, when the control hierarchy structure information is transmitted thereto from the first air conditioner, the at least one air conditioner may generate, maintain, and/or update a hierarchy structure on the basis of the transmitted control hierarchy structure (S1103).

When predetermined data, e.g., state information or information on a control hierarchy structure, has not been received from the first air conditioner at the specific time point (S1110), the at least one air conditioner may determine whether the first air conditioner is present in the control hierarchy structure (S1111).

When the first air conditioner is not present in the control hierarchy structure, the at least one air conditioner may delete the first air conditioner from the control hierarchy structure. Conversely, when the first air conditioner is present in the control hierarchy structure, the at least one air conditioner may compare a period in which data of the first air conditioner is not received with a predefined period (S1112). To determine the period in which the data of the first air conditioner is not received, the at least one air conditioner may update a count value every time point as described above. Specifically, the at least one air conditioner may receive predetermined data from the first air conditioner periodically or non-periodically. When the predetermined data is not transmitted from the first air conditioner, the at least one air conditioner may record a count value by increasing the count value every time point to check a period in which the predetermined data is not received.

When the period in which the data of the first air conditioner is not received is longer than the predefined period (YES in S1112), the at least one air conditioner determines that the first air conditioner has been removed from the control hierarchy structure, deletes the first air condition from the information on the control hierarchy structure, and updates the control hierarchy structure (S1113). Conversely, when the period in which the data of the first air conditioner is not received is shorter than the predefined period (NO in S1112), the at least one air conditioner only records count values and repeats the above-described steps for another air conditioner. Specifically, the at least one air conditioner may determine whether data has been received from a subsequent air conditioner, e.g., a second air conditioner (S1104, S1105, S1101), and in accordance with a result of determination, generate, maintain, or update a hierarchy structure (S1103), increase a count related to the second air conditioner (S1111), delete the second air conditioner (S1113), or determine whether the second air conditioner is a main controlling air conditioner and/or a sub-controlling air conditioner (S1114, S1115).

When the first air conditioner is deleted (S1113), the at least one air conditioner may determine whether the first air conditioner is the main controlling air conditioner (S1114). When the first air conditioner is not the main controlling air conditioner (NO in S1114), the at least one air conditioner may determine whether the first air conditioner is the sub-controlling air conditioner (S1115).

When the deleted first air conditioner is the main controlling air conditioner or the sub-controlling air conditioner, the at least one air conditioner may determine that an error has occurred in the control hierarchy structure, and output an error message to the outside using at least one of a display, a sound output device, and a lighting device (S1116).

When the first air conditioner is neither the main controlling air conditioner nor the sub-controlling air conditioner, the at least one air conditioner may determine whether data has been received from the subsequent air conditioner, e.g., the second air conditioner, and generate, maintain, or update a hierarchy structure (S1104, S1105, S1101 to S1103).

Steps S1100 to S1116 described above may be repeated a number of times which is less than or equal to the number of air conditioners that may be installed in an air conditioner controlling system (S1104). Therefore, the at least one air conditioner may only determine whether data has been received from a limited number of air conditioner, and generate, maintain, or update a hierarchy structure.

FIG. 43 is a flowchart of a method of controlling a controlled air conditioner according to an embodiment.

As illustrated in FIG. 43, when any one of air conditioners is set as the controlled air conditioner (S1200), a lower-rank controlled air conditioner which is operated in the same way as the air conditioner set as the controlled air conditioner may be further set (S1201).

In this case, when the controlled air conditioner receives a control signal from at least one of a main controlling air conditioner and a sub-controlling air conditioner (S1202), the controlled air conditioner may transmit a control signal corresponding to the received control signal to the lower-rank controlled air conditioner (S1203). Here, the control signal corresponding to the received control signal includes the control signal for controlling the lower-rank controlled air conditioner to perform the same operation as that corresponding to the received control signal.

The lower-rank controlled air conditioner is operated in accordance with the control signal transmitted from the controlled air conditioner, and accordingly, the lower-rank controlled air conditioner is operated in the same way as the controlled air conditioner (S1204).

FIG. 44 is a flowchart of a method of controlling a controlled air conditioner according to another embodiment.

As illustrated in FIG. 44, when any one of air conditioners is set as a controlled air conditioner, a lower-rank controlled air conditioner which is operated in the same way as the air conditioner set as the controlled air conditioner may be further set (S1211).

The lower-rank controlled air conditioner may periodically or non-periodically check and monitor a preset controlled air conditioner (S1211). In this case, the lower-rank controlled air conditioner may periodically or non-periodically check and monitor the controlled air conditioner by periodically or non-periodically receiving information related to operation of the controlled air conditioner from the controlled air conditioner.

In this case, when the controlled air conditioner receives a control signal from at least one of a main controlling air conditioner and a sub-controlling air conditioner (S1212), the controlled air conditioner may change operation of the controlled air conditioner, and simultaneously, settings related to operation of the controlled air conditioner may be changed and stored (S1213).

The lower-rank controlled air conditioner may check such changes in operation of the controlled air conditioner, and in accordance with the changed operation of the controlled air conditioner, change settings related to operation of the lower-rank controlled air conditioner (S1214). In accordance with the changes in settings related to operation, the lower-rank controlled air conditioner may generate a control signal corresponding to changed operation and transmit the generated control signal to each component included in the lower-rank controlled device to be operated in the same way as the controlled air conditioner (S1215).

The above-described method of controlling an air conditioner may be implemented in the form of a program that may be performed through various computer means. Here, the program may include a program command, a data file, a data structure, and the like solely or in combination. Here, for example, the program may be designed and produced using a high-level language code that may be executed by a computer using an interpreter or the like, as well as a machine language code created by a compiler. The program may be specially designed to implement the above-described method of controlling an air conditioner, or may be implemented using various functions or definitions that are known and usable by one of ordinary skill in the computer software field.

A program for implementing the above-described method of controlling an air conditioner may be recorded in a computer-readable recording medium. For example, the computer-readable recording medium may include various types of hardware devices, which are capable of storing specific programs executed in accordance with a call of a computer or the like, including magnetic disk storage media such as a hard disk or a floppy disk, a magnetic tape, optical media such as a compact disk (CD) or a digital versatile disk (DVD), magneto-optical media such as a floptical disk, and solid state drives such as a ROM, a RAM, or a flash memory.

Although various embodiments of an air conditioner, an air conditioner controlling system, and an air conditioner controlling method have been described above, the air conditioner, the air conditioner controlling system, and the air conditioner controlling method are not limited to the above-described embodiments. Various embodiments that may be realized by one of ordinary skill in the art making changes or modifications on the basis of the above-described embodiments also correspond to the above-described air conditioner, air conditioner controlling system, and air conditioner controlling method. For example, even when the above-described techniques are performed in a different order from the above-described method, and/or elements of the above-described system, structure, device, circuit, or the like are coupled or combined in a different form from the above-described method or replaced or substituted with other elements or their equivalents, a result that is same as or similar to that of the above-described air conditioner, air conditioner controlling system, and air conditioner controlling method may be acquired.

The above-described air conditioner, air conditioner controlling system, and air conditioner controlling method can be used in various fields including homes, industrial sites, or the like, and thus are industrially applicable.

The invention claimed is:

1. An air conditioner controlling system comprising:

a plurality of controlled air conditioners belonging to an upper rank group;

a main controlling air conditioner, from among the plurality of controlled air conditioners, having control authority over the plurality of controlled air conditioners; and a sub-controlling air conditioner, from among the plurality of controlled air conditioners, having control authority over controlled air conditioner that belong to a first lower rank group, wherein the upper rank group includes at least one lower rank group, and the first lower rank group, from among the at least one lower rank group, comprises the sub-controlling air conditioner, wherein at least one of the plurality of the controlled air conditioners is configured to receive first information about the upper rank group and the at least one lower rank group and second information about the main controlling air conditioner and the sub-controlling air conditioner, and generate a control hierarchy structure related to the plurality of the controlled air conditioners based on the first information and the second information.

2. The air conditioner controlling system of claim 1, wherein the main controlling air conditioner is an air conditioner that belongs to any one lower rank group from among the at least one lower rank group.

3. The air conditioner controlling system of claim 1, wherein the sub-controlling air conditioner is an air conditioner that belongs to the first lower rank group.

4. The air conditioner controlling system of claim 1, wherein the control authority of the sub-controlling air conditioner includes control authority that is different from the control authority of the main controlling air conditioner over the controlled air conditioners belonging to the first lower rank group, in accordance with at least one of a user's choice and a predefined setting.

5. The air conditioner controlling system of claim 1, wherein the at least one of the plurality of controlled air conditioners is configured to determine at least one of the main controlling air conditioner and the sub-controlling air conditioner based on the control hierarchy structure.

6. The air conditioner controlling system of claim 1, wherein the at least one of the plurality of controlled air conditioners is configured to be operated in accordance with a control signal transmitted from an air conditioner having control authority over the at least one of the plurality of controlled air conditioners and ignore a control signal transmitted from an air conditioner other than the air conditioner having the control authority over the at least one of the plurality of controlled air conditioners.

7. The air conditioner controlling system of claim 1, wherein at least one of the main controlling air conditioner, the sub-controlling air conditioner, and the plurality of controlled air conditioners is configured to periodically or non-periodically receive information on at least one other air conditioner from the at least one other air conditioner.

8. The air conditioner controlling system of claim 7, wherein the at least one of the main controlling air conditioner, the sub-controlling air conditioner, and the plurality of controlled air conditioners is configured to use the information received from the at least one other air conditioner to determine whether the at least one other air conditioner is included in the control hierarchy structure.

9. The air conditioner controlling system of claim 7, wherein:

when the at least one other air conditioner is included in the control hierarchy structure, and the at least one other air conditioner does not exist in pre-stored information on the control hierarchy structure, the at least one of the main controlling air conditioner, the sub-controlling air conditioner, and the plurality of controlled air conditioners is configured to add the at least one other air conditioner to the pre-stored information on the control hierarchy structure; or when the at least one other air conditioner is not included in the control hierarchy structure, and the at least one other air conditioner exists in pre-stored information on the control hierarchy structure, the at least one of the main controlling air conditioner, the sub-controlling air conditioner, and the plurality of controlled air conditioners is configured to remove the at least one other air conditioner from the pre-stored information on the control hierarchy structure.

10. The air conditioner controlling system of claim 7, wherein:

the at least one of the main controlling air conditioner, the sub-controlling air conditioner, and the plurality of controlled air conditioners is configured to use information on the at least one other air conditioner to determine an air conditioner having control authority over the at least one other air conditioner; or the at least one of the main controlling air conditioner, the sub-controlling air conditioner, and the plurality of controlled air conditioners is configured to remove the at least one other air conditioner from pre-stored information on an air conditioner control hierarchy structure when information on the at least one other air conditioner is not received from the at least one other air conditioner for a predetermined amount of time or longer.

11. The air conditioner controlling system of claim 1, further comprising at least one lower-rank controlled air conditioner configured to perform a same operation as the plurality of controlled air conditioners.

12. An air conditioner controlling method comprising:

receiving first information about an upper rank group and a lower rank group to which an air conditioner and at least one other air conditioner belong and second information about at least one air conditioner, among the air conditioner and the at least one other air conditioner, having control authority for the upper rank group or the lower rank group;

generating third information about a control hierarchy structure related to the first air conditioner and the at least one other air conditioner based on the first information and the second information; and operating the first air conditioner in accordance with the control hierarchy structure.

* * * * *